US008743033B2

(12) United States Patent
Yamauchi

(10) Patent No.: US 8,743,033 B2
(45) **Date of Patent: *Jun. 3, 2014**

(54) PIXEL CIRCUIT AND DISPLAY DEVICE

(75) Inventor: Yoshimitsu Yamauchi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 204 days.

This patent is subject to a terminal disclaimer.

(21) Appl. No.: 13/504,884

(22) PCT Filed: Jun. 29, 2010

(86) PCT No.: PCT/JP2010/061004

§ 371 (c)(1),
(2), (4) Date: Apr. 27, 2012

(87) PCT Pub. No.: WO2011/052266

PCT Pub. Date: May 5, 2011

(65) Prior Publication Data

US 2012/0212476 A1 Aug. 23, 2012

(30) Foreign Application Priority Data

Oct. 29, 2009 (JP) ..... 2009-248965

(51) Int. Cl.
*G09G 3/34* (2006.01)

(52) U.S. Cl.
USPC ..... 345/84; 345/212; 349/130

(58) Field of Classification Search
USPC ..... 345/212, 82; 349/130
See application file for complete search history.

(56) References Cited

U.S. PATENT DOCUMENTS

| | | | | |
|---|---|---|---|---|
| 8,310,638 | B2 * | 11/2012 | Yamauchi et al. | 349/130 |
| 2004/0130544 | A1 | 7/2004 | Sun | |
| 2006/0232577 | A1 | 10/2006 | Edwards et al. | |

FOREIGN PATENT DOCUMENTS

| | | |
|---|---|---|
| JP | 61-69283 | 4/1986 |
| JP | 61-74481 | 4/1986 |
| JP | 2004-212924 | 7/2004 |
| JP | 2005-18088 | 1/2005 |
| JP | 2006-343563 | 12/2006 |
| JP | 2007-502068 | 2/2007 |
| JP | 2007-334224 | 12/2007 |

* cited by examiner

*Primary Examiner* — Viet Pham
(74) *Attorney, Agent, or Firm* — Morrison & Foerster LLP

(57) ABSTRACT

A display device where low power consumption is realized without lowering aperture ratio is provided. A liquid crystal capacitive element Clc is sandwiched between a pixel electrode 20 and an opposite electrode 80. The pixel electrode 20, one end of a first switch circuit 22, one end of a second switch circuit 23 and a first terminal of a second transistor T2 form an internal node N1. The other terminals of the first switch circuit 22 and the second switch circuit 23 are connected to a source line SL and a voltage supply line VSL, respectively. The second switch circuit 23 is a series circuit including a transistor T1 and diode D1. A control terminal of the transistor T1, a second terminal of the transistor T2 and one end of a boost capacitive element Cbst form an output node N2. The other end of the boost capacitive element Cbst and the control terminal of the transistor T2 are connected to a boost line BST and a reference line REF, respectively. The diode D1 has a rectifying function from the voltage supply line VSL to the internal node N1.

28 Claims, 36 Drawing Sheets

| | | | | | | |
|---|---|---|---|---|---|---|
| T1(H) | ON | OFF | ON | OFF | OFF | OFF |
| T1(M) | OFF | OFF | ON | OFF | OFF | OFF |
| T1(L) | OFF | OFF | OFF | OFF | OFF | OFF |
| T2(H) | OFF | OFF | OFF | OFF | ON | OFF |
| T2(M) | ON | OFF | OFF | OFF | ON | OFF |
| T2(L) | ON | OFF | ON | OFF | ON | OFF |
| T3 | OFF | OFF | OFF | OFF | OFF | OFF |

| | | | | | | |
|---|---|---|---|---|---|---|
| T1(H) | ON | OFF | ON | OFF | OFF | OFF |
| T1(M) | OFF | OFF | ON | OFF | OFF | OFF |
| T1(L) | OFF | OFF | OFF | OFF | OFF | OFF |
| T2(H) | OFF | OFF | | OFF | ON | OFF |
| T2(M) | ON | OFF | | OFF | ON | OFF |
| T2(L) | ON | ON | | OFF | ON | OFF |
| T3 | OFF | OFF | OFF | OFF | OFF | OFF |

| | | | | | | | | |
|---|---|---|---|---|---|---|---|---|
| T1(H) | ON | OFF | OFF | OFF | ON | OFF | OFF | OFF |
| T1(M) | OFF | OFF | OFF | OFF | ON | OFF | OFF | OFF |
| T1(L) | OFF | OFF | OFF | OFF | OFF | OFF | OFF | OFF |
| T2(H) | OFF | OFF | ON | OFF | OFF | OFF | ON | OFF |
| T2(M) | ON | OFF | ON | OFF | OFF | OFF | ON | OFF |
| T2(L) | ON | OFF | ON | OFF | ON | OFF | ON | OFF |
| T3 | OFF | OFF | OFF | OFF | OFF | OFF | OFF | OFF |

| | | | | | | |
|---|---|---|---|---|---|---|
| T1(H) | ON | OFF | ON | OFF | OFF | OFF |
| T1(M) | OFF | OFF | ON | OFF | OFF | OFF |
| T1(L) | OFF | OFF | OFF | OFF | OFF | OFF |
| T2(H) | OFF | OFF | OFF | OFF | ON | OFF |
| T2(M) | ON | OFF | OFF | OFF | ON | OFF |
| T2(L) | ON | OFF | ON | OFF | ON | OFF |
| T3 | OFF | OFF | OFF | OFF | OFF | OFF |

| | | | | | | |
|---|---|---|---|---|---|---|
| T1(H) | ON | OFF | ON | OFF | OFF | OFF |
| T1(M) | OFF | OFF | ON | OFF | OFF | OFF |
| T1(L) | OFF | OFF | OFF | OFF | OFF | OFF |
| T2(H) | OFF | OFF | OFF | OFF | ON | OFF |
| T2(M) | ON | OFF | OFF | OFF | ON | OFF |
| T2(L) | ON | OFF | ON | OFF | ON | OFF |
| T3 | OFF | OFF | OFF | OFF | OFF | OFF |

| | | | |
|---|---|---|---|
| T1(H) | OFF | ON | OFF |
| T1(M) | OFF | ON | OFF |
| T1(L) | OFF | | |
| T2(H) | OFF | | ON |
| T2(M) | OFF | | ON |
| T2(L) | ON | | |
| T3 | OFF | | |

| | | | |
|---|---|---|---|
| T1(H) | OFF | ON | OFF |
| T1(M) | OFF | ON | OFF |
| T1(L) | OFF | | |
| T2(H) | OFF | | ON |
| T2(M) | OFF | | ON |
| T2(L) | ON | | |
| T3 | OFF | | |

| | | | |
|---|---|---|---|
| T1(H) | OFF | ON | OFF |
| T1(M) | OFF | ON | OFF |
| T1(L) | OFF | | |
| T2(H) | OFF | | ON |
| T2(M) | OFF | | ON |
| T2(L) | ON | | |
| T3 | OFF | | |

PIXEL CIRCUIT AND DISPLAY DEVICE

REFERENCE TO RELATED APPLICATIONS

This application is a National Phase filing under 35 U.S.C. §371 of International Application No. PCT/JP2010/061004 filed on Jun. 29, 2010, and which claims priority to Japanese Patent Application No. 2009-248965 filed on Oct. 29, 2009.

FIELD OF THE INVENTION

The present invention relates to a pixel circuit and a display device including the pixel circuit and, in particular, an active-matrix type display device.

BACKGROUND OF THE INVENTION

In a mobile terminal such as a cellular phone or a mobile game console, a liquid crystal display device is generally used as a display means. Since a cellular phone is driven by a battery, a power consumption is strongly required to be reduced. For this reason, information such as time or a battery life that is required to be always displayed is displayed on a reflective sub-panel. In recent years, on the same main panel, a normal display by a full-color display and a reflective always-on display have been required to be compatible.

FIG. 35 shows an equivalent circuit of a pixel circuit in a general active-matrix type liquid crystal display device. FIG. 36 shows an example of a circuit arrangement of an active-matrix type liquid crystal display device having m×n pixels. Both reference symbols m and n denote integers each of which is 2 or more.

As shown in FIG. 36, switch elements configured by thin film transistors (TFTs) are arranged at intersections between m source lines SL1, SL2, . . . , SLm and n scanning lines GL1, GL2, . . . , GLn. In FIG. 35, the source lines SL1, SL2, . . . , SLm are represented by a source line SL, and, similarly, the scanning lines GL1, GL2, . . . , GLn are represented by a symbol GL.

As shown in FIG. 35, a liquid crystal capacitor element Clc and an auxiliary capacitor element Cs are connected in parallel to each other through a TFT. The liquid crystal capacitor element Clc is configured by a laminated structure in which a liquid crystal layer is formed between a pixel electrode 20 and a counter electrode 80. The counter electrode is also called a common electrode.

In FIG. 36 simply shows only a TFT and a pixel electrode (black rectangular portion) in each pixel circuit.

The auxiliary capacitor element Cs has one terminal (one electrode) connected to the pixel electrode 20 and the other terminal (other electrode) connected to an auxiliary capacitive line CSL to stabilize a voltage of pixel data held in the pixel electrode 20. The auxiliary capacitor Cs advantageously suppresses a voltage of pixel data held in a pixel electrode from varying due to generation of a leakage current in the TFT, a variation in electric capacity of the liquid crystal capacitor element Clc by a black display and a white display obtained by dielectric anisotropy held by liquid crystal molecules, a variation in voltage through a parasitic capacity between a pixel electrode and a peripheral wire, and the like. Voltages of the scanning lines are sequentially controlled to set TFTs connected to one scanning line to a conducting state, and voltages of pixel data supplied to source lines are written in corresponding pixel electrodes, respectively, in units of scanning lines.

In a normal display by a full-color display, even though display contents are a still image, the same display contents are repeatedly written in the same pixel for each frame. In this manner, the voltages of the pixel data held in the pixel electrodes are updated to minimize a variation in voltage of the pixel data and to secure a display of a high-quality still image.

A power consumption to drive a liquid crystal display device is almost controlled by a power consumption to drive a source line by a source driver, and is almost expressed by a relational expression represented by the following numerical expression 1. In numerical expression 1, reference symbol P denotes a power consumption; f, a refresh rate (the number of times of a refresh action of one frame per unit time); C, a load capacity driven by a source driver; V, a drive voltage of the source driver; n, the number of scanning lines; and m, the number of source lines. In this case, the refresh action is an operation that applies a voltage to a pixel electrode through a source line while keeping display contents.

$$P \propto f \cdot C \cdot V^2 \cdot n \cdot m \qquad \text{(Numerical Expression 1)}$$

In the always-on display, since the display contents are a still image, the voltage of the pixel data need not be always updated for each frame. For this reason, in order to further reduce the power consumption of the liquid crystal display device, a refresh frequency in the always-on display state is lowered. However, when the refresh frequency is lowered, a pixel data voltage held in a pixel electrode varies by an influence of a leakage current of a TFT. The variation in voltage causes a variation in display luminance (transmittance of liquid crystal) of each pixel and becomes to be observed as flickers. Since an average potential in each frame period also decreases, deterioration of display quality such as insufficient contrast may be probably caused.

In this case, as a method of simultaneously realizing a solution of a problem of deterioration of display quality caused by a decrease in refresh frequency and a reduction in power consumption in an always-on display of a still image such as a display of a battery life or time, for example, a configuration described in the following Patent Document 1 is disclosed. In the configuration disclosed in Patent Document 1, liquid crystal displays by both transmissive and reflective functions are possible. Furthermore, a memory unit is arranged in a pixel circuit in a pixel area in which a reflective liquid crystal display can be obtained. The memory unit holds information to be displayed in a reflective liquid crystal display unit as a voltage signal. In a reflective liquid crystal display state, a voltage held in the memory unit of the pixel circuit is read out to display information corresponding to the voltage.

In Patent Document 1, the memory unit is configured by an SRAM, and the voltage signal is statically held. For this reason, a refresh action is not required, and maintenance of display quality and a reduction in power consumption can be simultaneously realized.

[Patent Document 1] Unexamined Japanese Patent Publication No. 2007-334224

SUMMARY OF THE INVENTION

However, when the above configuration is applied to a liquid crystal display device used in a cellular phone or the like, in addition to an auxiliary capacitor element to hold a voltage of each pixel data serving as analog information in a normal operation, a memory unit to store the pixel data needs to be arranged for each pixel or each pixel group. In this manner, since the numbers of elements and signal lines to be formed on an array substrate (active matrix substrate) that configures the display unit in the liquid crystal display device increase, an aperture in a transmission mode decreases. When a polarity-inverted drive circuit to AC-drive a liquid crystal is arranged together with the memory unit, the aperture further decreases. In this manner, when the aperture decreases due to the increase in number of elements or signal lines, a luminance of a display image decreases in a normal display mode.

The always-on display mode is merely supposed to realize a two-tone display. However, an always-on display mode that can obtain a multi-tone display is also required to be realized. However, in order to realize the display mode described above, the number of required memory units increases, and the number of elements or signal lines further increases accordingly.

The present invention has been made in consideration of the above problems and, has as its object to provide a pixel circuit and a display device that can prevent deterioration of a liquid crystal and display quality with a low power consumption without causing a decrease in aperture, in particular, to make it possible to perform a refresh action even in a display mode in which a multi-color display is realized while suppressing the number of elements and signals from increasing.

In order to achieve the above object, according to the present invention, there is provided a pixel circuit including: a display element unit including a unit display element; an internal node that is a part of the display element unit and holds a voltage of pixel data applied to the display element unit; a first switch circuit that transfers the voltage of the pixel data supplied from a data signal line to the internal node through at least a predetermined switch element; a second switch circuit that transfers a voltage supplied from a voltage supply line different from the data signal line to the internal node without passing through the predetermined switch element; and a control circuit that holds a predetermined voltage depending on the voltage of the pixel data held by the internal node at one end of a first capacitor element and controls on/off of the second switch circuit, wherein the second switch circuit is configured by a series circuit including a first transistor element having a first terminal, a second terminal, and a control terminal that controls conduction between the first and second terminals, and a diode element, the control circuit is configured by a series circuit including a second transistor element having a first terminal, a second terminal, and a control terminal that controls conduction between the first and second terminals, and the first capacitor element, one end of the first switch circuit is connected to the data signal line, one end of the second switch circuit is connected to the voltage supply line, the other ends of the first and second switch circuits and the first terminal of the second transistor element are connected to the internal node, the diode element has a rectifying function in a direction from the voltage supply line to the internal node, the control terminal of the first transistor element, the second terminal of the second transistor element, and one end of the first capacitor element are connected to each other to form an output node of the control circuit, the control terminal of the second transistor element is connected to a first control line, and the other end of the first capacitor element is connected to a second control line.

At this time, the predetermined switch element may be configured by a third transistor element having a first terminal, a second terminal, and a control terminal that controls conduction between the first and second terminals, and the control terminal may be connected to a scanning signal line.

The second switch circuit may be configured by a series circuit including the first transistor element, the diode element, and a fourth transistor element having a first terminal, a second terminal, and a control terminal that controls conduction between the first and second terminals, and the control terminal may be connected to the second control line or connected to a third control line different from the second control line.

In the configuration described above, the first switch circuit may be configured by a series circuit including the fourth transistor element in the second switch circuit and the predetermined switch element or a series circuit including a fifth transistor element having a control terminal connected to the control terminal of the fourth transistor element in the second switch circuit and the predetermined switch element.

Furthermore, in addition to the configurations, the pixel circuit according to the present invention further includes a second capacitor element having one end connected to the internal node and having the other end connected to a fourth control line or a predetermined fixed voltage line.

According to the present invention, there is provided a display device in which a plurality of pixel circuits described above are arranged in a row direction and a column direction to configure a pixel circuit array, wherein the data signal line is arranged for each of the columns, one ends of the first switch circuits in the pixel circuits arranged along the same column are connected to the common data signal line, control terminals of the second transistor elements in the pixel circuits arranged along the same row or the same column are connected to the common first control line, the other ends of the first capacitor elements in the pixel circuits arranged along the same row or the same column are connected to the common second control line, and one terminal of the second switch circuits in the pixel circuits arranged along the same row or the same column are connected to the common voltage supply line, and a data signal line drive circuit that drives the data signal lines independently, and a control line drive circuit that drives the first control line, the second control line, and the voltage supply line independently are provided.

The display device according to the present invention has, in addition to the above characteristics, other characteristics in which the predetermined switch element is a third transistor element having a first terminal, a second terminal, and a control terminal that controls conduction between the first and second terminals, the control terminal is connected to a scanning signal line, the scanning signal line is arranged for each of the rows, the pixel circuits arranged along the same row are connected to the common scanning signal line, and a scanning signal line drive circuit that drives the scanning signal lines independently is provided.

In this case, when the second switch circuit is configured by a series circuit including the first transistor element, the diode element, and a fourth transistor element having a first terminal, a second terminal, and a control terminal that controls conduction between the first and second terminals, the control terminals of the fourth transistor elements in the pixel circuits arranged along the same row or the same column are connected to the common second control line. In addition to this, the control terminals of the fourth transistor elements may be connected to the common third control line. In this case, the third control line is controlled by the control line drive circuit.

In the configuration described above, furthermore, the first switch circuit may be configured by a series circuit including the fourth transistor element in the second switch circuit and the third transistor element or a series circuit including a fifth transistor element having a control terminal connected to the control terminal of the fourth transistor element in the second switch circuit and the third transistor element.

The display device according to the present invention has, in addition to the characteristics described above, other characteristics in which in a writing action for writing the pixel data in the pixel circuits arranged along one selected row independently, the scanning signal line drive circuit applies a predetermined selected row voltage to the scanning signal line of the selected row to tern on the third transistor elements arranged along the selected row and applies a predetermined non-selected row voltage to the scanning signal line of a non-selected row to turn off the third transistor elements arranged along the non-selected row, and the data signal line drive circuit applies data voltages corresponding to pixel data to be written in the pixel circuits of the columns of the selected row to the data signal lines, independently.

In the writing action, the control line drive circuit preferably applies a predetermined voltage to the first control line to turn on the second transistor element.

According to the present invention, there is provided a display device wherein, in a writing action for writing the pixel data in the pixel circuits arranged along one selected row, the scanning signal line drive circuit preferably applies a predetermined selected row voltage to the scanning signal line of the selected row to turn on the third transistor elements arranged along the selected row, and applies a predetermined non-selected row voltage to the scanning signal line of a non-selected row to turn off the third transistor elements arranged along the non-selected row, and the control line drive circuit applies a predetermined selecting voltage to the second control line of the selected row to turn on the fourth transistor elements, and applies a predetermined non-selecting voltage to the second control line of the non-selected row to turn off the fourth transistor elements, and the data signal line drive circuit applies data voltages corresponding to the pixel data to be written in the pixel circuits of the columns of the selected row to the data signal lines, independently.

In the pixel circuit, when the control terminal of the fourth transistor element is connected to the third control line, the control line drive circuit may apply the selecting voltage to the third control line of the selected row and apply the non-selecting voltage to the third control line of the non-selected row.

According to the present invention, there is provided a display device wherein the internal nodes of the pixel circuits in the pixel circuit array can hold one voltage state among a plurality of discrete voltage states, in which a multi-tone mode is realized by different voltage states, and in a self-refresh action for compensating for voltage variations of the internal nodes at the same time by operating the second switch circuit and the control circuit in the plurality of pixel circuits, the scanning signal line drive circuit applies a predetermined voltage to the scanning signal lines connected to all the pixel circuits in the pixel circuit array to turn off the third transistor elements, and in a state in which the control line drive circuit applies to the voltage supply line a refresh input voltage obtained by adding a predetermined first adjusting voltage corresponding to a voltage drop in the second switch circuit to a refresh target voltage corresponding to a voltage state of a target gradation level in which a refresh action is to be executed, and applies to the first control line a refresh reference voltage obtained by adding a predetermined second adjusting voltage corresponding to voltage drops in the first control line and the internal node to a refresh isolation voltage defined by an intermediate voltage between a voltage state of a gradation level one step lower than the target gradation level and a voltage state of the target gradation level, the control line drive circuit applies a boost voltage having a predetermined amplitude to the second control line to give a voltage change by a capacitive coupling through the first capacitor element to the output node, when a voltage state of the internal node is higher than the refresh target voltage, the diode element is reversely biased from the voltage supply line to the internal node not to electrically connect the voltage supply line to the internal node, when the voltage state of the internal node is lower than the refresh isolation voltage, a potential variation of the output node due to the application of the boost voltage is suppressed to turn off the first transistor element not to electrically connect the voltage supply line to the internal node, and when the voltage state of the internal node is the refresh isolation voltage or more and the refresh target voltage or less, the diode element is forwardly biased from the voltage supply line to the internal node, the first transistor element is turned on without suppressing a potential variation of the output node to give the refresh target voltage to the internal node, so that the refresh action to the pixel circuit having the internal node that exhibits the voltage state of the target gradation level is executed.

In this case, as other characteristics, in the pixel circuit, when the first switch circuit includes the fourth transistor element or the fifth transistor element, in a state in which the control line drive circuit applies a predetermined voltage that turn on the fourth transistor element to the third control line, the control line drive circuit applies a boost voltage having a predetermined amplitude to the second control line to give a voltage change by a capacitive coupling through the first capacitor element to the output node, thereby executing the refresh action to the pixel circuit having the internal node that exhibits the voltage state of the target gradation level.

In the above case, after application of a refresh reference voltage to the first control line and application of a boost voltage to the second control line, a predetermined voltage is preferably applied to the third control line.

In addition to the above characteristics, as other characteristics, in a state in which the third transistor element is turned off, the refresh input voltage is applied to the voltage supply line, and the refresh reference voltage is applied to the first control line, an action of applying the boost voltage to the second control line is executed more than once while changing the values of the refresh input voltage and the refresh isolation voltage, so that the refresh action is sequentially executed to the pixel circuits having the internal nodes that exhibit voltage states of different gradation levels.

At this time, while the values of the refresh input voltage and the refresh isolation voltage are changed the number of times that is equal to a number obtained by subtracting 1 from the number of gradation levels that is the number of voltage states that can be held by the internal nodes of the pixel circuits in the pixel circuit array, the boost voltage may be applied.

The display device according to the present invention has, in addition to the above characteristics, as other characteristics, after a refresh step in which, in a state in which the third transistor element is turned off, the refresh input voltage is applied to the voltage supply line, and the refresh reference voltage is applied to the first control line, an action of applying the boost voltage to the second control line is executed more than once while changing the values of the refresh input voltage and the refresh isolation voltage, a standby step is performed in which the control line drive circuit applies a voltage corresponding to a minimum value in a voltage state that can be held by the internal node to the voltage supply line without applying the boost voltage to the second control line, and applies a voltage at which the second transistor element can be turned on regardless of the voltage state of the internal node to the first control line for at least a predetermined period of time.

At this time, after the standby step is executed for a period of time that is ten or more times as long as that of the refresh step, the refresh step is preferably executed again.

In the above configuration, the first adjusting voltage is preferably a turn-on voltage of the diode element. The second adjusting voltage is preferably a threshold voltage of the second transistor element.

With the configuration of the present invention, in addition to a normal writing action, an action (self-refresh action) that returns an absolute value of a voltage between both ends of the display element unit to a value in the immediately previous writing action without performing a writing action can be performed. According to the present invention, when a pulse voltage is applied once, only a pixel circuit having an internal node to be returned to a voltage state of a target gradation level among the plurality of pixel circuits can be automatically refreshed, and a self-refresh action can be performed in a situation in which voltage states at multi-value levels are held in the internal nodes.

When a plurality of pixel circuits are arranged, a normal writing action is generally executed for each row. For this reason, at the maximum, a driver circuit need to be driven up to the number of times which is equal to the number of rows of the arranged pixel circuits.

According to the pixel circuit of the present invention, a self-refresh action is performed to make it possible to execute a refresh action to all the plurality of arranged pixels at once for each of the held voltage states. For this reason, the number of times of driving of a driver circuit required from the start of the refresh action to the end thereof can be greatly reduced to make it possible to realize a low power consumption.

Since a memory unit such as an SRAM need not be additionally arranged in the pixel circuit, an aperture ratio does not decrease unlike in the conventional art.

DETAILED DESCRIPTION OF THE INVENTION

Figure 35:
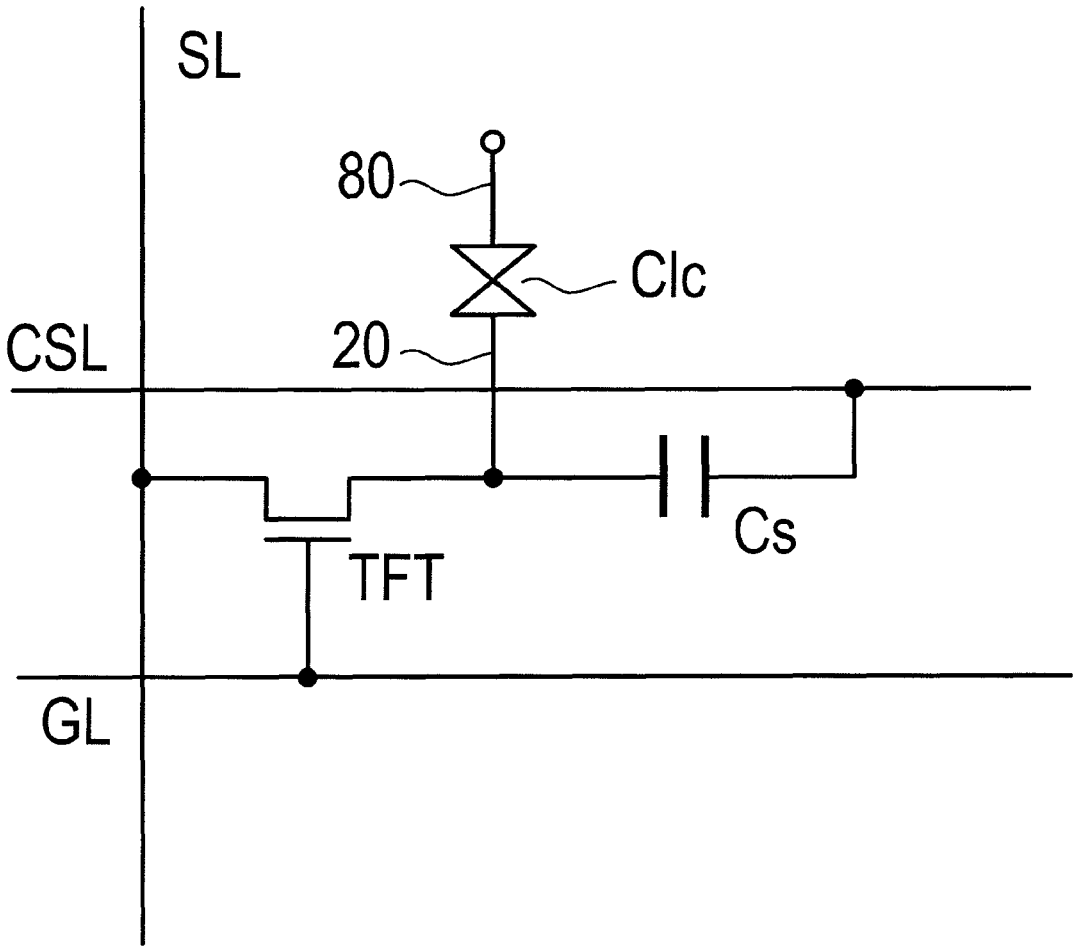
FIG. 35 shows an equivalent circuit of a pixel circuit in a general active-matrix type liquid crystal display device.
Figure 36:
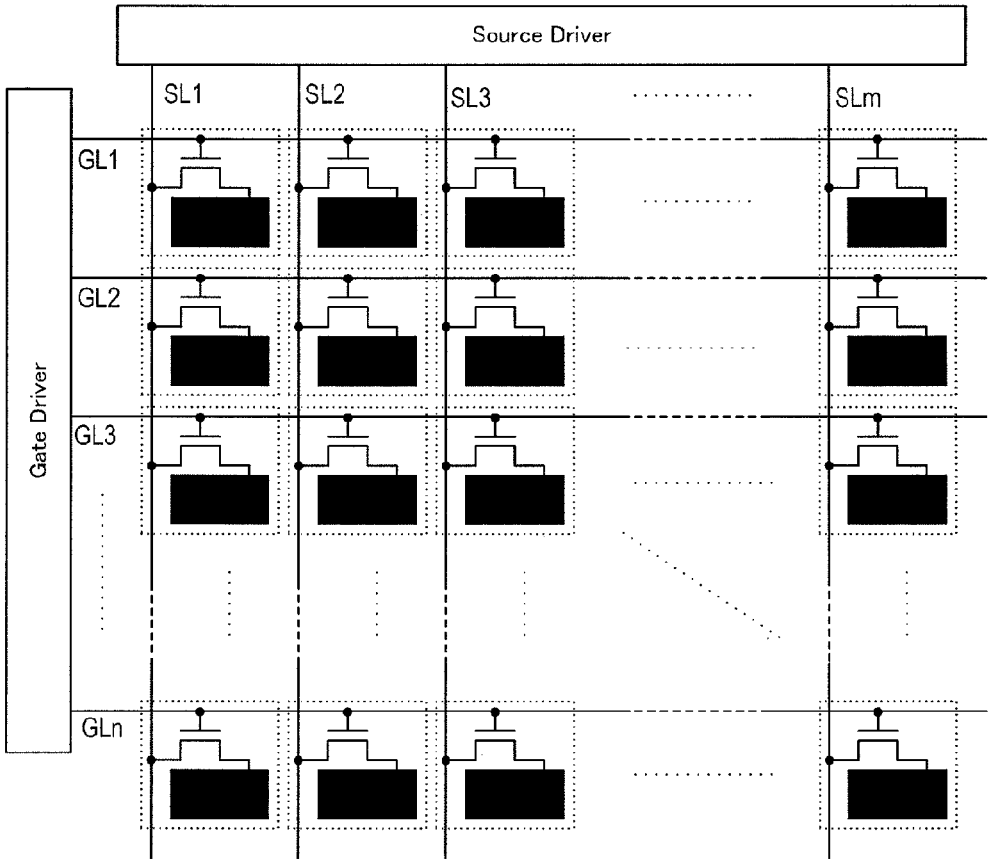
FIG. 36 is a block diagram showing an example of a circuit arrangement of an active-matrix type liquid crystal display device having m×n pixels.

Embodiments of a pixel circuit and a display device of the present invention will be described below with reference to the accompanying drawings. The same reference numerals as in FIGS. 35 and 36 denote the same constituent elements in the embodiments.

[First Embodiment]

In the first embodiment, configurations of a display device of the present invention (to be simply referred to as a "display device" hereinafter) and a pixel circuit of the present invention (to be simply referred to as a "pixel circuit" hereinafter) will be described below.

<Display Device>

Figure 1:
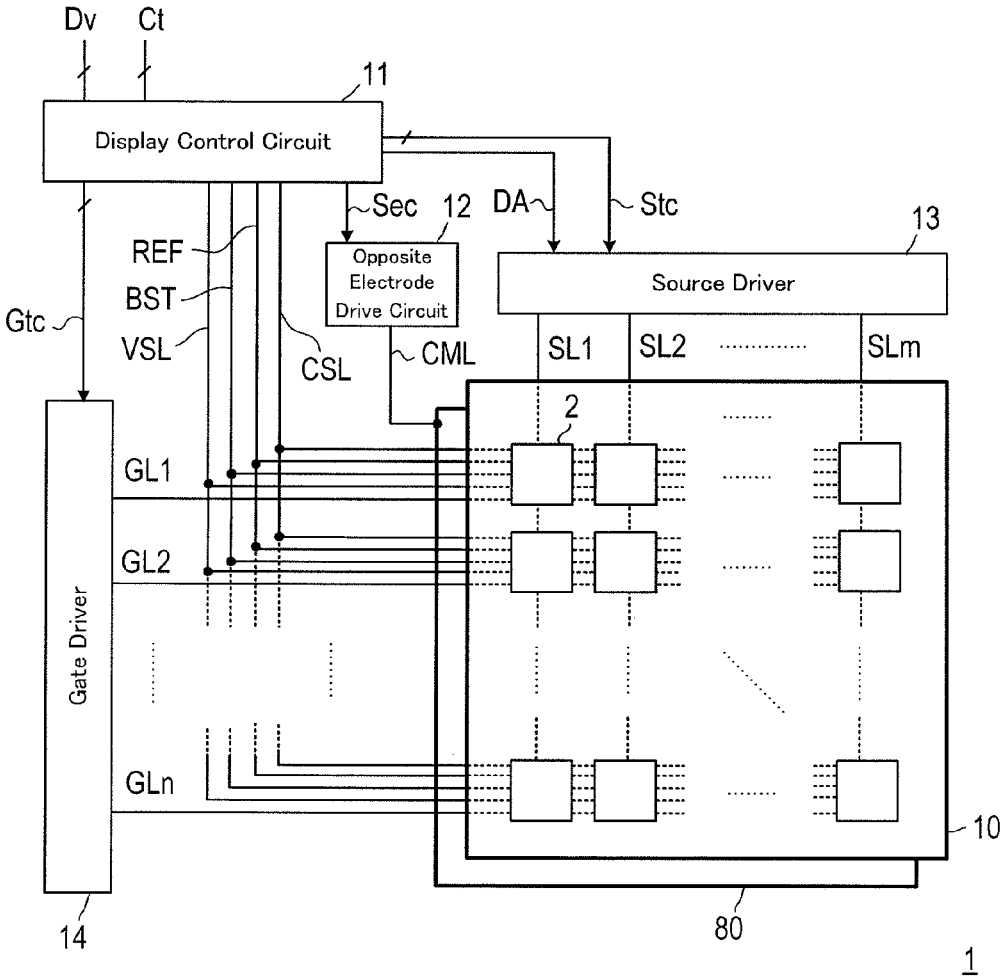
FIG. 1 is a block diagram showing an example of a schematic configuration of a display device according to the present invention.

FIG. 1 shows a schematic configuration of a display device 1. The display device 1 includes an active matrix substrate 10, a counter electrode 80, a display control circuit 11, a counter electrode drive circuit 12, a source driver 13, a gate driver 14, and various signal lines (will be described later). On the active matrix substrate 10, a plurality of pixel circuits 2 are arranged in row and column directions to form a pixel circuit array.

In FIG. 1, to avoid the drawings from being complex, the pixel circuits 2 are displayed to be blocked. In order to clarify that the various signal lines are formed on the active matrix substrate 10, for descriptive convenience, the active matrix substrate 10 is shown on the upper side of the counter electrode 80.

In the embodiment, the display device 1 has a configuration in which the same pixel circuits 2 are used to make it possible to perform screen display in two display modes including a normal display mode and an always-on display mode. The normal display mode is a display mode that displays a moving image or a still image in full color and uses a transmissive liquid crystal display using a back light. On the other hand, the always-on display mode of the embodiment is a display mode that performs display at a plurality of gradation levels the number of which is three or more and allocates the three adjacent pixel circuits 2 to three primary colors (R, G, and B), respectively. For example, when the number of gradation levels is 3, 27 colors are displayed. When the number of gradation levels is 4, 64 colors are displayed. However, the number of supposed gradation levels is smaller than that in a normal display mode.

Furthermore, in the always-on display mode, a plurality of sets of three adjacent pixel circuits can also be combined to each other to increase the number of display colors by area coverage modulation. The always-on display mode according to the embodiment is a technique that can be used in transmissive liquid crystal display or reflective liquid crystal display.

In the following explanation, for descriptive convenience, a minimum display unit corresponding to one pixel circuit 2 is called a "pixel", and "pixel data" written in each of the pixel circuits serves as tone data of each color in color display in three primary colors (R, G, and B). When color display is to be performed by using, in addition to the three primary colors, luminance data of a plurality of gradation levels, the luminance data is included in pixel data.

Figure 2:
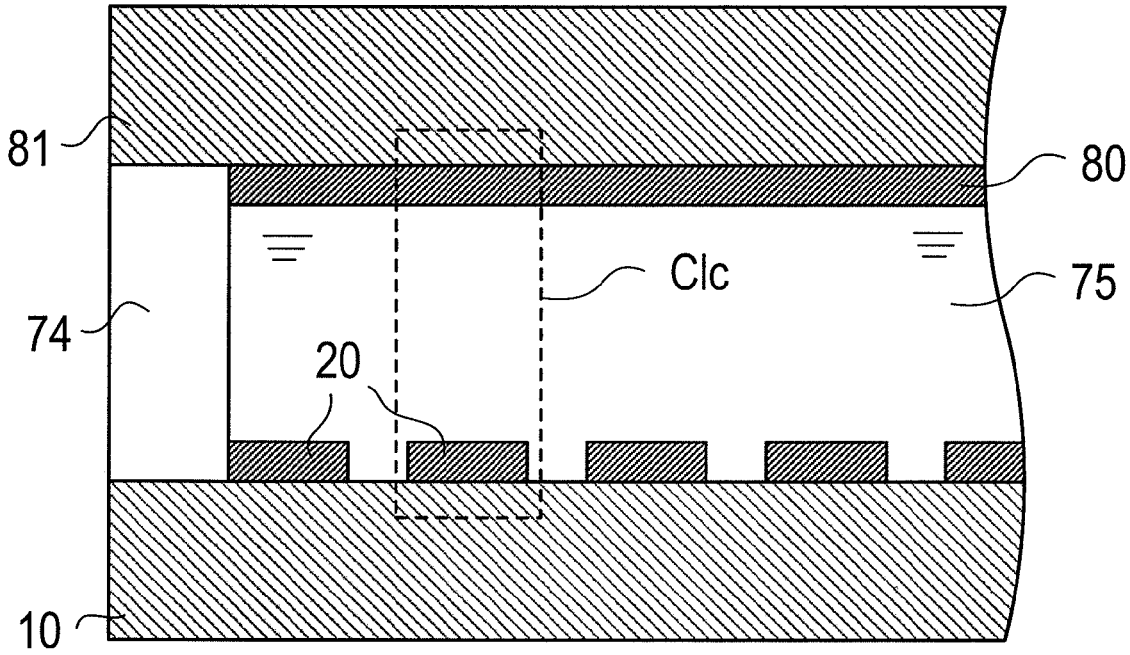
FIG. 2 is a schematic structural diagram of a partial section of a liquid crystal display device.

FIG. 2 is a schematic sectional structural diagram showing a relation between the active matrix substrate 10 and the counter electrode 80, and shows a structure of a display element unit 21 (see FIG. 4) serving as a constituent element of the pixel circuit 2. The active matrix substrate 10 is a light-transmitting transparent substrate made of, for example, glass or plastic.

As illustrated in FIG. 1, the pixel circuits 2 including signal lines are formed on the active matrix substrate 10. In FIG. 2, the pixel electrode 20 is illustrated as a representative of a constituent element of the pixel circuit 2. The pixel electrode 20 is made of a light-transmitting transparent conductive material, for example, ITO (indium tin oxide).

A light-transmitting counter substrate 81 is arranged to face the active matrix substrate 10, and a liquid crystal layer 75 is held in a gap between both the substrates. Deflection plates (not shown) are stuck to outer surfaces of both the substrates.

The liquid crystal layer 75 is sealed by a seal member 74 at the peripheral portions of both the substrates. On the counter substrate 81, the counter electrode 80 made of a light-transmitting transparent conductive material such as ITO is formed to face the pixel electrode 20. The counter electrode 80 is formed as a single film to spread on an almost entire surface of the counter substrate 81. In this case, a unit liquid crystal display element Clc (see FIG. 4) is formed by one pixel electrode 20, the counter electrode 80, and the liquid crystal layer 75 held therebetween.

A back light device (not shown) is arranged on a rear surface side of the active matrix substrate 10 to make it possible to emit light oriented from the active matrix substrate 10 to the counter substrate 81.

As shown in FIG. 1, a plurality of signal lines are formed in vertical and horizontal directions on the active matrix substrate 10. The plurality of pixel circuits 2 are formed in the form of a matrix at positions where m source lines (SL1, SL2, . . . , SLm) extending in the vertical direction (column direction) and n gate lines (GL1, GL2, . . . , GLn) extending in the horizontal direction (row direction) intersect with each other. Both reference symbols m and n denote natural numbers that are 2 or more. Each of the source lines is represented by a "source line SL", and each of the gate lines is represented by a "gate line GL".

In this case, the source line SL corresponds to a "data signal line", and the gate line GL corresponds to a "scanning signal lines". The source driver 13 corresponds to a "data signal line drive circuit", the gate driver 14 corresponds to a "scanning signal line drive circuit", the counter electrode drive circuit 12 corresponds to a "counter electrode voltage supply circuit", and a part of the display control circuit 11 corresponds to a "control line drive circuit".

In FIG. 1, the display control circuit 11 and the counter electrode drive circuit 12 are shown to be independent of the source driver 13 and the gate driver 14. However, in the drivers, the display control circuit 11 and the counter electrode drive circuit 12 may be included.

In the embodiment, as signal lines that drive the pixel circuits 2, in addition to the source line SL and the gate line GL described above, a reference line REF, a voltage supply line VSL, an auxiliary capacitive line CSL, and a boost line BST are included. As another configuration, a configuration further including the selecting line SEL can also be used. The configuration of the display device in this case is shown in FIG. 3.

The reference line REF, the boost line BST, the selecting line SEL, and the voltage supply line VSL correspond to a "first control line", a "second control line", a "third control line", and a "voltage supply line", and are driven by the display control circuit 11. The auxiliary capacitive line CSL corresponds to a "fourth control line" or a "fixed voltage line", and is driven by the display control circuit 11 for example.

Figure 3:
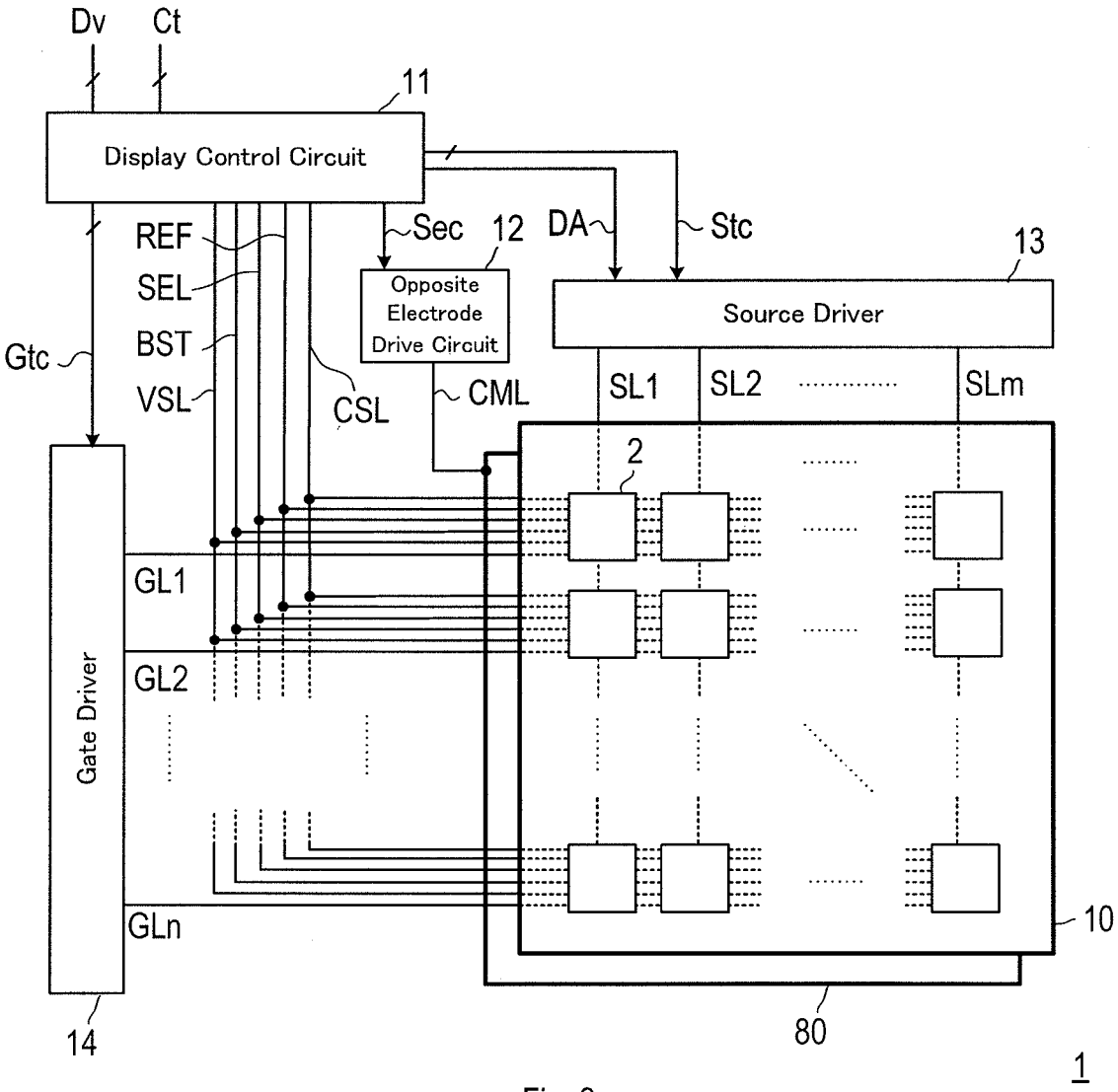
FIG. 3 is a block diagram showing an example of a schematic configuration of a display device according to the present invention.

In FIG. 1 and FIG. 3, the reference line REF, the boost line BST, the voltage supply line VSL, and the auxiliary capacitive line CSL are provided for each row so as to extend in the row direction, and wires of the respective rows are connected to each other at a peripheral portion of the pixel circuit array to form a single wire. However, the wires of the respective rows are independently driven, a common voltage may be able to be applied depending on operating modes, and the wires may also be provided for each column so as to extend in the column direction. Basically, the reference line REF, the boost line BST, the voltage supply line VSL, and the auxiliary capacitive line CSL are shared by the plurality of pixel circuits 2. When the selecting line SEL is further included, the selecting line SEL may be arranged like the boost line BST.

The display control circuit 11 is a circuit that controls writing actions in an always-on display mode and an always-on display mode (will be described later) and a self-refresh action in the always-on display mode.

In the writing action, the display control circuit 11 receives a data signal Dv representing an image to be displayed and a timing signal Ct from an external signal source, and, based on the signals Dv and Ct, as signals to display an image on the display element unit 21 (see FIG. 4) of the pixel circuit array, generates a digital image signal DA and a data-side timing control signal Stc given to the source driver 13, a scanning-side timing control signal Gtc given to the gate driver 14, a counter voltage control signal Sec given to the counter electrode drive circuit 12, and signal voltages applied to the reference line REF, the boost line BST, the auxiliary capacitive line CSL, the voltage supply line VSL, and, if it exists, the selecting line SEL, respectively.

The source driver 13 is a circuit that applies a source signal having a predetermined voltage amplitude at a predetermined timing to the source lines SL under the control of the display control circuit 11 in the writing action and the self-refresh action.

In the writing action, the source driver 13, based on the digital image signal DA and the data-side timing control signal Stc, generates a voltage corresponding to a pixel value of one display line represented by the digital signal DA and matched with a voltage level of a counter voltage Vcom as source signals Sc1, Sc2, . . . , Scm every one-horizontal period (to be also referred to as a "1H period"). The voltages are supposed to be multi-tone voltages in both the normal display mode and the always-on display mode. However, in the embodiment, the number of gradation levels in the always-on display mode is supposed to be smaller than that in the normal display mode. For example, the voltage is a three-gradation level (ternary) voltage. These source signals are applied to the source lines SL1, SL2, . . . , SLm, respectively.

In the self-refresh action, the source driver 13 performs the same voltage application to all the source lines SL connected to the target pixel circuits 2 at the same timing under the control of the display control circuit 11 (will be described in detail later).

The gate driver 14 is a circuit that applies a gate signal having a predetermined voltage amplitude to the gate lines GL at a predetermined timing under the control of the display control circuit 11 in the writing action, the self-refresh action. The gate driver 14, like the pixel circuit 2, may be formed on the active matrix substrate 10.

In the writing action, the gate driver 14 sequentially selects the gate lines GL1, GL2, . . . , GLn every almost one-horizontal period in each frame period of the digital image signal DA on the basis of the scanning-side timing control signal Gtc to write the source signals Sc1, Sc2, . . . , Scm in the pixel circuits 2.

In the self-refresh action, the gate driver 14 performs the same voltage application at the same timing to all the gate lines GL connected to the target pixel circuits 2 under the control of the display control circuit 11 (will be described in detail later).

The counter electrode drive circuit 12 applies the counter voltage Vcom to the counter electrode 80 through a counter electrode wire CML. In the embodiment, the counter electrode drive circuit 12 outputs the counter voltage Vcom in the normal display mode and the always-on display mode such that the level of the counter voltage Vcom is alternately switched between a predetermined high level (5 V) and a predetermined low level (0 V). In this manner, it is called "counter AC drive" that the counter electrode 80 is driven while switching the counter voltage Vcom between the high level and the low level.

The "counter AC drive" in the normal display mode switches the counter voltage Vcom between the high level and the low level every one-horizontal period and one-frame period. That is, in a certain one-frame period, in two sequential horizontal periods, a voltage polarity across the counter electrode 80 and the pixel electrode 20 changes. Even in the same one-horizontal period, in two sequential frame periods, a voltage polarity across the counter electrode 80 and the pixel electrode 20 changes.

On the other hand, in the always-on display mode, although the same voltage level is maintained, the voltage polarity across the counter electrode 80 and the pixel electrode 20 changes in two sequential writing actions.

When a voltage having the same polarity is continuously applied across the counter electrode 80 and the pixel electrode 20, a display screen burns in (surface burn-in). For this reason, the polarity inverting action is required. However, the "counter AC drive" is employed, an amplitude of a voltage applied to the pixel electrode 20 in the polarity inverting action can be reduced.

<<Pixel Circuit>>

Figure 4:
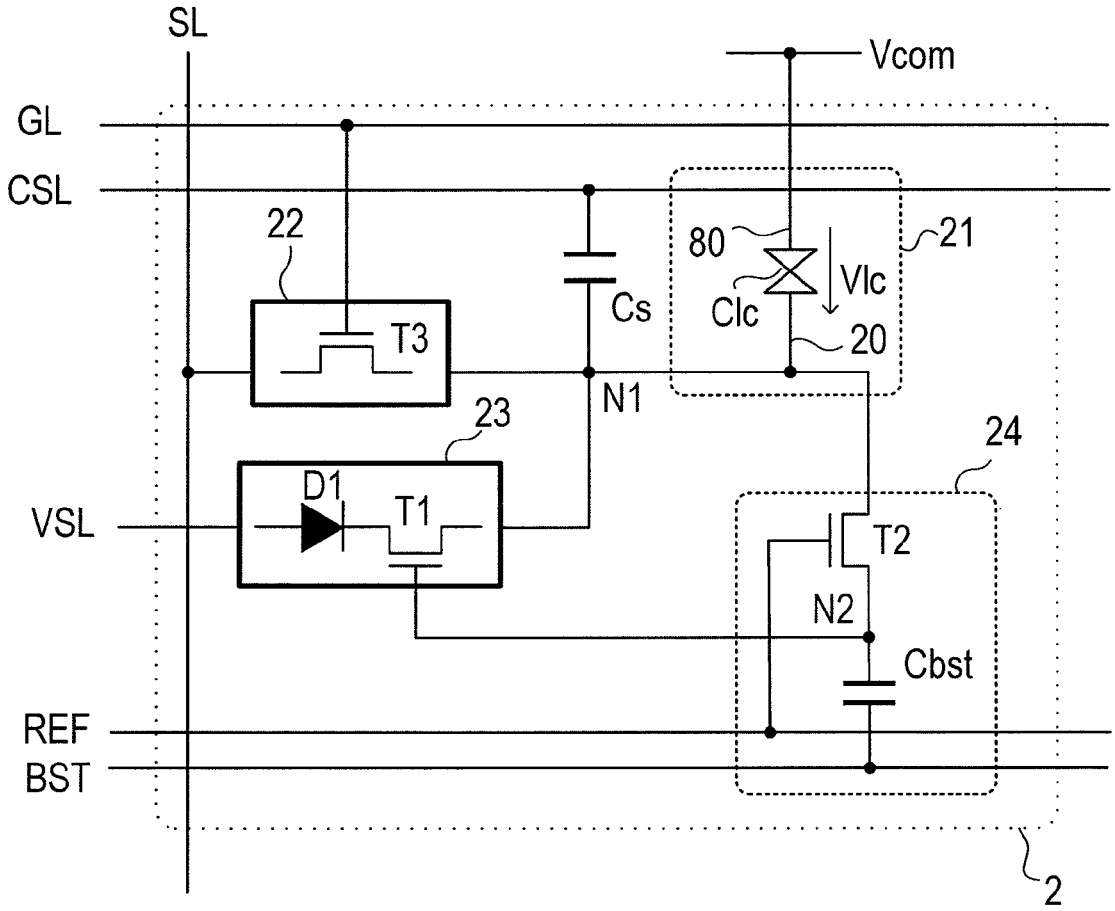
FIG. 4 is a circuit diagram showing a basic circuit configuration of a pixel circuit of the present invention.
Figure 5:
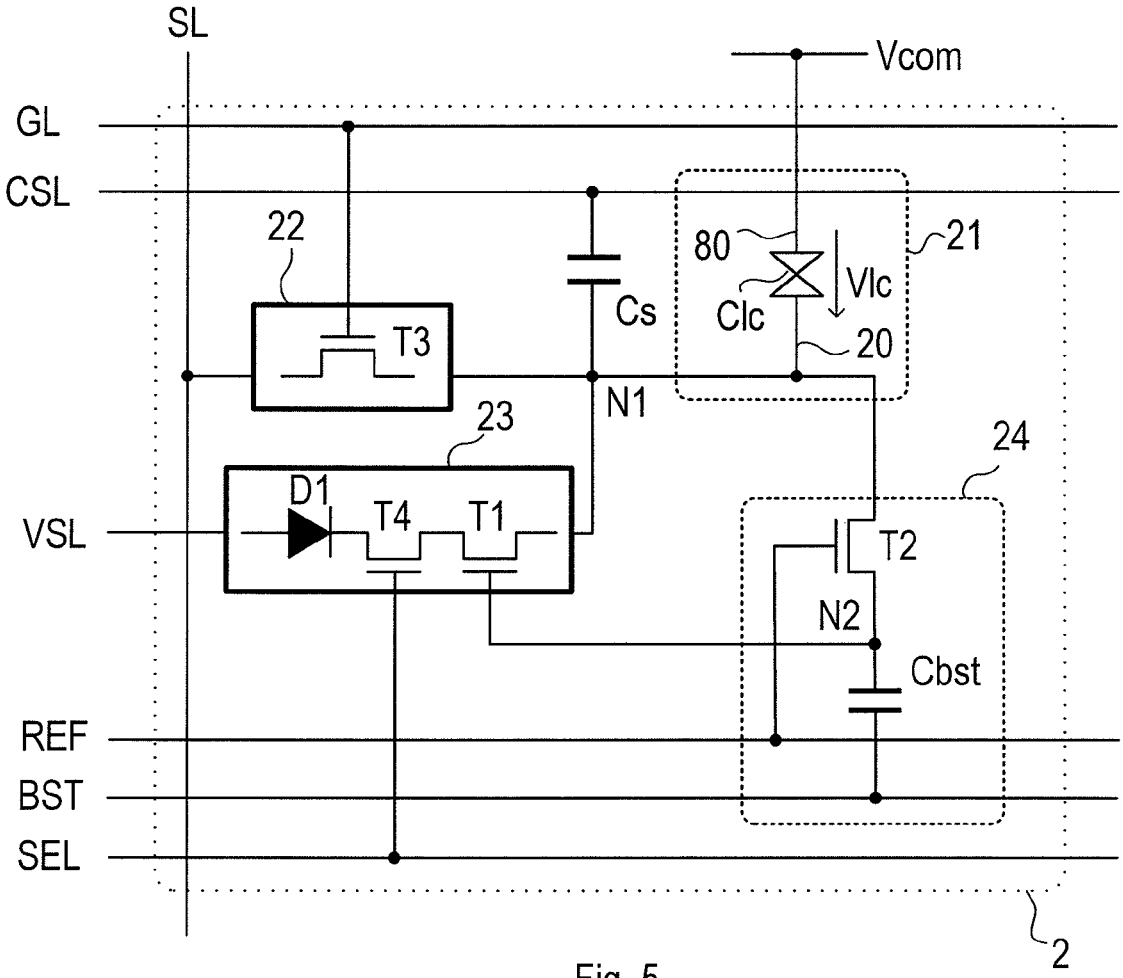
FIG. 5 is a circuit diagram showing another basic circuit configuration of the pixel circuit of the present invention.
Figure 6:
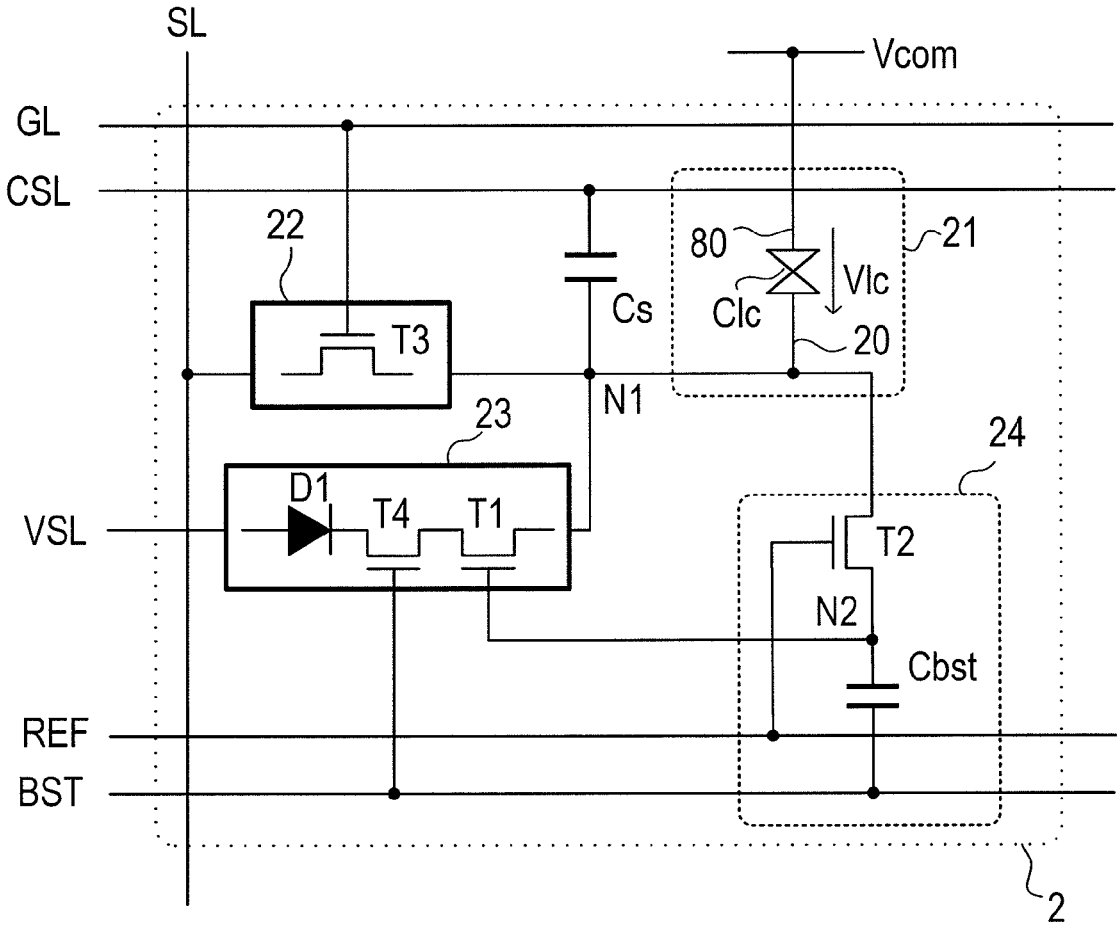
FIG. 6 is a circuit diagram showing another basic circuit configuration of the pixel circuit of the present invention.

A configuration of the pixel circuit 2 will be described below with reference to FIGS. 4 to 17. FIGS. 4 to 6 show a basic circuit configuration of the pixel circuit 2 of the present invention. The pixel circuit 2, being common in all circuit configurations, includes a display element unit 21 including the unit liquid crystal display element Clc, a first switch circuit 22, a second switch circuit 23, a control circuit 24, and an auxiliary capacitor element Cs. The auxiliary capacitor element Cs corresponds to a "second capacitor element".

Each of the basic circuit configurations shown in FIG. 4, FIG. 5, and FIG. 6 shows a common circuit configuration including basic circuit configurations of first to third types (will be described later). Since the unit liquid crystal display element Clc has been described with reference to FIG. 2, an explanation thereof will be omitted.

The pixel electrode 20 is connected to one ends of the first switch circuit 22, the second switch circuit 23, and the control circuit 24 to form an internal node N1. The internal node N1 holds a voltage of pixel data supplied from the source line SL in the writing action.

The auxiliary capacitor element Cs has one end connected to the internal node N1 and the other end connected to the auxiliary capacitive line CSL. The auxiliary capacitor element Cs is additionally arranged to make it possible to cause the internal node N1 to stably hold the voltage of the pixel data.

The first switch circuit 22 has one end on which the internal node N1 is not configured and that is connected to the source line SL. The first switch circuit 22 includes a transistor T3 that functions as a switch element. The transistor T3 means a transistor having a control terminal connected to the gate line and corresponds to a "third transistor element". In at least an off state of the transistor T3, the first switch circuit 22 is turned off, and conduction between the source line SL and the internal node N1 is interrupted.

The second switch circuit 23 has one end on which the internal node N1 is not configured and that is connected to the voltage supply line VSL. The second switch circuit 23 includes a series circuit of a transistor T1 and a diode D1. The transistor T1 means a transistor having a control terminal that is connected to an output node N2 of the control circuit 24, and corresponds to a "first transistor element". The diode D1 has a rectifying function in a direction from the voltage supply line VSL to the internal node N1, and corresponds to a "diode element". In the embodiment, it is assumed that the diode D1 is formed by a PN junction. The diode D1 may be formed by a Schottky barrier junction or a diode connection of a MOSFET (MOSFET in which a drain or a source is connected to a gate).

As shown in FIG. 4, the second switch circuit 23 is configured by a series circuit of the transistor T1 and the diode D1, and a configuration that does not include the transistor T4 (will be described later) will called a first type hereinafter.

Unlike the first type, as shown in FIG. 5 and FIG. 6, the second switch circuit 23 may be configured by a series circuit including the transistor T1, the diode D1, and the transistor T4. For this reason, two types in FIG. 5 and FIG. 6 are classified depending on signal lines to which the control terminal of the transistor T4 is connected. The type (second type) of the pixel circuit shown in FIG. 5 includes the selecting line SEL different from the boost line BST, and the control terminal of the transistor T4 is connected to the selecting line SEL. On the other hand, in the type (third type) of the pixel circuit shown in FIG. 6, the control terminal of the transistor T4 is connected to the boost line BST. In the first type, the selecting line SEL is not present as a matter of course. The transistor T4 corresponds to a "fourth transistor element".

In the first type, when the transistor T1 is turned on, if a potential difference equal to or larger than a turn-on voltage is generated between both the ends of the diode D1, the second switch circuit 23 is turned on in a direction from the voltage supply line VSL to the internal node N1. On the other hand, in the second and third types, when both the transistors T1 and T4 are turned on, if a potential difference equal to or larger than the turn-on voltage is generated between both the ends of the diode D1, the second switch circuit 23 is turned on in a direction from the voltage supply line VSL to the internal node N1.

The control circuit 24 includes a series circuit of the transistor T2 and a boost capacitor element Cbst. A first terminal of the transistor T2 is connected to the internal node N1, and a control terminal thereof is connected to the reference line REF. The second terminal of the transistor T2 is connected to the first terminal of the boost capacitor element Cbst and the control terminal of the transistor T1 to form an output node N2. The second terminal of the boost capacitor element Cbst is connected to the boost line BST. The transistor T2 corresponds to a "second transistor element".

One end of the auxiliary capacitor element Cs and one end of the liquid crystal capacitor element Clc are connected to the internal node N1. In order to avoid reference numerals from being complicated, an electrostatic capacity ("auxiliary capacity") of the auxiliary capacitor element is expressed by Cs, and an electrostatic capacity (called a "liquid crystal capacity") of a liquid crystal capacitor element is expressed by Clc. At this time, a full capacity being parasitic in the internal node N1, i.e., a pixel capacity Cp in which pixel data is to be written and held is approximately expressed by the sum of the liquid crystal capacity Clc and the auxiliary capacity Cs ($Cp \cong Clc+Cs$).

At this time, the boost capacitor element Cbst is set to establish $Cbst \ll Cp$ when the electrostatic capacity (called a "boost capacity") is described as Cbst.

The output node N2 holds a voltage depending on a voltage level of the internal node N1 when the transistor T2 is turned on, and holds the initial hold voltage when the transistor T2 is turned off regardless of the change of the voltage level of the internal node N1. By the hold voltage of the output node N2, the transistor T1 of the second switch circuit 23 is on/off-controlled.

All the transistors T1 to T4 of four types are thin film transistors such as polycrystalline silicon TFTs or amorphous silicon TFTs formed on the active matrix substrate 10. One of the first and second terminals corresponds to a drain electrode, the other corresponds to a source electrode, and the control terminal corresponds to a gate electrode. Furthermore, each of the transistors T1 to T4 may be configured by a single transistor element. When a request to suppress a leakage current in an off state is strong, the plurality of transistors may be connected in series with each other to share the control terminal. In an explanation of action of the pixel circuit 2, as all the transistors T1 to T4, N-channel type polycrystalline silicon TFTs each having a threshold voltage of about 2 V are supposed.

The diode D1 is also formed on the active matrix substrate 10 like the transistors T1 to T4. In the embodiment, the diode D1 is realized by a PN junction made of polycrystalline silicon.

<First Type>

A pixel circuit, belonging to the first type, in which the second switch circuit 23 is configured by a series circuit of only the transistor T1 and the diode D1 will be described below.

Figure 7:
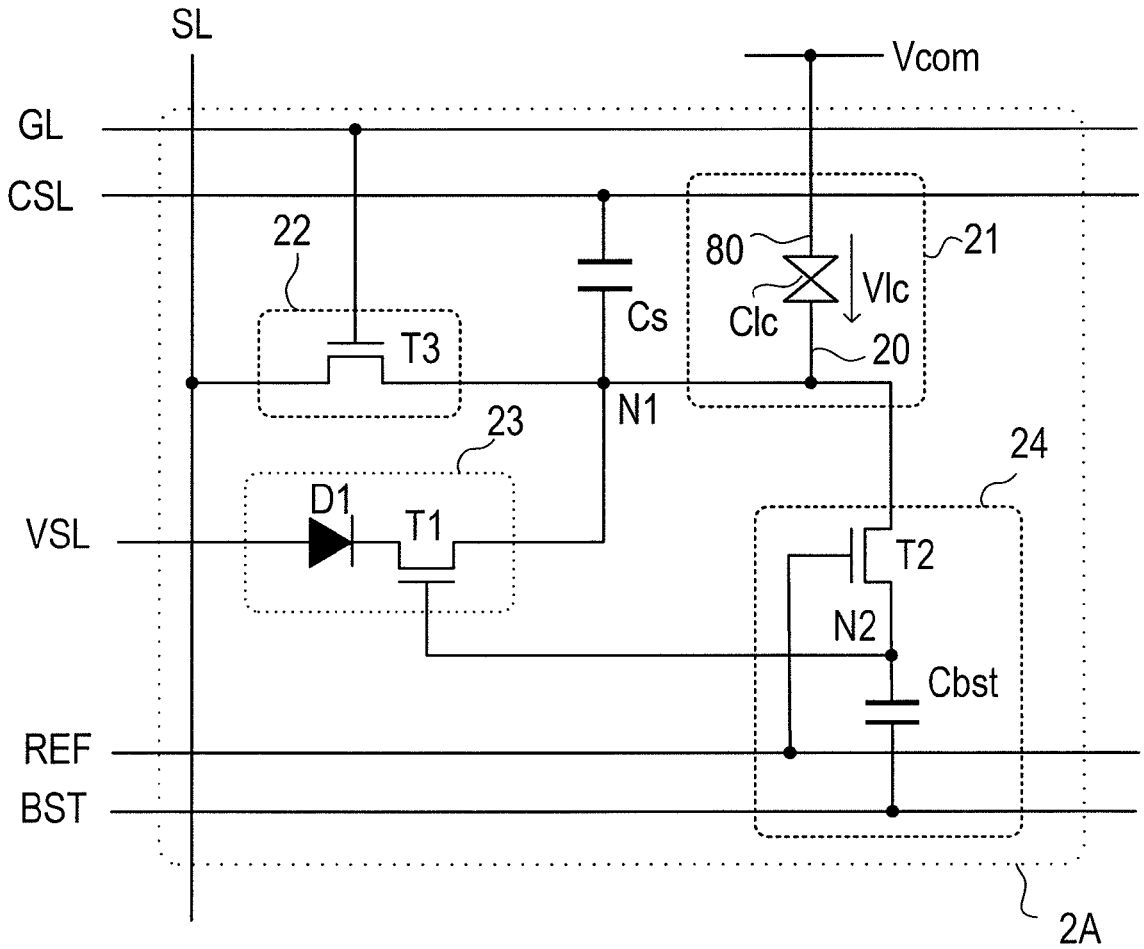
FIG. 7 is a circuit diagram showing an example of a circuit configuration of a first type of the pixel circuit of the present invention.
Figure 8:
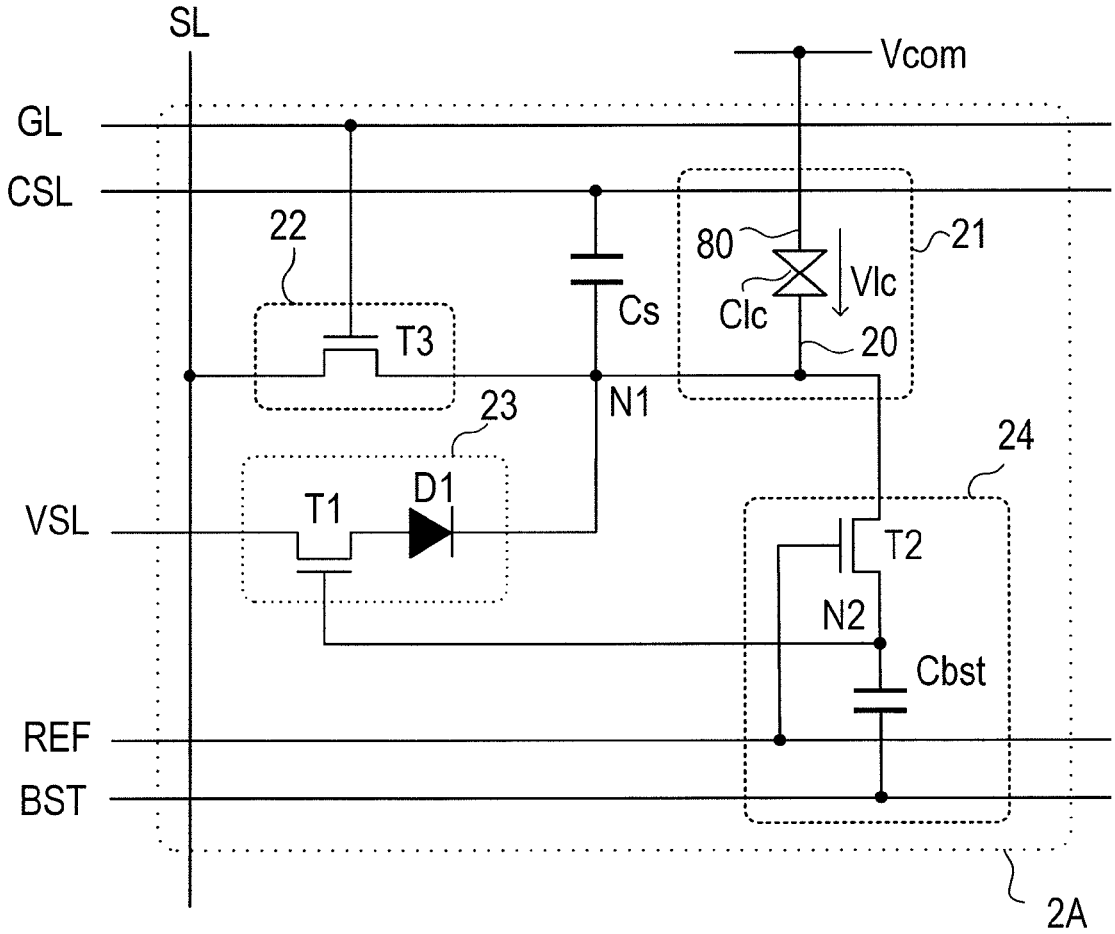
FIG. 8 is a circuit diagram showing another example of circuit configuration of a first type of the pixel circuit of the present invention.

At this time, as described above, depending on the configuration of the first switch circuit 22, the pixel circuits 2A shown in FIG. 7 and FIG. 8 are supposed.

In the pixel circuit 2A of the first type shown in FIG. 7, the first switch circuit 22 is configured by only the transistor T3.

In this case, FIG. 7 shows a configuration in which the second switch circuit 23 is configured by the series circuit of the diode D1 and the transistor T1, as an example, a configuration in which the first terminal of the transistor T1 is connected to the internal node N1, the second terminal of the transistor T1 is connected to the cathode terminal of the diode D1, and the anode terminal of the diode D1 is connected to the voltage supply line VSL. However, as shown in FIG. 8, the arrangements of the transistor T1 and the diode D1 of the series circuit may be replaced with each other. A circuit configuration in which the transistor T1 is interposed between the two diodes D1 may also be available.

<Second Type>

A pixel circuit, belonging to the second type, in which the second switch circuit 23 is configured by the series circuit of the transistor T1, the diode D1, and the transistor T4, and the control terminal of the transistor T4 is connected to the selecting line SEL will be described below.

Figure 9:
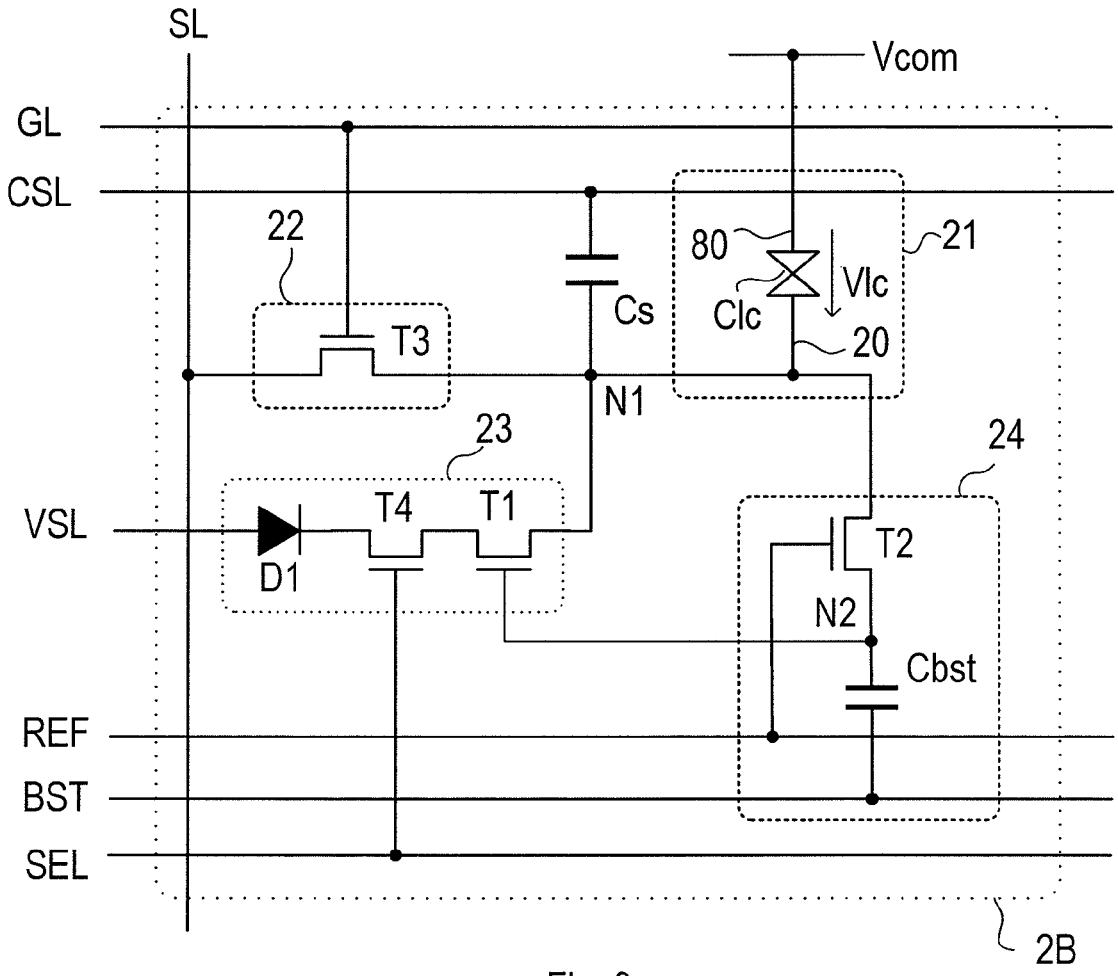
FIG. 9 is a circuit diagram showing an example of a circuit configuration of a second type of the pixel circuit of the present invention.
Figure 10:
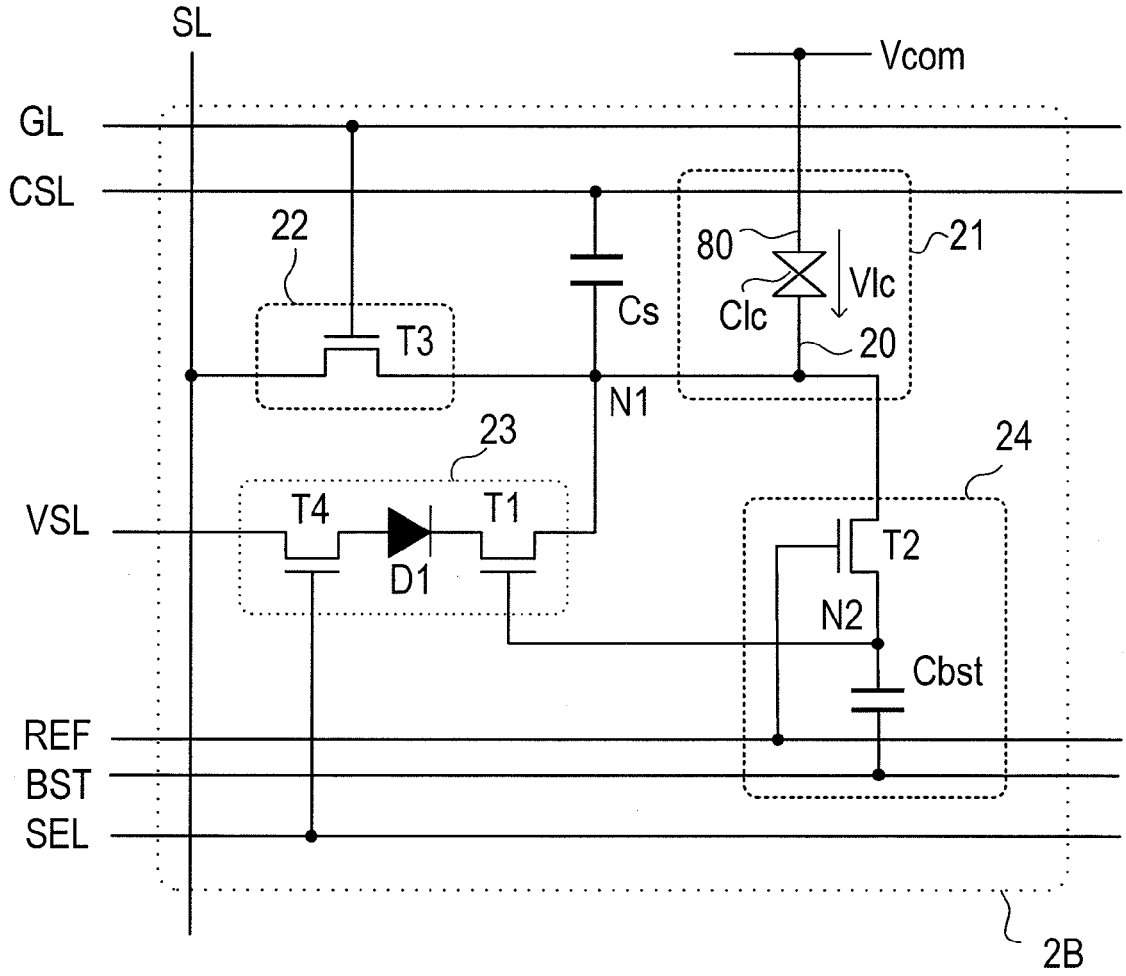
FIG. 10 is a circuit diagram showing an example of the circuit configuration of the second type of the pixel circuit of the present invention.
Figure 11:
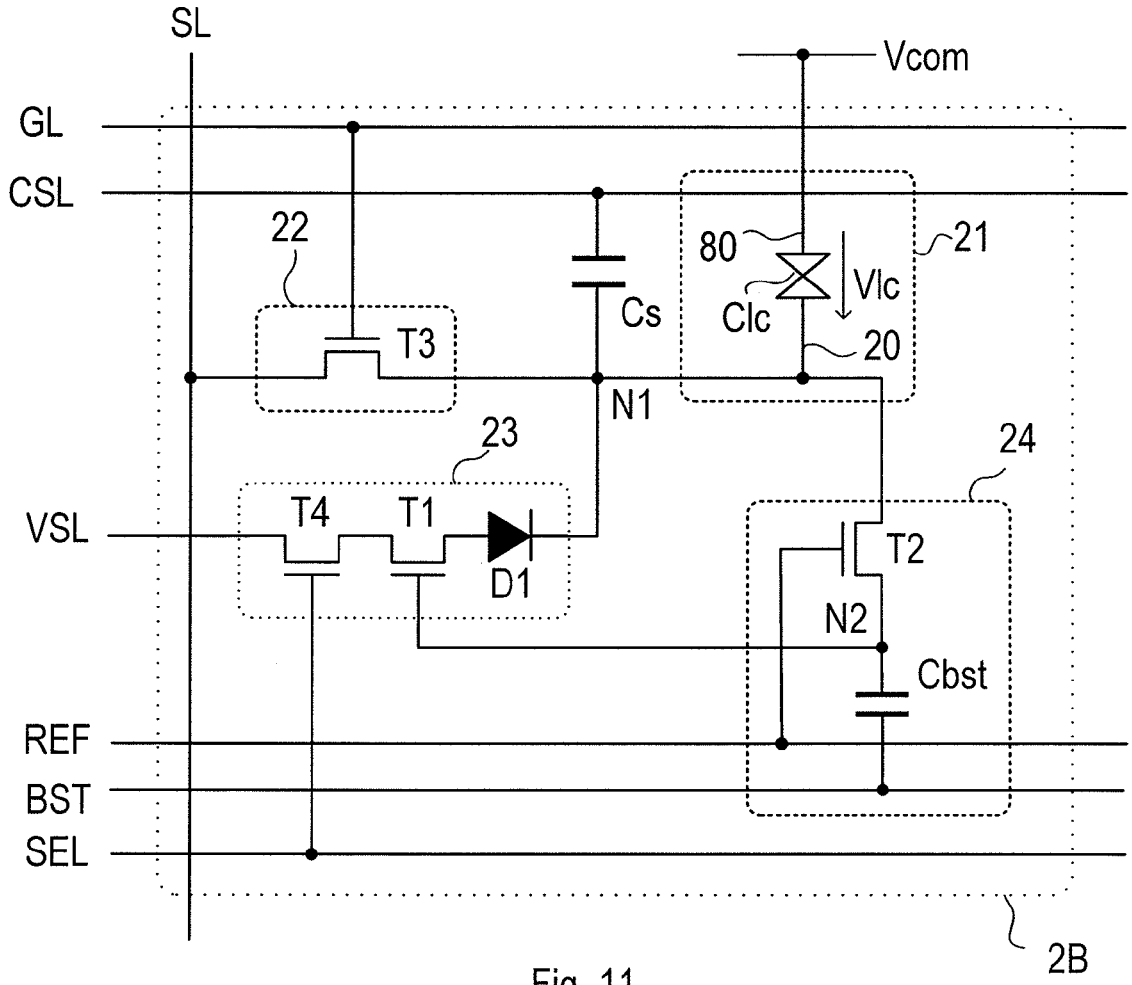
FIG. 11 is a circuit diagram showing an example of the circuit configuration of the second type of the pixel circuit of the present invention.

In the second type, depending on the configuration of the first switch circuit 22, a pixel circuit 2B shown in FIG. 9 to FIG. 11 and a pixel circuit 2C shown in FIG. 12 to FIG. 15 are supposed.

In the pixel circuit 2B shown in FIG. 9, the first switch circuit 22 is configured by only the transistor T3. As in the first type, in the configuration of the second switch circuit 23, a modified circuit depending on arrangements of the diode D1 can be realized (for example, see FIG. 10 and FIG. 11). In these circuits, the arrangements of the transistors T1 and T4 may be replaced with each other.

Figure 12:
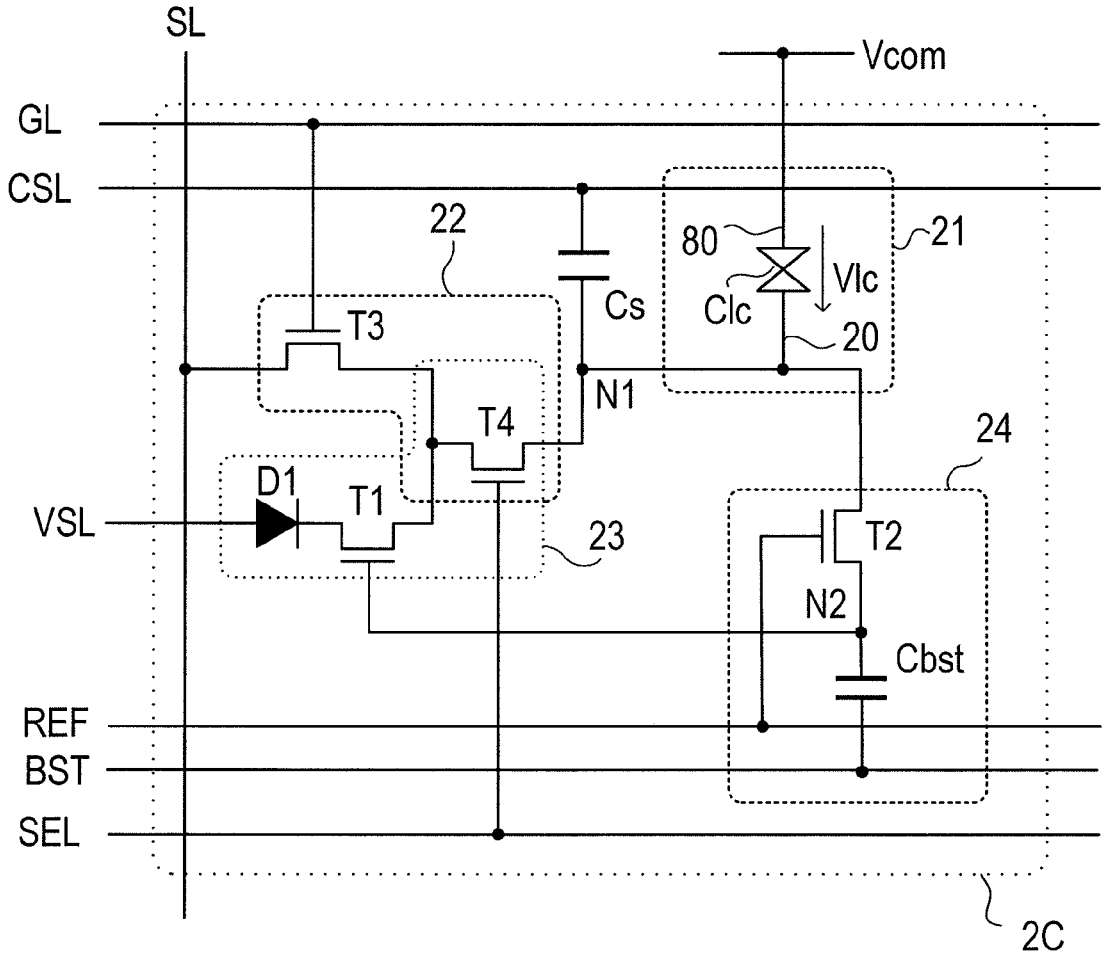
FIG. 12 is a circuit diagram showing an example of the circuit configuration of the second type of the pixel circuit of the present invention.
Figure 13:
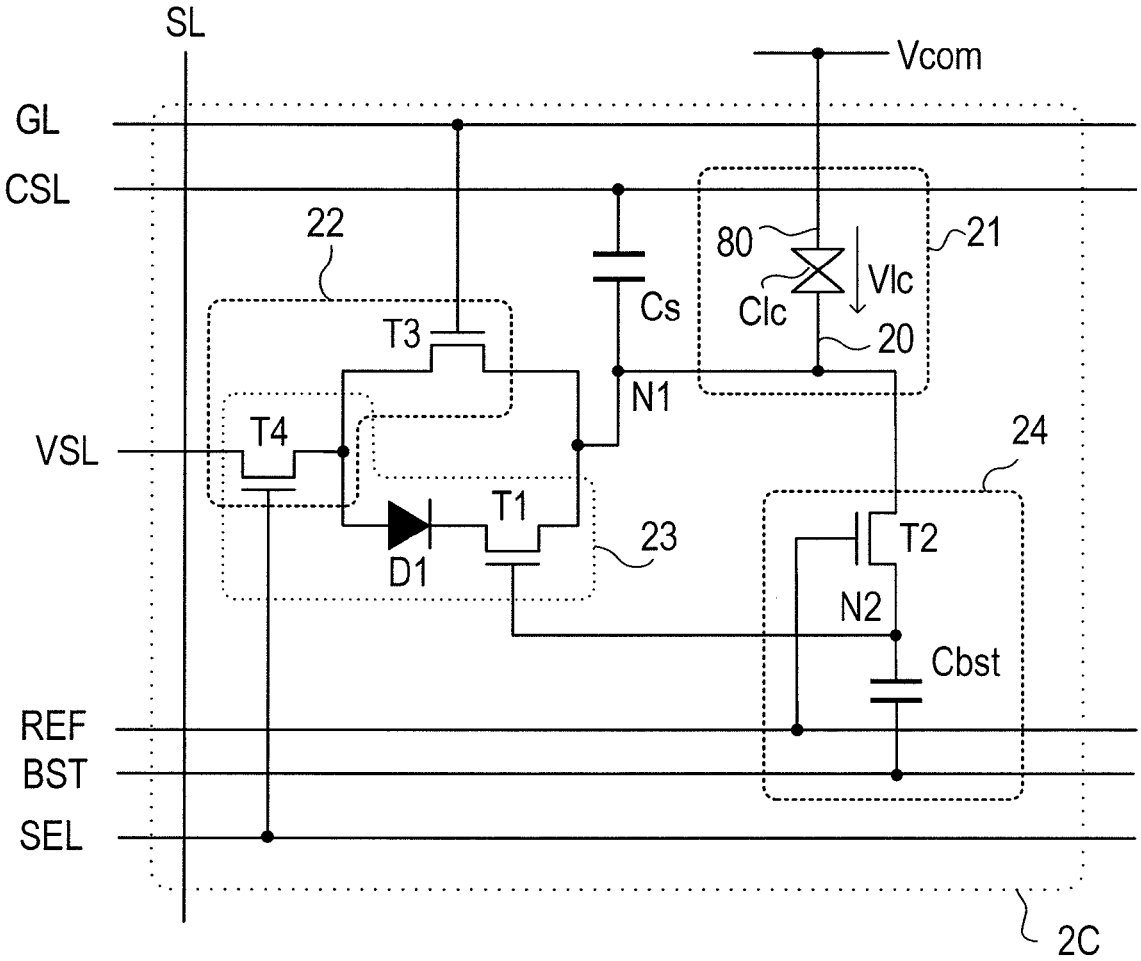
FIG. 13 is a circuit diagram showing an example of the circuit configuration of the second type of the pixel circuit of the present invention.
Figure 14:
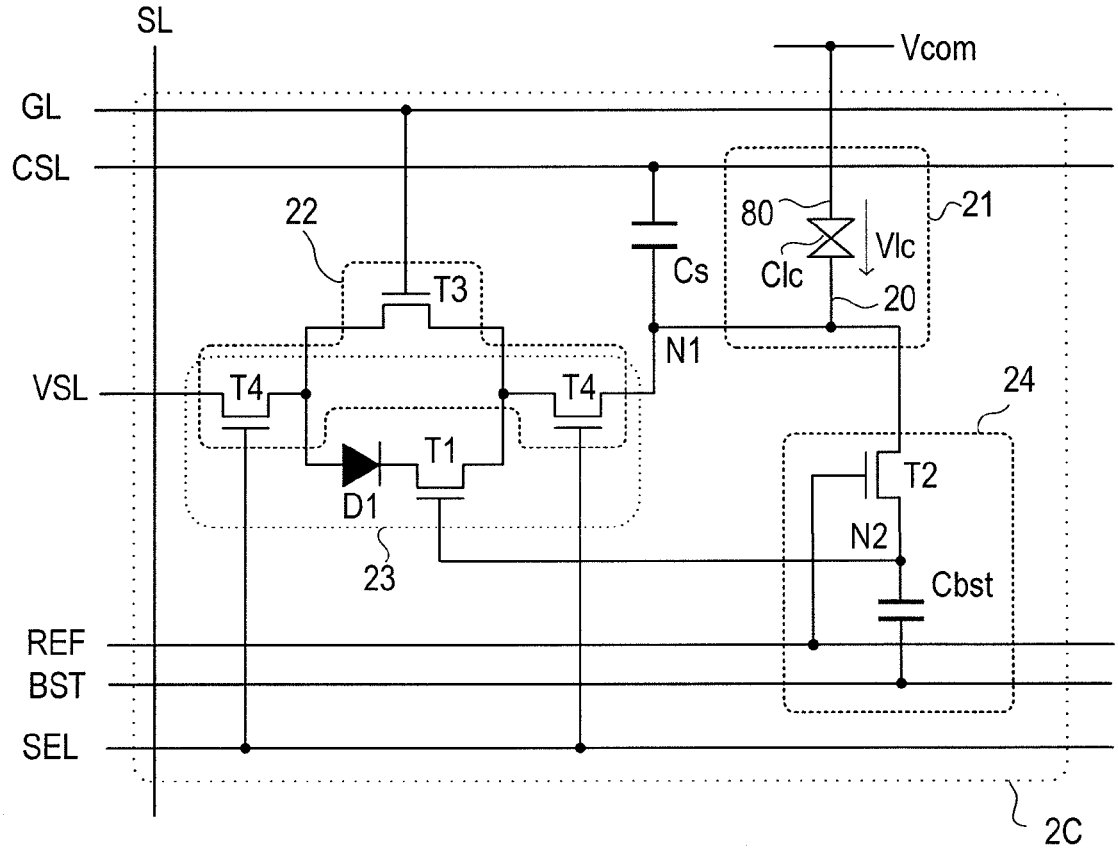
FIG. 14 is a circuit diagram showing an example of the circuit configuration of the second type of the pixel circuit of the present invention.

In the pixel circuit 2C shown in FIG. 12, the first switch circuit 22 is configured by a series circuit of the transistor T3 and the transistor T4. The arrangement positions of the transistor T4 are changed to make it possible to realize a modified circuit shown in FIG. 13. The plurality of transistors T4 are arranged to make it possible to realize a modified circuit shown in FIG. 14.

Figure 15:
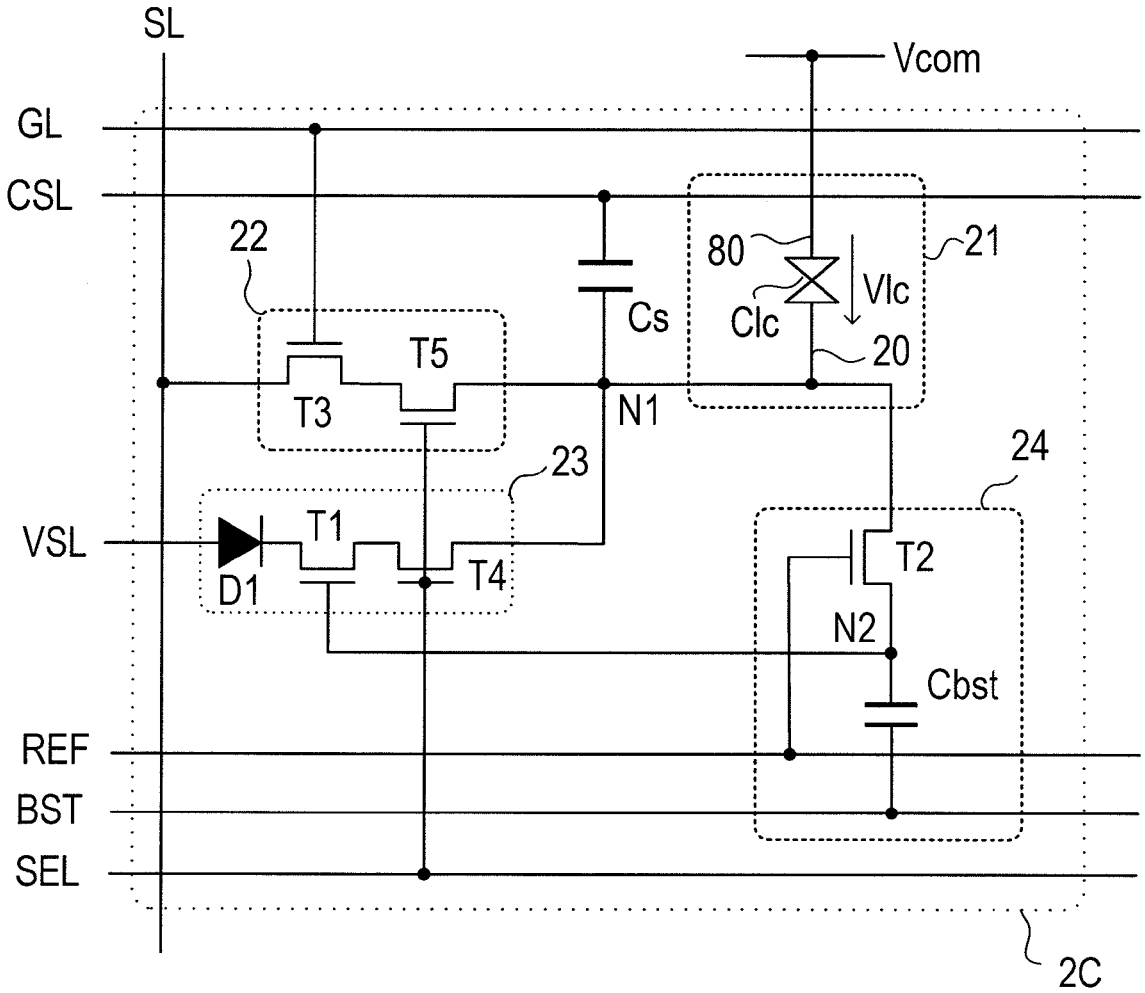
FIG. 15 is a circuit diagram showing an example of the circuit configuration of the second type of the pixel circuit of the present invention.

Furthermore, as shown in FIG. 15, in place of the transistor T4 in the first switch circuit 22, a modified circuit including the transistor T5 having a control terminal connected to the control terminal of the transistor T4 can be realized.

<Third Type>

A pixel circuit, belonging to the third type, in which the second switch circuit 23 is configured by a series circuit of the transistor T1, the diode D1, and the transistor T4, and the control terminal of the transistor T4 is connected to the boost line BST will be described below.

Figure 16:
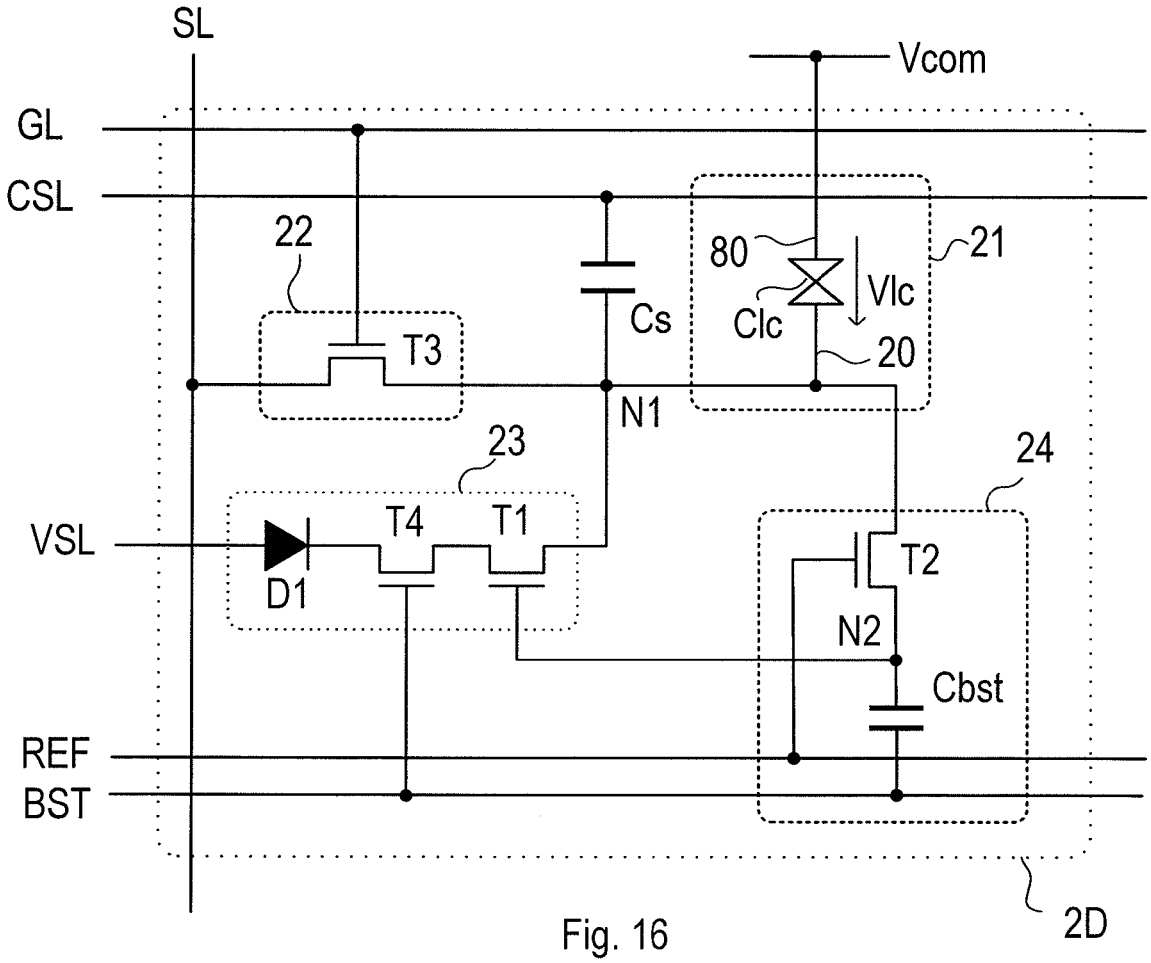
FIG. 16 is a circuit diagram showing an example of a circuit configuration of the third type of the pixel circuit of the present invention.
Figure 17:
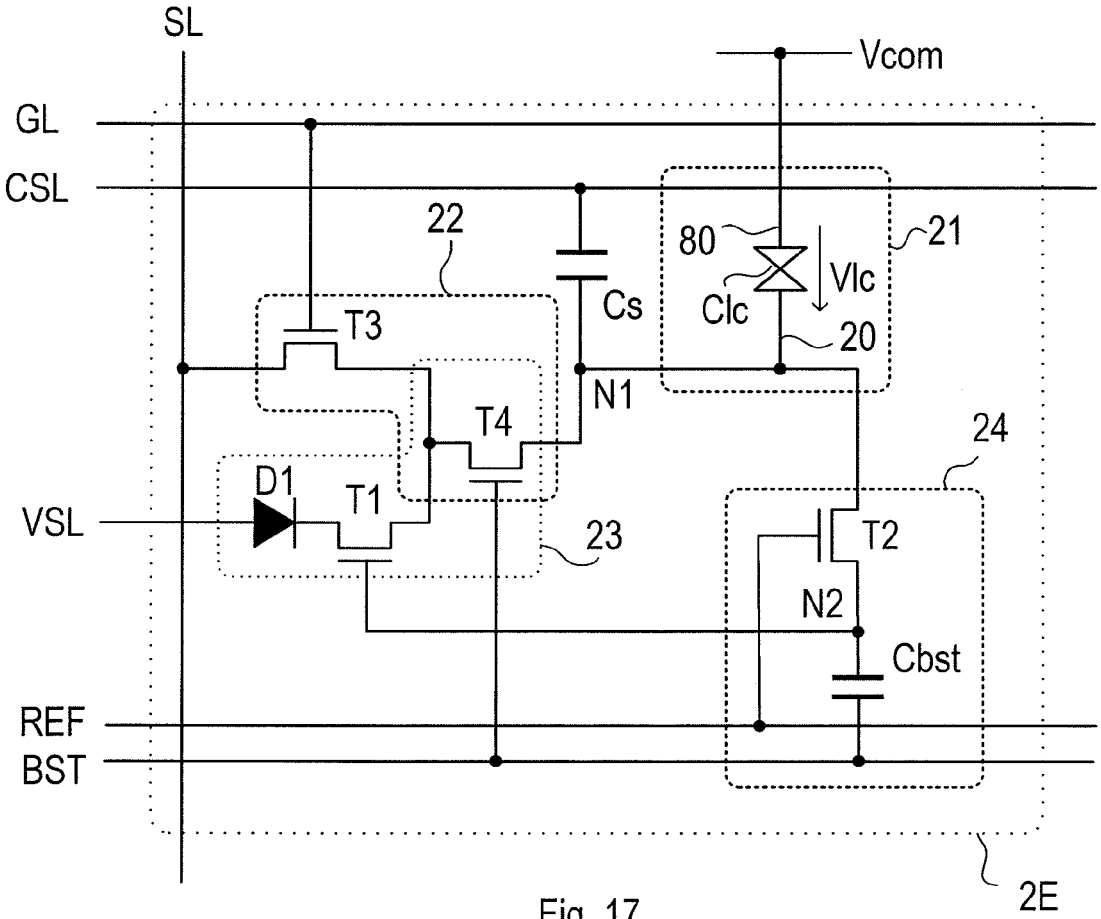
FIG. 17 is a circuit diagram showing an example of circuit configuration of a third type of the pixel circuit of the present invention.

Each of the pixel circuits of the third type has a configuration in which a connection destination of the control terminal of the transistor T4 in each of the pixel circuits of the second type is changed into the boost line BST, and the selecting line SEL is not provided. Thus, pixel circuits corresponding to the pixel circuits 2B shown in FIG. 9 to FIG. 11 and the pixel circuit 2C shown in FIG. 12 to FIG. 15 can be realized. As an example, a pixel circuit 2D corresponding to the pixel circuit 2B shown in FIG. 9 is shown in FIG. 16, and a pixel circuit 2E corresponding to the pixel circuit 2C in FIG. 12 is shown in FIG. 17.

The same transistor elements or the same diode elements are connected in series with each other to make it possible to also realize the pixel circuit of each of the types.

[Second Embodiment]

In the second embodiment, self-refresh actions performed by the pixel circuits of the first to third types will be described below with reference to the drawings.

The self-refresh action is an action in an always-on display mode, and is an action in which the first switch circuit 22, the second switch circuit 23, and the control circuit 24 are operated by a predetermined sequence in the plurality of pixel circuits 2 to recover a potentials of a pixel electrode 20 (or a potential of the internal node N1) to a potential of a gradation level written by an immediately previous writing action, and the potentials are recovered for the pixel circuits having all the gradation levels at the same time in a lump in units of gradation levels. The self-refresh action is an action being unique to the present invention and performed by the pixel circuits 2A to 2E. The self-refresh action can achieve a very low power consumption in comparison with an "external refresh action" that performs a normal writing action as in the conventional technique to recover the potential of the pixel electrode 20. The "the same time" in the "at the same time in a lump" is "the same time" having a time range of a series of self-refresh actions.

In the conventional technique, the writing action is performed to perform an action (external polarity inverting action) that inverts only a polarity of a liquid crystal voltage Vlc applied across the pixel electrode 20 and the counter electrode 80 while maintaining an absolute value of the liquid crystal voltage Vlc. When the external polarity inverting action is performed, the polarity is inverted, and the absolute value of the liquid crystal voltage Vlc is updated to an absolute value in an immediately previous writing state. More specifically, polarity inversion and refreshing are simultaneously performed. For this reason, by the writing action, a refresh action is not normally executed to update only the absolute value of the liquid crystal voltage Vlc without inverting the polarity. However, in the following explanation, for descriptive convenience, in terms of comparison with the self-refresh action, such a refresh action is called an "external refresh action".

Even though the refresh action is executed by the external polarity inverting action, the writing action is still performed. More specifically, in comparison with the conventional method, a very low power consumption can also be achieved by the self-refresh action according to the embodiment.

As will be described below, in the self-refresh action of the embodiment, all the pixel circuits are set to the same voltage application state. However, in fact, in the voltage state, only a pixel circuit in which the internal node N1 exhibits a voltage state at a specific gradation level is automatically selected to recover (refresh) the potential of the internal node N1. That is, although voltage application is performed as a self-refresh action, at the time of the voltage application, a pixel circuit in which the potential of the internal node N1 is refreshed and a pixel circuit in which the potential of the internal node N1 is not refreshed are present.

For this reason, in order to avoid expressions from being confused, a word "self-refresh (action)" and a word "refresh (action)" are consciously distinctively described. The former is used in an expanded sense that indicates a series of actions to recover the potential of the internal node N1 of each of the pixel circuits. On the other hand, the latter is used in a narrow sense that indicates an action to actually recover the potential (potential of the internal node) of the pixel electrode. That is, in the "self-refresh action" in the embodiment, the same voltage state is set to all the pixel circuits to automatically select and "refresh" only an internal node that exhibits a voltage state at a specific gradation level. A value of a voltage is changed to change a gradation level to be "refreshed" to perform voltage application as described above, thereby "refreshing" all the gradation levels. In this manner, the "self-refresh action" in the embodiment is configured such that a "refresh action" is performed in units of gradation levels.

Voltages are applied to all the gate lines GL, the source lines SL, the reference lines REF, the auxiliary capacitive lines CSL, the boost lines BST, the voltage supply lines VSL, and the counter electrode 80 that are connected to the pixel circuits 2 targeted by the self-refresh action at the same timing. In the pixel circuit of the second type including the selecting line SEL, the same voltage application is also performed to the selecting line SEL.

At the same timing, the same voltage is applied to all the gate lines GL, the same voltage is applied to all the reference lines REF, the same voltage is applied to all the auxiliary capacitive lines CSL, the same voltage is applied to all the voltage supply lines VSL, and the same voltage is applied to all the boost lines BST. The timing control of the voltage applications is performed by the display control circuit 11 shown in FIG. 1, and the voltage applications are performed by the display control circuit 11, the counter electrode drive circuit 12, the source driver 13, and the gate driver 14, respectively.

Also in the always-on display mode of the present invention, as shown in the first embodiment, it is assumed that three-gradation-level (ternary) pixel data are held in units of pixel circuits. At this time, a potential VN1 (this is also a potential of the pixel electrode 20) held in the internal node N1 exhibits three voltage states, i.e., first to third voltage states. In the embodiment, as an example, a first voltage state (high-voltage state) is set to 5 V, a second voltage state (intermediate voltage state) is set to 3 V, and a third voltage state (low-voltage state) is set to 0 V.

In a state immediately previous to the execution of the self-refresh action, it is supposed that a pixel in which the pixel electrode 20 is written in the first voltage state, a pixel in which the pixel electrode 20 is written in the second voltage state, and a pixel in which the pixel electrode 20 is written in the third voltage state are mixed. However, according to the self-refresh action according to the embodiment, regardless of the written voltage state of the pixel electrode 20, a voltage application process based on the same sequence is performed to make it possible to execute a refresh action to all the pixel circuits. The contents will be described below with reference to a timing chart and a circuit diagram.

In the following description, a case in which a voltage in the first voltage state (high-level voltage) is written in an immediately previous writing action and the high-level voltage is recovered is called a "case H". A case in which the second voltage state (intermediate-level voltage) is written in the immediately previous writing action and the intermediate-level voltage is recovered is called a "case M". A case in which the third voltage state (low-level voltages) is written in the immediately previous writing action and the low-level voltage is recovered is called a "case L".

As described in the first embodiment, a threshold voltage of each transistor is set to 2 V. A turn-on voltage of the diode D1 is set to 0.6 V.

<First Type>

A self-refresh action of the pixel circuit 2A of the first type in which the second switch circuit 23 is configured by a series circuit of only the transistor T1 and the diode D1 will be described below. In this case, the pixel circuit 2A shown in FIG. 7 is supposed.

Figure 18:
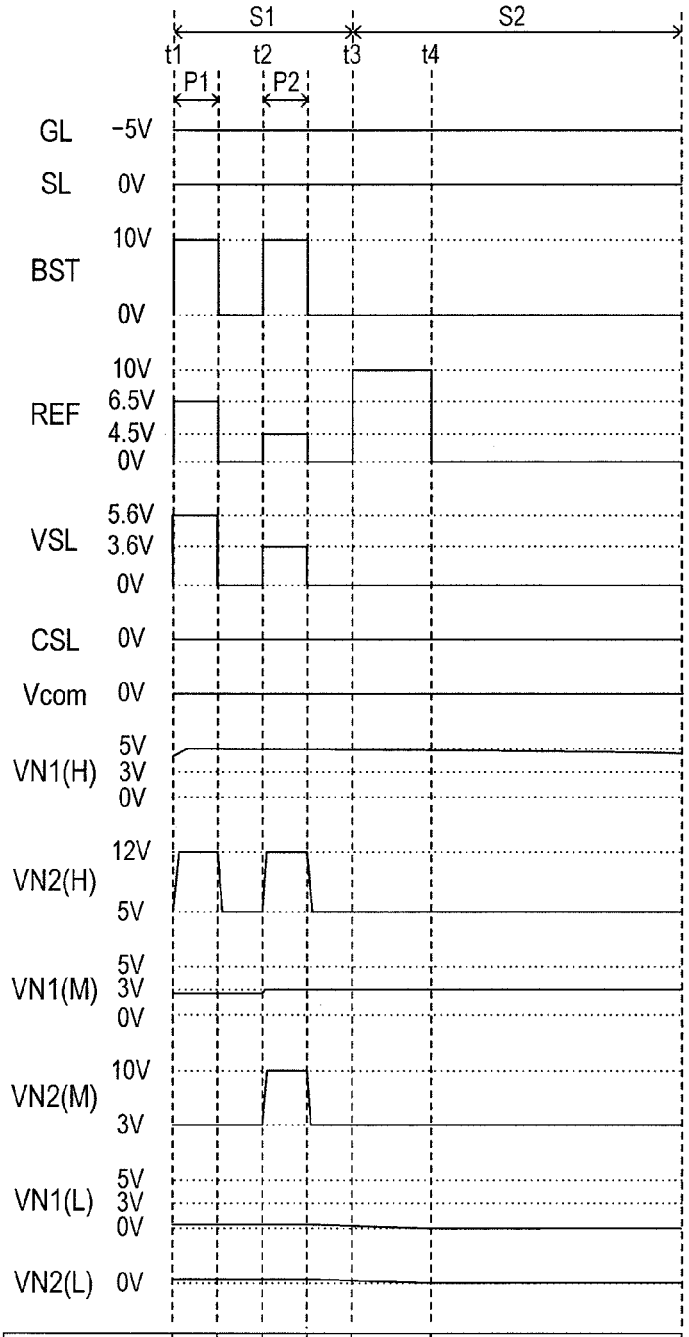
FIG. 18 is a timing chart of self-refresh actions of the second embodiment performed by the pixel circuits of the first and third types.

FIG. 18 shows a timing chart of the self-refresh action of the first type. As shown in FIG. 18, the self-refresh action is divided into two steps S1 and S2, and step S1 includes two phases P1 and P2. FIG. 18 shows voltage waveforms of all the gate lines GL, the source lines SL, the boost lines BST, the reference lines REF, the voltage supply lines VSL, the auxiliary capacitive lines CSL, and the boost lines BST that are connected to the pixel circuits 2A targeted by the self-refresh action, and a voltage waveform of the counter voltage Vcom. In the embodiment, all the pixel circuits of the pixel circuit array are targeted by the self-refresh action.

Furthermore, in FIG. 18, voltage waveforms showing changes of potentials (pixel voltages) VN1 of the internal nodes N1 and potentials VN2 of the output nodes N2 in the cases H, M, and L, and ON/OFF states of the transistors T1 to T3 in the steps and the phases are shown. In FIG. 18, a corresponding case is specified by a symbol in parentheses. For example, reference symbol VN1 (H) denotes a waveform showing a change of a potential VN1 in the case H.

It is assumed that, before time (t1) at which the self-refresh action is started, high-level writing is performed in the case H, intermediate-level writing is performed in the case M, and low-level writing is performed in the case L.

When a time has elapsed after the writing action is executed, the potential VN1 of the internal node N1 varies with generation of leakage currents of the transistors in the pixel circuit. In the case H, the VN1 is 5 V immediately after the writing action. However, the value decreases to a value lower than the initial value with time. Similarly, in the case M, immediately after the writing action, the VN1 is a 3 V. However, the value decreases to a value lower than the initial value with time. The reason the potential of the internal node N1 gradually lowers with time in the cases H and M is that a leakage current flows toward a low potential (for example, a grounding wire) mainly through a transistor in an OFF state.

In the case L, immediately after the writing action, the potential VN1 is at 0 V. However, the potential may increase with time. This is because a writing voltage is applied to the source line SL in a writing action in another pixel circuit to cause a leakage current to flow from the source line SL to the internal node N1 through a non-conducting transistor even in a non-selected pixel circuit.

In FIG. 18, at time t1, the VN1 (H) is shown as a potential slightly lower than 5 V, the VN1 (M) is shown as a potential slightly lower than 3 V, and the VN1 (L) is shown as a potential slightly higher than 0 V. These potentials are set in consideration of the potential variations described above.

The self-refresh action of the embodiment is roughly divided into two steps S1 and S2. The step S1 corresponds to a "refresh step", and step S2 corresponds to a "standby step".

In the step S1, a pulse voltage is applied to directly execute a refresh action to the case H and the case M. On the other hand, in step S2, a predetermined voltage is applied for a predetermined period of time longer than that in the step S1 (for example, a period of time ten or more times as long as that in the step S1) to indirectly execute a refresh action to the case L. The "directly execute" means that the internal node N1 and the voltage supply line VSL are connected to each other through the second switch circuit 23 to give the voltage applied to the voltage supply line VSL to the internal node N1 so as to set the potential VN1 of the internal node to a target value. The "indirectly execute" means that, although the internal node N1 and the voltage supply line VSL are not connected to each other through the second switch circuit 23, by using a weak leakage current flowing between the internal node N1 and the source line SL through the turned-off first switch circuit 22, the potential VN1 of the internal node N1 is caused to be close to a target value.

As described above, the step S1 includes two phases P1 and P2. The phases are discriminated from each other depending on whether a case to be refreshed is the case H or the case M. In FIG. 18, only the internal node N1 in the case H (high-voltage writing) is refreshed in the phase P1, and only the internal node N1 in the case M (intermediate-voltage writing) is refreshed in the phase P2. This action will be described below in detail.

<<Step S1/Phase P1>>

In the phase P1 started from time t1, a voltage is applied to a gate line GL such that the transistor T3 is completely turned off. The voltage is set to −5 V. Since the transistor T3 is always in an off state during execution of the self-refresh action, the applied voltage to the gate line GL may be constant during the execution of the self-refresh action.

Since the transistor T3 is always in an off state during the execution of the self-refresh action, the first switch circuit 22 is in an off state as a matter of course. In this manner, since the source line SL and the internal node N1 are not connected to each other during the execution of the self-refresh action, an applied voltage to the source line SL does not influence the potential VN1 of the internal node N1. Thus, during the execution of the self-refresh action, the applied voltage to the source line SL may be set to any value. However, 0 V is applied here.

The counter voltage Vcom applied to the counter electrode 80 and a voltage applied to the auxiliary capacitive line CSL are set to 0 V. The above description means that the voltage is not limited to 0 V but still kept at a voltage value obtained at a point of time before time t1. The voltages may be constant during execution of the refresh action.

To the voltage supply line VSL, at time t1, a voltage obtained by adding a turn-on voltage Vdn of the diode D1 to the target voltage of the internal node N1 to be recovered by the refresh action is applied. In the phase P1, since a refresh target is the case H, the target voltage of the internal node N1 is 5 V. Thus, when the turn-on voltage Vdn of the diode D1 is set to 0.6 V, 5.6 V is applied to the voltage supply line VSL.

The target voltage of the internal node N1 corresponds to a "refresh target voltage", the turn-on voltage Vdn of the diode D1 corresponds to a "first adjusting voltage", and a voltage actually applied to the voltage supply line VSL in the refresh step S1 corresponds to a "refresh input voltage". In the phase P1, the refresh input voltage is 5.6 V.

A voltage is applied to the reference line REF at time t1 such that, when the internal node N1 exhibits a voltage state (gradation level) to be refreshed or a voltage state (high gradation level) higher than the voltage state, the transistor T2 is turned off, and when the internal node N1 exhibits a low-voltage state (low gradation level) lower than the voltage state (gradation level) to be refreshed, the transistor T2 is turned on. In the phase P1, the refresh target is the case H (first voltage state), and there is no voltage state higher than the first voltage state. For this reason, a voltage is applied to the reference line REF such that the transistor T2 is turned off only when the internal node N1 is in the first voltage state (case H), and the transistor T2 is turned on when the internal node N1 is in the second voltage state (case M) or the third voltage state (case L).

More specifically, since a threshold voltage Vt2 of the transistor T2 is 2 V, a voltage higher than 5 V is applied to the reference line REF to make it possible to turn on the transistor T2 in the case M. On the other hand, when a voltage higher than 7 V is applied to the reference line REF, the transistor T2 in the case H serving as a target in the phase P1 is also turned on. Thus, a voltage between 5 V and 7 V may be applied to the reference line REF.

It is assumed that, at a point of time before the self-refresh action is executed, the potential of the internal node N1 is lowered by a certain level from a voltage state written by the immediately writing action due to generation of the leakage current That is, the potential VN1 of the internal node N1 corresponding to the case M may lower to about 2.5 V at the point of time before the self-refresh action is executed. At this time, if a voltage of about 5.1 V is applied to the reference line REF, the transistor T2 may be turned off even in the case M depending on the degree of decrease in potential of the internal node N1. For this reason, the voltage is set to 6.5 V on the safe side.

When 6.5 V is applied to the reference line REF, in a pixel circuit in which the potential VN1 of the internal node N1 is 4.5 V or more, the transistor T2 is turned off. On the other hand, in a pixel circuit in which the VN1 is lower than 4.5 V, the transistor T2 is turned on. At the internal node N1 in the case H in which writing is performed at 5 V in the immediately previous writing action, since the VN1 of 4.5 V or more is realized by executing the self-refresh action before the VN1 is decreased by 0.5 V or more due to generation of a leakage current, the transistor T2 is turned off. On the other hand, the internal node N1 in the case M in which writing is performed at 3 V by the immediately previous writing action and the internal node N1 in the case L in which writing is performed at 0 V do not have 4.5 V or more even after the time has passed, and the transistor T2 is turned on in these cases.

In this manner, a value obtained by subtracting the threshold voltage Vt2 of the transistor T2 from a voltage Vref applied to the reference line REF needs to be set between the internal node potential Vn1 in the case H targeted by the refresh action in the phase and the internal node potential VN1 in the case M having a voltage state one step lower than that in the case H. In other words, in the phase P1, the applied voltage Vref to the reference line REF needs to satisfy a condition: 3 V<(Vref−Vt2)<5 V. A voltage Vref−Vt2 corresponds to a "refresh isolation voltage", a voltage Vt2 corresponds to a "second adjusting voltage", and a voltage Vref corresponds to a "refresh reference voltage". When the above condition is described by using these words, a "refresh reference voltage" applied to the reference line REF in the phase P1 corresponds to a voltage value obtained by adding a "second adjusting voltage" corresponding to the threshold voltage of the transistor T2 to a "refresh isolation voltage" defined by an intermediate voltage between a voltage state (gradation level) targeted by a refresh action and a voltage state (gradation level) one step lower than the voltage state.

A voltage falling within the range in which the transistor T1 is turned on in the case H in which the transistor T2 is turned off and the transistor T1 is turned off in the cases M and L in which the transistor T2 is turned on is applied to the boost line BST.

The boost line BST is connected to one end of the boost capacitor element Cbst. For this reason, when a high-voltage level is applied to the boost line BST, the potential of the other end of the boost capacitor element Cbst, i.e., the potential of the output node N2 is raised. In this manner, it will be called "boost rising" that the voltage applied to the boost line BST is increased to raise the potential of the output node N2.

As described above, in the case H, the transistor T2 is in an off state in the phase P1. For this reason, a variation in potential of the node N2 caused by boost rising is determined by a ratio of a boost capacity Cbst to a full capacity parasitic in the node N2. As an example, when the ratio is 0.7, a potential of one electrode of a boost capacitor element increases by ΔVbst, and a potential of the other electrode, i.e., the potential of the node N2, consequently increases by about 0.7 ΔVbst.

In the case H, the potential VN1 (H) of the internal node N1 exhibits about 5 V at time t1. When a potential higher than the potential VN1 (H) by a threshold voltage of 2 V or more is given to the gate of the transistor T1, i.e., the output node N2, the transistor T1 is turned on. In the embodiment, a voltage applied to the boost line BST at time t1 is set to 10 V. In this case, the potential of the output node N2 consequently increases by 7 V. As will be described later in the third embodiment, since the transistor T2 is turned on in the writing action, the node N2 at a point of time immediately before time t1 exhibits a potential (5 V) almost equal to that of the node N1. In this manner, the node N2 exhibits about 12 V by boost rising. Thus, since a potential difference that is equal to or higher than a threshold voltage is generated between the gate of the transistor T1 and the node N1, the transistor T1 is turned on.

On the other hand, in the case M or the case L in which the transistor T2 is in an on state in the phase P1, unlike in the case H, the output node N2 and the internal node N1 are electrically connected to each other. In this case, a variation in potential of the output node N2 caused by boost rising is influenced by, in addition to a boost capacity Cbst and a full parasitic capacity of the node N2, a full parasitic capacity of the internal node N1.

One end of the auxiliary capacitor element Cs and one end of the liquid crystal capacitor element Clc are connected to the internal node N1, and a full capacity Cp being parasitic in the internal node N1 is approximately expressed by a sum of the liquid crystal capacity Clc and the auxiliary capacity Cs as described above. The boost capacity Cbst has a value that is considerably smaller than that of a liquid crystal capacity Cp. Therefore, a ratio of the boost capacity to the total of capacities is very low, for example, a value of about 0.01 or less. In this case, when a potential of one electrode of the boost capacitor element increases by ΔVbst, a potential of the other electrode, i.e., the potential of the output node N2 increases by only about 0.01 ΔVbst at most. More specifically, in the cases M and the case L, even though ΔVbst=10 V, the potentials VN2 (M) and VN2 (L) of the output node N2 increase very little.

In the case M, the potential VN2 (M) exhibits about 3 V immediately before time t1. In the case L, the potential VN2 (L) exhibits about 0 V immediately before time t1. Therefore, even though boost rising is performed at time t1 in both the cases, to the gate of the transistor T1, a potential enough to turn on the transistor is not given. More specifically, unlike in the case H, the transistor T1 is still in an off state.

In the cases M and L, the potential of the output node N2 immediately before time t1 need not be always 3 V and 0 V, respectively, and a potential at which the transistor T1 is not turned on in consideration of a small variation in potential caused by pulse voltage application to the boost line BST may be set. Similarly, in the case H, a potential of the node N1 immediately before time t1 is not necessarily 5 V, a potential at which the transistor T1 is turned on in consideration of a variation in potential caused by performing boost rising under a situation where the transistor T2 is in an off state may be set.

In the case H, boost rising is performed to turn on the transistor T1. Since 5.6 V is applied to the voltage supply line VSL, when the potential VN1 (H) of the internal node N1 is slightly lower than 5 V, a potential difference that is equal to or larger than the turn-on voltage Vdn of the diode D1 is generated between the voltage supply line VSL and the internal node N1. Thus, the diode D1 is turned on in a direction from the voltage supply line VSL to the internal node N1, and a current flows in this direction. In this manner, the potential VN1 (H) of the internal node N1 increases. The increase in potential occurs until the potential difference between the voltage supply line VSL and the internal node N1 is equal to the turn-on voltage Vdn of the diode D1, and is stopped when the potential difference is equal to Vdn. In this case, the applied voltage of the voltage supply line VSL is 5.6 V, and the turn-on voltage Vdn of the diode D1 is 0.6 V. For this reason, the increase of the potential VN1 (H) of the internal node N1 is stopped when the potential VN1 (H) increases to 5 V. That is, a refresh action in the case H is executed.

As described above, in both the cases M and L, since the transistor T1 is in an off state, the voltage supply line VSL and the internal node N1 are not turned on. Thus, an applied voltage to the voltage supply line VSL does not influence the potentials VN1 (M) and VN1 (L) of the internal node N1.

When the above description is summarized, the refresh action is executed to a pixel circuit in which the potential of the internal node N1 is the refresh isolation voltage or more and the refresh target voltage or less. In the phase P1, since the refresh isolation voltage and the refresh target voltage are set to 4.5 V (=6.5−2 V) and 5 V, respectively, a refresh action to set the potential VN1 to 5 V is performed to only a pixel circuit in which the potential VN1 of the internal node N1 is 4.5 V or more and 5 V or less, i.e., in only the case H.

Upon completion of the phase P1, voltage applications to the voltage supply line VSL, the boost line BST, and the reference line REF are temporarily stopped. Thereafter, the next phase P2 is started from time t2.

<<Step S1/Phase P2>>

In the phase P2 started from time t2, the case M (intermediate-voltage writing node) is to be refreshed.

More specifically, 3.6 V is applied to the voltage supply line VSL as a refresh input voltage. The voltage of 3.6 V is obtained by adding the turn-on voltage Vdn of the diode D1 to the refresh target voltage (3 V) of the internal node N1 in the phase P2.

A voltage is applied to the reference line REF such that the transistor T2 is turned off when the internal node N1 exhibits a voltage state (case M) to be refreshed or a voltage state higher than the voltage state to be refreshed and the transistor T2 is turned on when the internal node N1 exhibits a voltage state (case L) lower than the voltage state (case M) to be refreshed. As in the phase P1, a voltage higher than 2 V is applied to the reference line REF to make it possible to turn on the transistor T2 in the case L. On the other hand, when a voltage higher than 5 V is applied to the reference line REF, the transistor T2 in the case M is also turned on. Thus, formally, a voltage between 2 V and 5 V may be applied to the reference line REF. However, since a voltage needs to be applied as in the phase P1 with some margin, a voltage of 4.5 V is applied as an example here. The voltage of 4.5 V corresponds to the refresh reference voltage in the phase P2, and a voltage of 2.5 V obtained by subtracting a threshold voltage of the transistor T2 therefrom corresponds to the refresh isolation voltage.

At this time, when the potential VN1 of the internal node N1 is 2.5 V or more that is the refresh isolation voltage, the transistor T2 is turned off. On the other hand, in a pixel circuit in which the voltage VN1 is lower than 2.5 V, the transistor T2 is turned on. That is, in the case H in which writing is performed at 5 V by the immediately previous writing action and the case M in which writing is performed at 3 V, the transistor T2 is turned off because both the voltages VN1 are 2.5 V or more. On the other hand, in the case L in which writing is performed at 0 V by the immediately previous writing action, the transistor T2 is turned on because the voltage VN1 is lower than 2.5 V.

A voltage falling within the range in which the transistor T1 is turned on in the cases H and M in which the transistor T2 is turned off and the transistor T1 is turned off in the case L in which the transistor T2 is turned on is applied to the boost line BST. In this case, the voltage is set to 10 V as in the phase P1. Since the potential of the output node N2 is raised by boost rising in the cases H and M, the transistor T1 is turned on. On the other hand, even though the boost rising is performed in the case L, the potential VN2 (L) of the output node N2 rarely changes. For this reason, the transistor T1 is not turned on. This principle is the same as that in the phase P1, and a detailed description thereof will be omitted.

In the case H, boost rising is performed to turn on the transistor T1. However, a voltage of 3.6 V is applied to the voltage supply line VSL. Even though the potential VN1 (H) of the internal node N1 slightly decreases from 5 V, the potential VN1 (H) decreases by a voltage lower than 1 V. In this case, a reversely-biased state from the voltage supply line VSL to the internal node N1 is set, the voltage supply line VSL and the internal node N1 are not electrically connected to each other due to a rectifying function of the diode D1. More specifically, the potential VN1 (H) of the internal node N1 is not influenced by an applied voltage of the voltage supply line VSL.

Also in the case M, boost rising is performed to turn on the transistor T1. Since 3.6 V is applied to the voltage supply line VSL, when the potential VN1 (M) of the internal node N1 is slightly lower than 3 V, a potential difference that is equal to or larger than the turn-on voltage Vdn of the diode D1 is generated between the voltage supply line VSL and the internal node N1. Thus, the diode D1 is turned on in a direction from the voltage supply line VSL to the internal node N1, and a current flows in this direction. In this manner, the potential VN1 (M) of the internal node N1 increases until a potential difference between the voltage supply line VSL and the internal node N1 becomes equal to the turn-on voltage Vdn (=0.6 V). More specifically, after the VN1 (M) rises to 3 V, the potential is maintained. In this manner, a refresh action in the case M is executed.

As described above, in the case L, since the transistor T1 is in an off state, the source line SL and the internal node N1 are not electrically connected to each other. Thus, an applied voltage to the voltage supply line VSL does not influence the potential VN1 (L) of the internal node N1.

When the above description is summarized, in the phase P2, the refresh isolation voltage is set to 2.5 V (=4.5−2 V), and the refresh target voltage is set to 3 V. For this reason, an action to refresh the potential VN1 to 3 V is performed to only a pixel circuit in which the potential VN1 of the internal node N1 is 2.5 V or more and 3 V or less, i.e., in only the case M.

Upon completion of the phase P2, voltage applications to the voltage supply line VSL, the boost line BST, and the reference line REF are stopped, and the step shifts to a standby step S2.

<<Step S2>>

In the step S2 started from time t3, regardless of the potential VN1 of the internal node N1, a voltage at which the transistor T2 is always turned on is applied to the reference line REF. The voltage is set to 10 V.

In at least the step S2, it is assumed that 0 V is applied to the source line SL. In the configuration in which 0 V is applied to the source line SL in the step S1, the state in which 0 V is applied may continuously be maintained. 0 V is also applied to the voltage supply line VSL.

When the voltage state is set, in all the cases H, M, and L, the transistor T2 is turned on, and the transistor T1 is turned off. Since a low-level voltage is still applied to the gate line GL, the transistor T3 is still in an off state. Thus, the potential VN1 of the internal node N1 is maintained in a state immediately after a refresh step S1 is ended. Since the output node N2 and the internal node N1 are electrically connected to each other, the potential VN2 is equal to the potential VN1.

Thereafter, at time t4, an applied voltage of the reference line REF is shifted to a low level (0 V). In this manner, the transistor T2 is turned off.

In the step S2, it is assumed that the same voltage state is maintained for a period of time sufficiently longer than that in the step S1. Meanwhile, since 0 V is applied to the source line SL, a leakage current is generated in a direction from the internal node N1 to the source line SL through the transistor T3 in an off state. As described above, even though the voltage VN1 (L) is slightly higher than 0 V at time t1, the voltage VN1 (L) gradually comes close to 0 V for a period of the standby step S2. In this manner, a refresh action of the case L is "indirectly" performed.

At this time, when 0 V is applied to the voltage supply line VSL, a leakage current from the voltage supply line VSL to the internal node N1 is suppressed from being generated, disturbance of the indirect refresh action in the case L is excluded.

However, the leakage current is not generated in only the case L, and the leakage current is also generated in the case H or the case M. For this reason, even in the case H and the case M, the potentials VN1 are refreshed to 5 V and 3V, respectively, at a point of time immediately after the step S1. However, in step S2, the potential VN1 gradually decreases. Thus, after the voltage state in the standby step S2 is maintained for a predetermined period of time, the refresh step S1 is desirably executed again to execute the refresh action to the cases H and M again.

As described above, the refresh step S1 and the standby step S2 are repeated to make it possible to return the potential VN1 of the internal node N1 to the immediately previous writing state for each of the cases H, M, and L.

As in the conventional technique, when a refresh action is to be performed to each pixel circuit through the source line SL by a "writing action", the gate lines GL need to be scanned in a vertical direction one by one. For this reason, a high-level voltage needs to be applied to the gate lines GL the number of times which is equal to the number (n) of the gate lines. Since a potential having the same level as a potential level written in the immediately previous writing action needs to be applied to the source lines SL, charging/discharging actions need to be performed to each of the source lines SL up to n times.

In contrast to this, according to the embodiment, application of a pulse voltage is performed in twice in the refresh step, and a constant voltage state is only maintained in the subsequent standby step. Regardless of the voltage state of the internal node N1, for all the pixel circuits, the potential of the internal node N1, i.e., the voltage of the pixel electrode 20 can be returned to a potential state in the writing action. More specifically, in a 1-frame period, the number of times of a change in application voltage applied to the lines in order to return the potentials of the pixel electrodes 20 of the pixels can be considerably reduced, and, furthermore, the control contents can also be simplified. For this reason, power consumptions of the gate driver 14 and the source driver 13 can be considerably reduced.

In the self-refresh action described with reference to FIG. 18, the pixel circuit 2A in FIG. 7A is supposed. However, also in a modified pixel circuit shown in FIG. 8, it is obvious that the self refresh action can be executed by the same method.

When a plurality of diodes D1 are included in the second switch circuit 23, unless the turn-on voltage Vdn has a potential difference that is multiplied by the number of diodes D1 or more from the voltage supply line VSL to the internal node N1 in the second switch circuit 23, the voltage supply line VSL and the internal node N1 are not electrically connected to each other. Thus, for example, when the two diodes D1 are arranged in the second switch circuit 23, as a refresh input voltage applied to the voltage supply line VSL, a voltage obtained by adding a value twice as high as the turn-on voltage Vdn as a first adjusting voltage to a refresh target voltage in each case needs to be applied. With respect to the other points, a self-refresh action can be executed by the same method as that in FIG. 18.

In place of the voltage applying method shown in FIG. 18, the following method can also be used.

1) In FIG. 18, a refresh action is executed to the case H in the phase P1. Thereafter, a refresh action is executed to the case M. This order may be reversed.

The order of the step S1 and the step S2 is not a very significant argument in consideration of the repeated execution of the steps S1 and S2.

2) It is assumed that 10 V is applied to the boost line BST in each of both the phases P1 and P2. However, the transistor T1 in the case H has only to be turned on in the phase P1, and the transistor T1 in the case M has only to be turned on in the phase P2. In the phase P2, a voltage applied to the voltage supply line VSL is 3.6 V, and a threshold voltage of the transistor T3 is 2 V. For this reason, if the turn-on voltage Vdn of the diode D1 is not considered, a voltage of at least 5.6 V or more may be applied. That is, in the phase P2, in the range in which the transistor T1 in the case M is turned on, an applied voltage to the boost line BST can be made smaller than that in the phase P1.

3) In the standby step S2, a high-level voltage (10 V) is applied to the reference line REF from time t3 to time t4. This voltage application is merely performed to make the potential VN2 of the output node N2 equal to the potential VN1 of the internal node N1. Thus, within the period of the step S2, a high-level voltage may be applied to the reference line REF at any timing.

Figure 19:
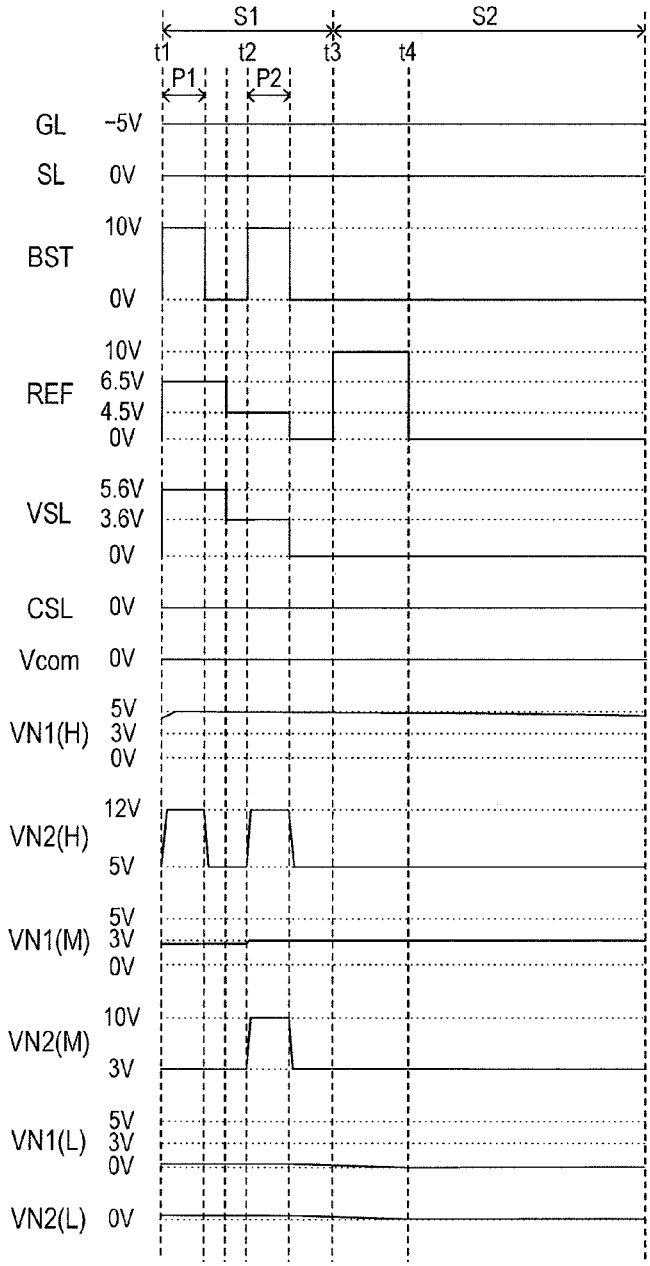
FIG. 19 is another timing chart of self-refresh actions of the second embodiment performed by the pixel circuits of the first and third types.

4) In FIG. 18, in the refresh step S1, after the refresh action in the phase P1, the voltages of the voltage supply line VSL and the reference line REF are lowered to a low level (0 V), and a refresh action in the phase P2 is performed. However, applied voltages to these lines are not necessarily lowered to the low level. For example, as shown in FIG. 19, between the phases P1 and P2, i.e., while the level of the boost line BST is lowered to the low level (0 V), the voltage supply line VSL and the reference line REF may be set to a voltage to be applied to the phase P2. In this manner, in comparison with the case in FIG. 18, ranges of variation of applied voltages to the voltage supply line VSL and the reference line REF can be reduced.

Figure 20:
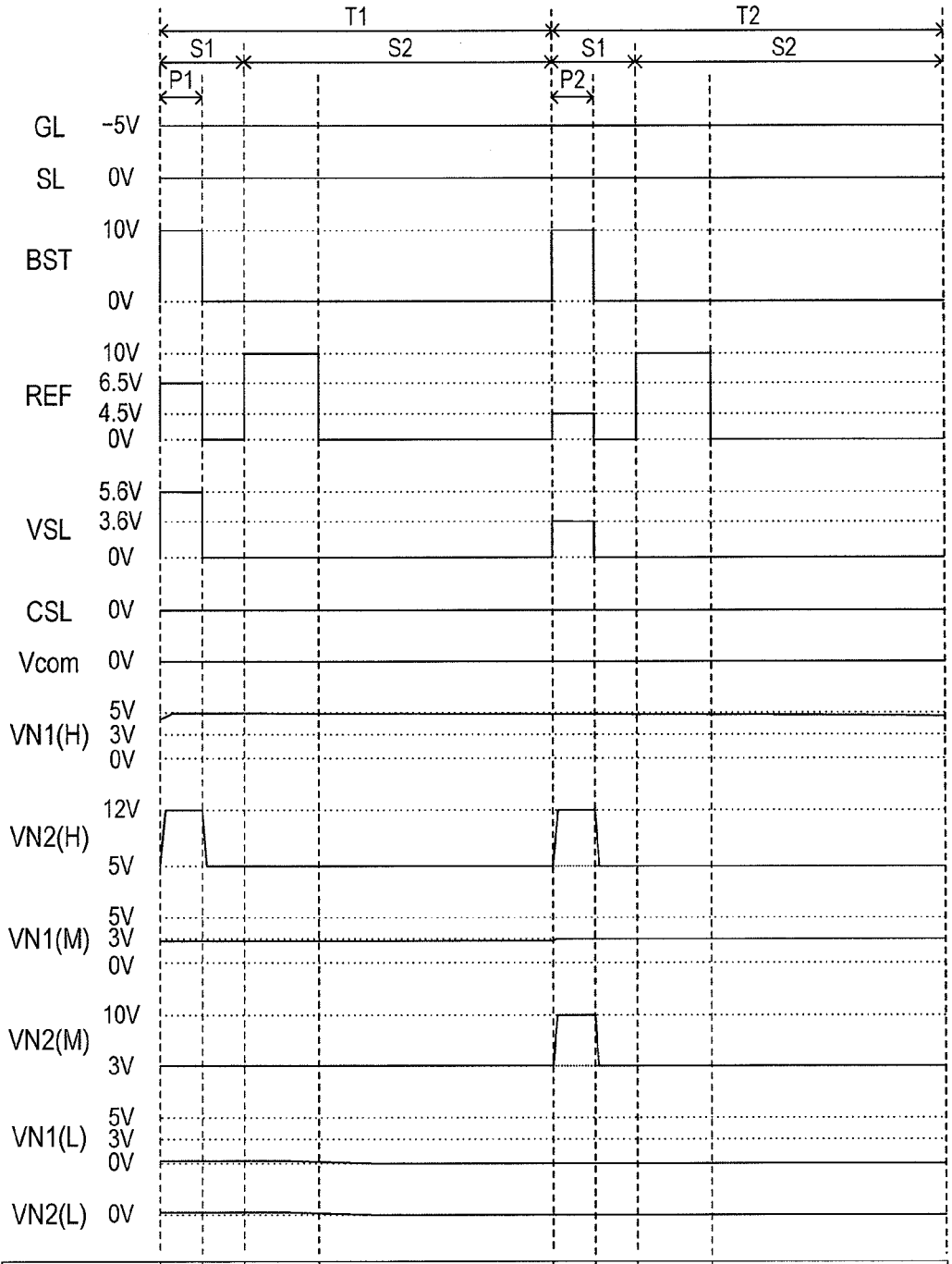
FIG. 20 is another timing chart of self-refresh actions of the second embodiment performed by the pixel circuits of the first and third types.

5) In the above embodiment, it is assumed that, as a series of self-refresh actions, an action that performs a refresh action to the case H and the case M in the refresh step S1 and subsequently performs the standby step S2 is repeatedly executed. In contrast to this, a refresh action is performed to a certain gradation level in the refresh step S1, thereafter, after the standby step S2 is performed, in the refresh step S1 of the next term, a refresh action may be performed to another gradation level (see FIG. 20). In FIG. 20, in the refresh step S1 of a term T1, a refresh action is performed to the node N1 in the case H (P1), after the standby step S2 is performed, a refresh action is performed to the node N1 in the case M in the refresh step S1 of a next term T2 (P2). In this manner, a gradation level targeted by the refresh action may be changed for each term.

<Second Type>

A pixel circuit, belonging to the second type, in which the second switch circuit 23 is configured by the series circuit of the transistor T1, the diode D1, and the transistor T4, and the control terminal of the transistor T4 is connected to the selecting line SEL will be described below.

A case in which a self-refresh action is executed to the pixel circuit 2B of the second type shown in FIG. 9 will be described below. When the pixel circuit 2B is compared with the pixel circuit 2A shown in FIG. 7, the pixel circuit 2B is different from the pixel circuit 2A in that a conducting state of the second switch circuit 23 is also controlled by not only the transistor T1 and the diode D1 but also the transistor T4.

In this case, as described above in the first type, the voltage supply line VSL and the internal node N1 are electrically connected to each other through the second switch circuit 23 only during the refresh step S1. In each of the refresh steps S1, control is performed by the diode D1 or the transistor T1 such that only a case targeted by a refresh action is turned on. In other cases, the diode D1 is reversely biased, or the transistor T1 is turned off to turn off the second switch circuit 23. This point is also applied to the second type.

Figure 21:
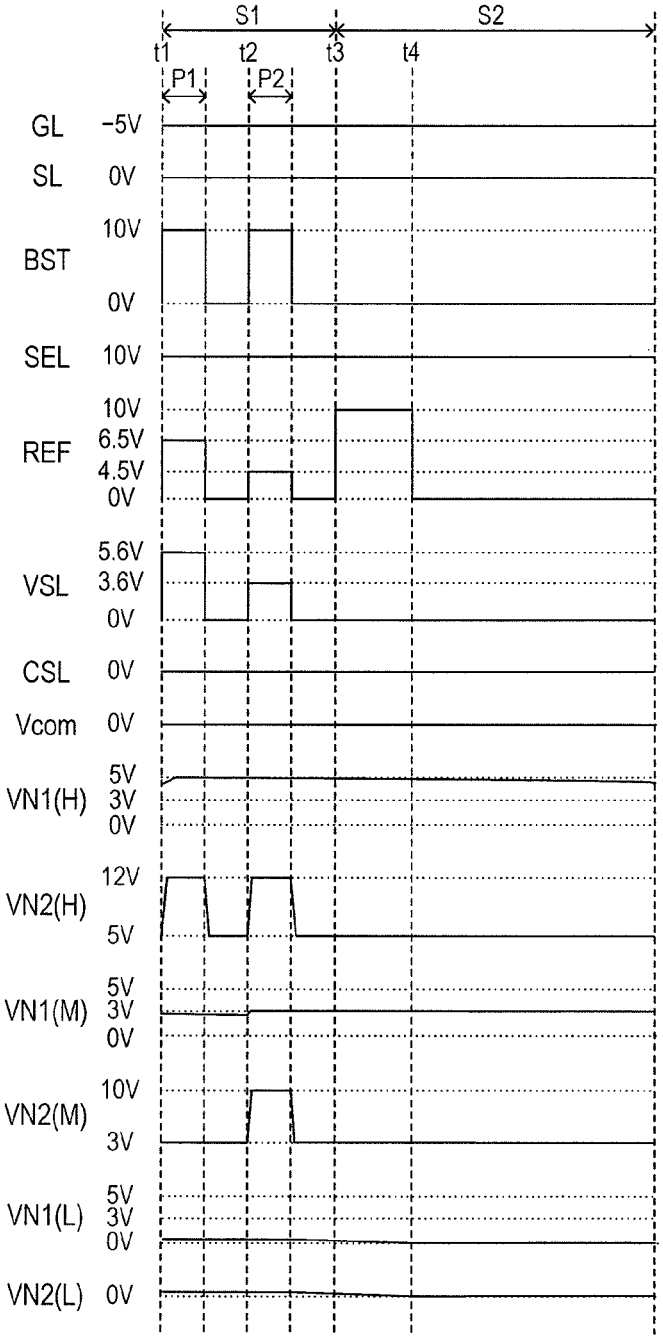
FIG. 21 is a timing chart of a self-refresh action of the second embodiment performed by the pixel circuit of the second type.

In the second type, the transistor T4 is arranged. However, the selecting line SEL to control the conducting state of the transistor T4 is arranged independently of the boost line BST. Thus, when a voltage is applied to the selecting line SEL so that the transistor T4 is always in an on state during the refresh step S1, the same voltage state as that in the first type can be realized. A timing chart in this case is shown in FIG. 21. An applied voltage to the selecting line SEL is set to 10 V.

Figure 22:
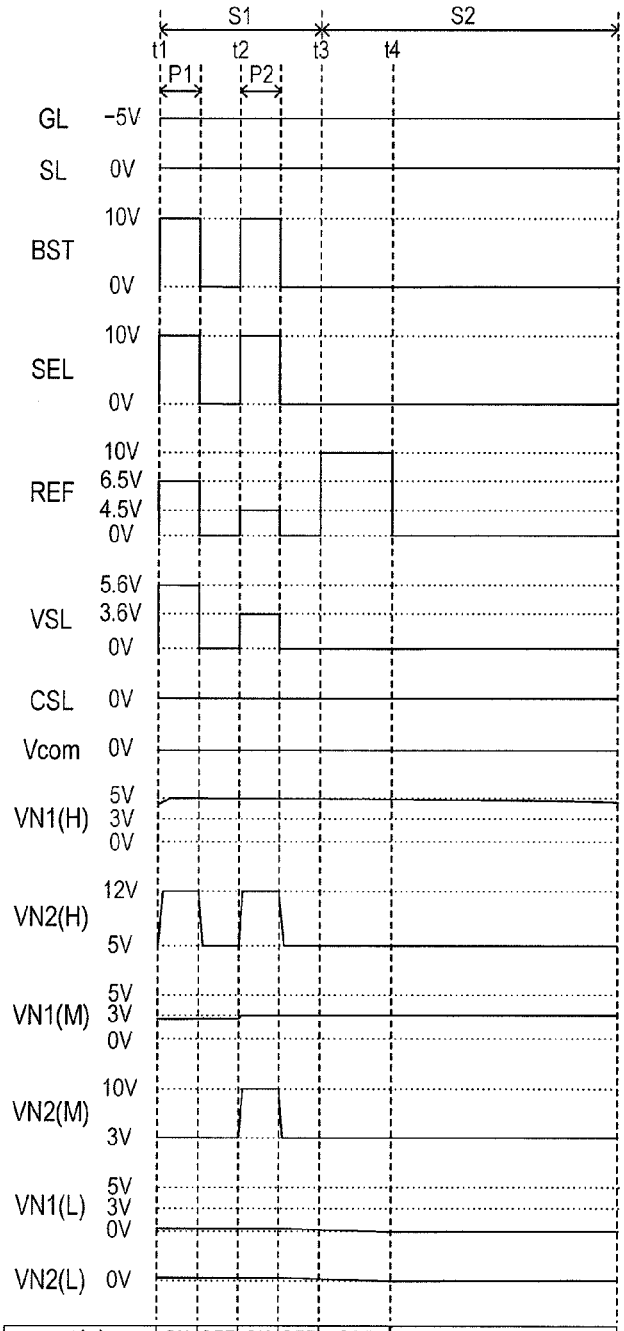
FIG. 22 is another timing chart of a self-refresh action of the second embodiment performed by the pixel circuit of the second type.

As a matter of course, a pulse-like voltage may be applied to the selecting line SEL at the same timing as that at which a boost voltage is applied to the boost line BST. A timing chart in this case is shown in FIG. 22.

The above description is applied to the pixel circuit 2B shown in FIG. 10 to FIG. 11 and the pixel circuit 2C shown in FIG. 12 to FIG. 15, as a matter of course, and a description thereof will be omitted.

<Third Type>

A pixel circuit, belonging to the third type, in which the second switch circuit 23 is configured by a series circuit of the transistor T1, the diode D1, and the transistor T4, and the control terminal of the transistor T4 is connected to the boost line BST will be described below.

Each of the pixel circuits belonging to the third type has a configuration in which, for each of the pixel circuits belonging to the second type, a connection destination of the control terminal of the transistor T4 is changed into the boost line BST and the selecting line SEL is not provided. Thus, unlike in the pixel circuit of the second type, turn-on/off control of the transistor T4 depends on the boost line BST.

However, as shown in FIG. 22, in the second type, also when a pulse voltage is applied to the selecting line SEL at the same timing as that of the boost line BST, the same voltage state as that of each of the pixel circuits of the first type can be realized. This means that the same voltage state can be realized also by connecting the control terminal of the transistor T4 to the boost line BST.

Thus, when the same voltage state as that in FIG. 18 is set, a self-refresh action can also be executed to the pixel circuit 2D in FIG. 16. This is also applied to the pixel circuit 2E in FIG. 17. A detailed description thereof will be omitted.

[Third Embodiment]

In the third embodiment, a case in which a self-refresh action is executed by a voltage applying method different from that in the second embodiment will be described with reference to the accompanying drawings. The self-refresh action of the embodiment, as in the second embodiment, is divided into a refresh step S1 and a standby step S2.

In the second embodiment, only the internal node N1 in the case H (high-voltage writing) is refreshed in the phase P1, and only the internal node N1 in the case M (intermediate-voltage writing) is refreshed in the phase P2. In the step S1, pulse voltage application to the boost line BST needs to be performed in each of the phase P1 and the phase P2.

In contrast to this, in the embodiment, as will be described later, only the internal node N1 in the case M (intermediate-voltage writing) is refreshed in the phase P1, and only the internal node N1 in the case H (high-voltage writing) is refreshed in the phase P2. In the step S1, a high-level voltage is given to the boost line BST in the phases P1 to P2. In this manner, the number of times of changing of an applied voltage to the boost line BST in the step S1 is reduced, and a power consumption in the self-refresh action can be reduced. This action will be described below in detail.

<First Type>

A case in which the self-refresh action according to the embodiment is performed to the pixel circuit 2A of the first type will be described below with reference to the timing chart in FIG. 23. As the pixel circuit 2A, as in the second embodiment, the pixel circuit 2A shown in FIG. 7 is supposed.

<<Step S1/Phase P1>>

In the phase P1, a writing node N1 (M) in the case M (intermediate-voltage state) is to be refreshed.

In the step S1 started from time t1, a voltage is applied to a gate line GL such that the transistor T3 is completely turned off. The voltage is set to −5 V. Since the transistor T3 is always in an off state during execution of the self-refresh action, an applied voltage to the gate line GL may be constant during the execution of the self-refresh action.

As in the second embodiment, 0 V is applied to the source line SL.

The counter voltage Vcom applied to the counter electrode 80 and a voltage applied to the auxiliary capacitive line CSL are set to 0 V. The above description means that the voltage is not limited to 0 V but still kept at a voltage value obtained at a point of time before time t1. These voltages may be constant during the execution of the self-refresh action.

At time t1, a voltage is applied to the reference line REF such that, when the internal node N1 exhibits a voltage state (gradation level) to be refreshed or a voltage state (high gradation level) higher than the voltage state, the transistor T2 is turned off, and when the internal node N1 exhibits a low-voltage state (low gradation level) lower than the voltage state (gradation level) to be refreshed, the transistor T2 is turned on. In the phase P1, the refresh target is the second voltage state (case M), and a voltage is applied to the reference line REF such that the transistor T2 is turned off when the internal node N1 is in the second voltage state (case M) or the first voltage state (case H), and the transistor T2 is turned on when the internal node N1 is in the third voltage state (case L).

More specifically, since a threshold voltage Vt2 of the transistor T2 is 2 V, a voltage higher than 2 V is applied to the reference line REF to make it possible to turn on the transistor T2 in the case L. On the other hand, when a voltage higher than 5 V is applied to the reference line REF, the transistor T2 in the case M serving as a target in the phase P1 is also turned on. Thus, a voltage between 2 V and 5 V may be applied to the reference line REF. In the example in FIG. 23, it is assumed that 4.5 V is applied to the reference line REF.

When 4.5 V is applied to the reference line REF, in a pixel circuit in which the potential VN1 of the internal node N1 is 2.5 V or more, the transistor T2 is turned off. On the other hand, in a pixel circuit in which the potential VN1 is lower than 2.5 V, the transistor T2 is turned on.

In the internal node N1 in the case M in which writing is performed at 3 V in the immediately previous writing action, since the VN1 of 2.5 V or more is realized by executing the self-refresh action before the VN1 is decreased by 0.5 V or more due to generation of a leakage current, the transistor T2 is turned off. In the internal node N1 in the case H in which writing is performed at 5 V in the immediately previous writing action, since the VN1 of 2.5 V or more is realized for the same reason as described above, the transistor T2 is turned off. On the other hand, the internal node N1 in the case L in which writing is performed at 0 V by the immediately previous writing action does not have 2.5 V or more even after the time has passed, and the transistor T2 is turned on in this case.

To the voltage supply line VSL, a voltage obtained by adding a turn-on voltage Vdn of the diode D1 to the target voltage of the internal node N1 to be recovered by the refresh action is applied (at time t2). In this case, in the phase P1 of the embodiment, since the refresh target is the case M, the target voltage of the internal node N1 is 3 V. Thus, when the turn-on voltage Vdn of the diode D1 is set to 0.6 V, 3.6 V is applied to the voltage supply line VSL. Time T1 at which 4.5 V is applied to the reference line REF and time t2 at which 3.6 V is applied to the voltage supply line VSL may be set to the same time.

The target voltage of the internal node N1 corresponds to a "refresh target voltage", the turn-on voltage Vdn of the diode D1 corresponds to a "first adjusting voltage", and a voltage actually applied to the voltage supply line VSL in the refresh step S1 corresponds to a "refresh input voltage". In the phase P1, the refresh input voltage is 3.6 V.

A voltage falling within the range in which the transistor T1 is turned on in the case M and the case H in which the transistor T2 is turned off and the transistor T1 is turned off in the case L in which the transistor T2 is turned on is applied to the boost line BST (at time t3). The boost line BST is connected to one end of the boost capacitor element Cbst. For this reason, when a high-voltage level is applied to the boost line BST, the potential of the other end of the boost capacitor element Cbst, i.e., the potential of the output node N2 is raised.

As described above, in each of the case M and the case H, the transistor T2 is in an off state in the phase P1. For this reason, a variation in potential of the node N2 caused by boost rising is determined by a ratio of a boost capacity Cbst to a full capacity parasitic in the node N2. As an example, when the ratio is 0.7, a potential of one electrode of a boost capacitor element increases by ΔVbst, and a potential of the other electrode, i.e., the potential of the node N2, consequently increases by about 0.7 ΔVbst.

In the case M, the potential VN1 (M) of the internal node N1 exhibits about 3 V at time t1. When a potential higher than the potential VN1 (M) by a threshold voltage of 2 V or more is given to the gate of the transistor T1, i.e., the output node N2, the transistor T1 is turned on. In the embodiment, a voltage applied to the boost line BST at time t1 is set to 10 V. In this case, the output node N2 consequently increases by 7 V. In the writing action, since the transistor T2 is turned on, the node N2 exhibits a potential (about 3 V) almost equal to that of the node N1 at a point of time immediately before time t1. In this manner, the node N2 exhibits about 10 V by boost rising. Thus, since a potential difference higher that is equal to or higher than a threshold voltage is generated between the gate of the transistor T1 and the node N1, the transistor T1 is turned on.

As in the case H, since the node N2 exhibits about 12 V due to boost rising, the transistor T1 is turned on.

On the other hand, in the case L in which the transistor T2 is in an on state in the phase P1, unlike in the case M and the case H, the output node N2 and the internal node N1 are electrically connected to each other. In this case, a variation in potential of the output node N2 caused by boost rising is influenced by, in addition to a boost capacity Cbst and a full parasitic capacity of the node N2, a full parasitic capacity of the internal node N1.

One end of the auxiliary capacitor element Cs and one end of the liquid crystal capacitor element Clc are connected to the internal node N1, and a full capacity Cp being parasitic in the internal node N1 is approximately expressed by a sum of the liquid crystal capacity Clc and the auxiliary capacity Cs. The boost capacity Cbst has a value that is considerably smaller than that of a liquid crystal capacity Cp. Therefore, a ratio of the boost capacity to the total of capacities is very low, for example, a value of about 0.01 or less. In this case, when a potential of one electrode of the boost capacitor element increases by ΔVbst, a potential of the other electrode, i.e., the potential of the output node N2 increases by only about 0.01

ΔVbst at most. More specifically, in the case L, even though ΔVbst=10 V, the potential VN2 (L) of the output node N2 increase very little.

In the case L, the potential VN2 (L) exhibits about 0 V immediately before time t1. Therefore, even though boost rising is performed at time t1, to the gate of the transistor T1, a potential enough to turn on the transistor is not given. More specifically, unlike in the case M, the transistor T1 is still in an off state.

In the case M, boost rising is performed to turn on the transistor T1. Since 3.6 V is applied to the voltage supply line VSL, when the potential VN1 (M) of the internal node N1 is slightly lower than 3 V, a potential difference that is equal to or larger than the turn-on voltage Vdn of the diode D1 is generated between the voltage supply line VSL and the internal node N1. Thus, the diode D1 is turned on in a direction from the voltage supply line VSL to the internal node N1, and a current flows in a direction from the voltage supply line VSL to the internal node N1. In this manner, the potential VN1 (M) of the internal node N1 increases. The increase in potential occurs until the potential difference between the voltage supply line VSL and the internal node N1 is equal to the turn-on voltage Vdn of the diode D1, and is stopped when the potential difference is equal to Vdn. In this case, the applied voltage of the voltage supply line VSL is 3.6 V, and the turn-on voltage Vdn of the diode D1 is 0.6 V. For this reason, the increase of the potential VN1 (M) of the internal node N1 is stopped when the potential VN1 (M) increases to 3 V. That is, a refresh action in the case M is executed.

Also in the case H, boost rising is performed to turn on the transistor T1. However, a voltage of 3.6 V is applied to the voltage supply line VSL. Even though the potential VN1 (H) of the internal node N1 slightly decreases from 5 V, the potential VN1 (H) decreases by a voltage lower than 1 V. In this case, a reversely-biased state from the voltage supply line VSL to the internal node N1 is set, the voltage supply line VSL and the internal node N1 are not electrically connected to each other due to a rectifying function of the diode D1. More specifically, the potential VN1 (H) of the internal node N1 is not influenced by an applied voltage of the voltage supply line VSL.

Since the transistor T1 is in an off state in the case L, the voltage supply line VSL and the internal node N1 are not electrically connected to each other. Thus, an applied voltage to the voltage supply line VSL does not influence the potential VN1 (L) of the internal node N1.

When the above description is summarized, in the phase P1, a refresh action is executed to the pixel circuit in which the potential of the internal node N1 is the refresh isolation voltage or more and the refresh target voltage or less. In the phase P1, the refresh isolation voltage is set to 2.5 V (=4.5−2 V), and the refresh target voltage is set to 3 V. For this reason, an action to refresh the potential VN1 to 3 V is performed to only a pixel circuit in which the potential VN1 of the internal node N1 is 2.5 V or more and 3 V or less, i.e., in only the case M.

<<Step S1/Phase P2>>

In the phase P2, a writing node N1 (H) in the case H (high-voltage state) is to be refreshed.

An applied voltage to the boost line BST is set to 10 V subsequently from the phase P1.

A voltage is applied to the reference line REF at time t4 such that the transistor T2 is still in an off state when the internal node N1 exhibits a voltage state (case H) to be refreshed and the transistor T2 is turned on when the internal node N1 exhibits a voltage state (case M, L) lower than the voltage state (case H) to be refreshed.

More specifically, a threshold voltage Vt2 of the transistor T2 is 2 V, and the voltage VN1 (M) of the internal node N1 in the case M is 3 V. For this reason, a voltage higher than 5 V (=2+3) is applied to the reference line REF to make it possible to turn on the transistor T2 in the case M. At this time, the transistor T2 is also turned on in the case L as a matter of course.

On the other hand, when a voltage higher than 7 V is applied to the reference line REF, the transistor T2 in the case H is also turned on. Thus, formally, a voltage between 5 V and 7 V may be applied to the reference line REF. However, since a voltage needs to be applied as in the phase P1 with some margin, a voltage of 6.5 V is applied as an example here. The voltage of 6.5 V corresponds to the refresh reference voltage in the phase P2, and a voltage of 4.5 V obtained by subtracting a threshold voltage of the transistor T2 therefrom corresponds to the refresh isolation voltage.

At this time, when the potential VN1 of the internal node N1 is 4.5 V or more that is the refresh isolation voltage, the transistor T2 is turned off. On the other hand, in a pixel circuit in which the VN1 is lower than 4.5 V, the transistor T2 is turned on. That is, in the case H in which writing is performed at 5 V by the immediately previous writing action, the transistor T2 is turned off because the voltage VN1 is 4.5 V or more. On the other hand, in the case L in which writing is performed at 0 V and in the case M in which writing is performed at 3 V by the immediately previous writing action, the transistor T2 is turned on because the voltage VN1 is lower than 4.5 V.

To the voltage supply line VSL, a voltage obtained by adding a turn-on voltage Vdn of the diode D1 to the target voltage of the internal node N1 to be recovered by the refresh action is applied (at time t5). In this case, in the phase P2 of the embodiment, since the refresh target is the case H, the target voltage of the internal node N1 is 5 V. Thus, when the turn-on voltage Vdn of the diode D1 is set to 0.6 V, 5.6 V is applied to the voltage supply line VSL. As will be described below, in the phase P2, time t5 at which 5.6 V is applied to the voltage supply line VSL must be later than time t4 at which 6.5 V is applied to the reference line REF.

In the case H, the transistor T2 maintains a non-conducting state subsequently from the phase P1, and the potential of the internal node N2 holds the state in the phase P1 to turn on the transistor T1. In this state, when 5.6 V is applied to the voltage supply line VSL to slightly decrease the potential VN1 (H) of the internal node N1 from 5 V, a potential difference that is the turn-on voltage Vdn or more of the diode D1 is generated between the voltage supply line VSL and the internal node N1. Thus, the diode D1 is turned on in a direction from the voltage supply line VSL to the internal node N1, and a current flows in a direction from the voltage supply line VSL to the internal node N1. In this manner, the potential VN1 (H) of the internal node N1 increases until the potential difference between the voltage supply line VSL and the internal node N1 is equal to the turn-on voltage Vdn (=0.6 V). More specifically, after the VN1 (M) rises to 5 V, the potential is maintained. In this manner, a refresh action in the case H is executed.

The case M will be described in detail. In a stage immediately before time t4 at which 6.5 V is applied to the reference line REF, the potential VN2 (M) of the node N2 is about 12 V, and the VN1 (M) is 3 V. In this state, 6.5 V is applied to the reference line REF at time t4, the transistor T2 is turned on in a direction from the node N2 to the node N1, and a current is generated in this direction. However, as described above, since a parasitic capacity of the node N1 is considerably larger than the parasitic capacity of the node N2, the potential of the node N2 decreases due to the current generation, and, on the other hand, the potential of the node N1 becomes constant. After the potential of the node N2 is decreased until the potential (i.e., 3 V) is equal to that of the node N1, the decrease in potential is stopped. At this point of time, since the refresh action has been performed in the phase P in the case M, the potential VN2 (M) of the node N2 is equal to the potential of the VN1 (M) obtained after the refresh action.

When the potential of the node N2 is lower than a voltage (i.e., 5 V) obtained by adding the threshold voltage (2 V) of the transistor T1 to the potential of the node N1, the transistor T1 is turned off. As described above, since the node N2 has a potential equal to that of the node N1 to stop the change in potential, thereafter, the transistor T1 is continuously in an off state. Thus, in this state, even though 5.6 V is applied to the voltage supply line VSL, the voltage is not supplied to the node N1 (M) through the transistor T1. That is, an applied voltage (5.6 V) to the voltage supply line VSL in the phase P2 does not influence the potential of the potential VN1 (M) of the internal node N1.

Conversely, when 5.6 V is applied to the voltage supply line VSL at time t5, in order to prevent the voltage from being supplied to the internal node N1 in the case M, the transistor T1 needs to be in an off state at a point of time of time t5. The transistor T1 in the case M is turned on in a stage immediately before 6.5 V is applied to the reference line REF. In order to turn off the transistor T1, after 6.5 V is applied to the reference line REF, the potential VN2 of the node N2 needs to be lower than at least 5 V. For this reason, after 6.5 V is applied to the reference line REF at time 4, an applied voltage to the voltage supply line VSL must be changed to 5.6 V after time until the potential VN2 of the node N2 is lower than at least 5 V has passed. Thus, time t5 at which 5.6 V is applied to the voltage supply line VSL is required to be at least after time t4 at which 6.5 V is applied to the reference line REF. In FIG. 23, this means that a timing at which the transistor T1 (M) is shifted from an on state to an off state is made slightly later than time t4.

Since the transistor T1 is in an off state in the case L subsequently from the phase P1, the voltage supply line VSL and the internal node N1 are not electrically connected to each other. Thus, an applied voltage to the voltage supply line VSL does not influence the potential VN1 (L) of the internal node N1.

When the above description is summarized, in the phase P2, a refresh action is executed to the pixel circuit in which the potential of the internal node N1 is the refresh isolation voltage or more and the refresh target voltage or less. In this case, since the refresh isolation voltage and the refresh target voltage are set to 4.5 V (=6.5−2 V) and 5 V, respectively, a refresh action to set the potential VN1 to 5 V is performed only to a pixel circuit in which the potential VN1 of the internal node N1 is 4.5 V or more and 5 V or less, i.e., in only the case H.

After the refresh action in the case H, voltage application to the boost line BST is stopped (at time t6), and a high voltage (in this case, 10 V) is applied to reference line REF to turn on the transistor T2 in each of the cases H, M, and L (at time t7). The voltage application to the voltage supply line VSL is stopped (at time t8). The order of times t6 to t8 is not limited to the above order, and the operations may be executed at the same time.

<<Step S2>>

After time t8, the step shifts to the standby step S2 in which the voltage state is maintained as it is (from times t8 to t9). At this time, since a high voltage is applied to the reference line REF, the potentials of the nodes N1 and N2 are equal to each other in each case H, M, and L. The standby step S2 is assured for a time sufficiently longer than that of the reference step S1 as in the second embodiment.

Figure 23:
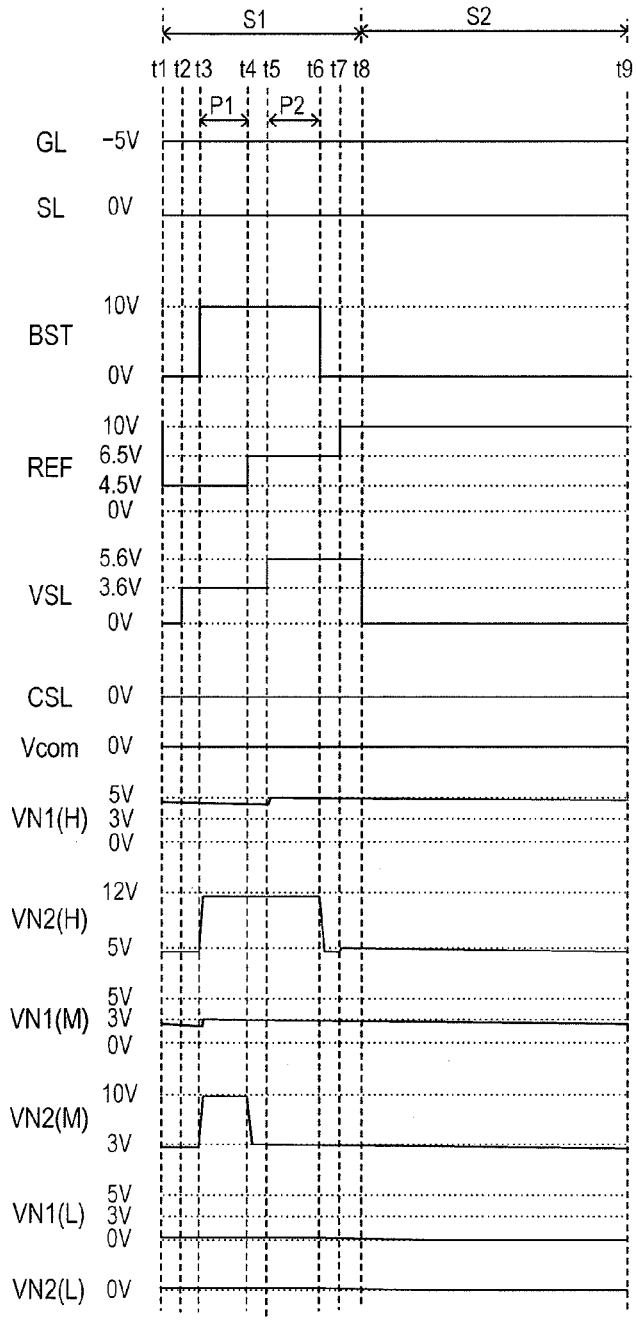
FIG. 23 is a timing chart of a self-refresh action of the third embodiment performed by the pixel circuit of the first type.

As described above, according to the self-refresh action of the embodiment shown in FIG. 23, in comparison with the case of the second embodiment shown in FIG. 18, the number of times of a variation in voltage to the boost line BST can be suppressed, and a power consumption can be further reduced. The above description can be applied to not only the pixel circuit 2A in FIG. 7, but also a modified pixel circuit shown in FIG. 8 as a matter of course.

In the second embodiment, the order of the refresh actions in the case H and the case M can be reversed. However, in the embodiment in which the number of times of a variation in voltage to the boost line BST is one, the refresh action in the case H must be performed after the refresh action of the case M, and the order cannot be reversed. This is because, since the potential of the node N2 in the case M is not raised when 10 V is applied to the boost line BST to execute the refresh action of the case H first, the variation in voltage of the boost line BST must be caused again to execute the refresh action in the case M.

In the embodiment, immediately before time t1, and in the standby step S2, 10 V (voltage that turns on the transistor T2 regardless of the cases H, M, and L) is applied to the reference line REF. However, as described in the second embodiment, 0 V may be applied to the reference line REF to turn off the transistor T2. However, the voltage application as described in the embodiment is performed to make it possible to suppress a variation of the applied voltage to the reference line REF.

<Second Type>

Figure 24:
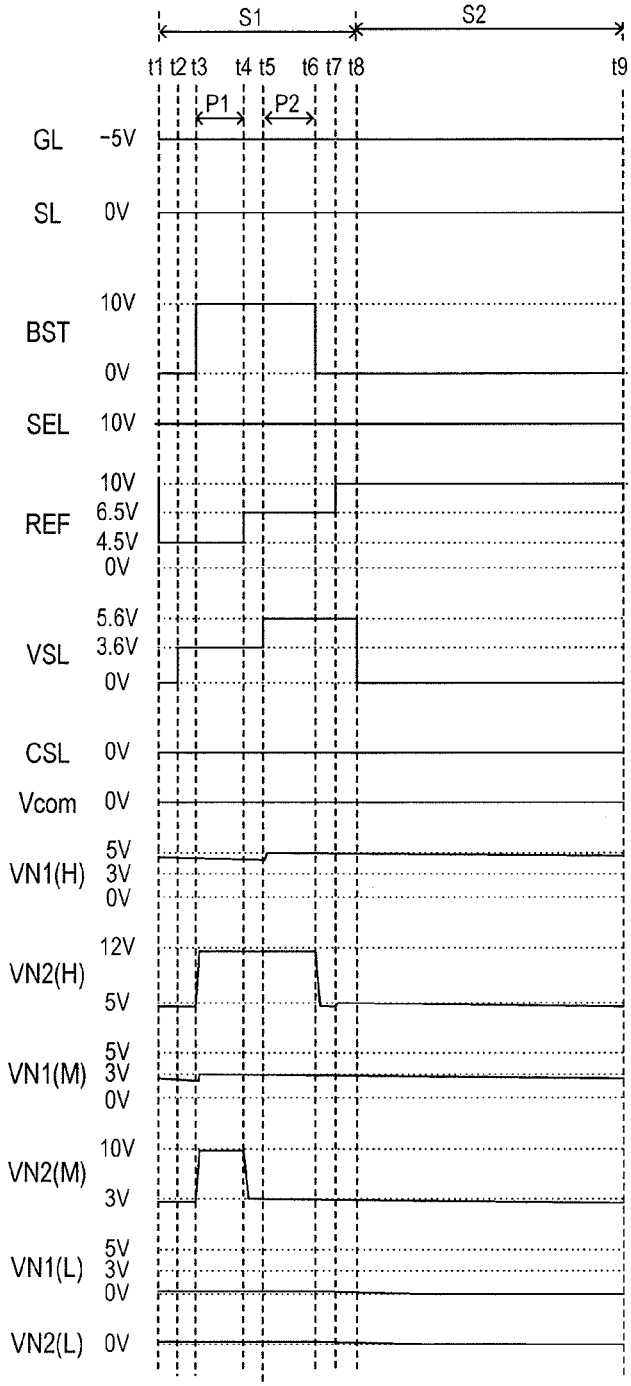
FIG. 24 is a timing chart of a self-refresh action of the third embodiment performed by the pixel circuit of the second type.

Although the pixel circuit 2B of the second type shown in FIG. 9 includes the transistor T4, the selecting line SEL to control the conducting state of the transistor T4 is arranged independently of the boost line BST. Thus, when a voltage is applied to the selecting line SEL to always turn on the transistor T4 during the refresh step S1, the same voltage state as that in the first type can be realized. A timing chart in this case is shown in FIG. 24. An applied voltage to the selecting line SEL is set to 10 V.

Figure 25:
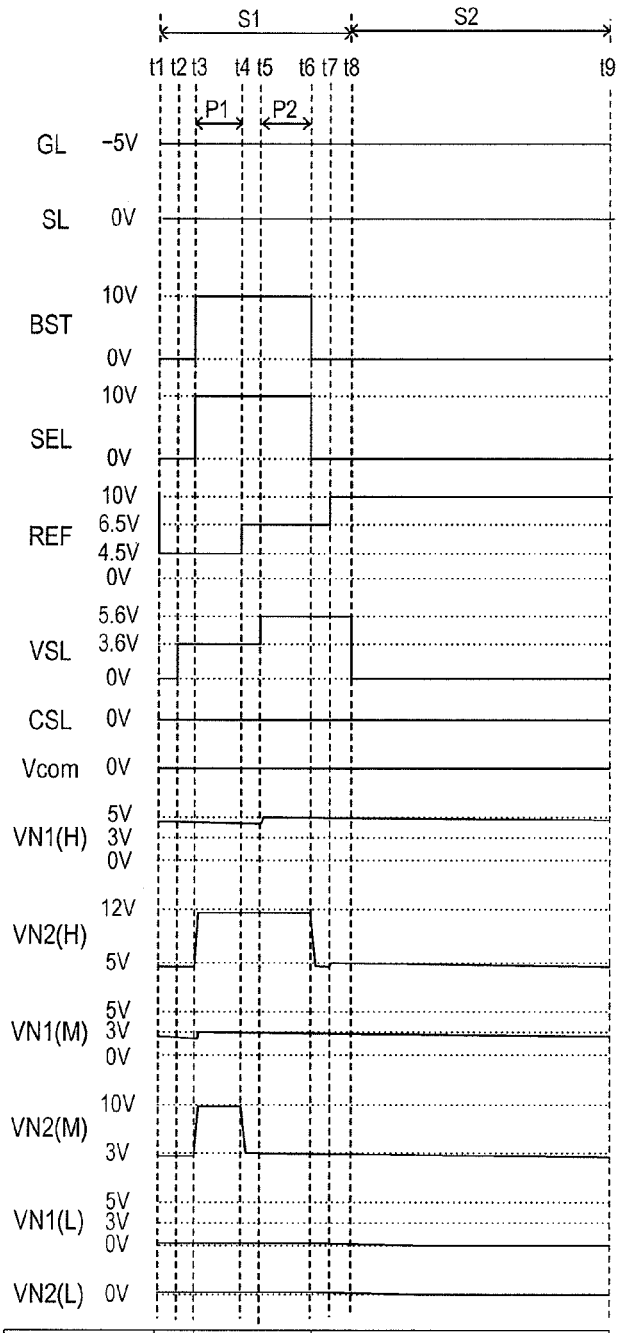
FIG. 25 is another timing chart of a self-refresh action of the third embodiment performed by the pixel circuit of the second type.

A pulse-like voltage may be applied to the selecting line SEL at the same timing as that at which a boost voltage is applied to the boost line BST. A timing chart obtained in this case is shown in FIG. 25.

The above description can be applied to not only the pixel circuit 2B in FIG. 9, but also pixel circuits 2B shown in FIG. 10 to FIG. 11 and the pixel circuits 2C shown in FIG. 12 to FIG. 15 as a matter of course. A detailed description thereof will be omitted.

<Third Type>

Each of the pixel circuits 2D and 2E belonging to the third type has a configuration in which, for each of the pixel circuits belonging to the second type, a connection destination of the control terminal of the transistor T4 is changed into the boost line BST and the selecting line SEL is not provided. Thus, unlike in the pixel circuit of the second type, turn-on/off control of the transistor T4 depends on the boost line BST.

However, as shown in FIG. 25, in the second type, also when a pulse voltage is applied to the selecting line SEL at the same timing as that of the boost line BST, the same voltage state as that of each of the pixel circuits of the first type can be realized. This means that the same voltage state can be realized by also connecting the control terminal of the transistor T4 to the boost line BST.

Thus, when the same voltage state as that in FIG. 25 is set, a self-refresh action can also be executed to the pixel circuit 2D in FIG. 16. This is also applied to the pixel circuit 2E in FIG. 17. A detailed description thereof will be omitted.

[Fourth Embodiment]

In the fourth embodiment, a writing action in an always-on display mode will be described with reference to the accompanying drawings.

In the writing action in the always-on display mode, pixel data of one frame is divided in units of display lines in a horizontal direction (row direction), and a voltage corresponding to each pixel data of one display line is applied to the source line SL of each column for each horizontal period. Also in this case, as in the second embodiment, three-gradation-level pixel data is supposed. The writing action is performed from the source line SL through the first switch circuit 22. Thus, to the source line SL, a high-level voltage (5 V), an intermediate-level voltage (3 V), or a low-level voltage (0 V) is applied. A selected row voltage of 8 V is applied to the gate line GL of a selected display line (selected row) to turn on the first switch circuits 22 of all the pixel circuits 2 of the selected row, and a voltage of the source line SL of each column is transferred to the internal node N1 of each of the pixel circuits 2 of the selected row.

A non-selected row voltage of −5 V is applied to the gate lines GL of display lines (non-selected rows) except for the selected display line to turn off the first switch circuits 22 of all the pixel circuits 2 of the non-selected rows. Timing control of a voltage application of each signal line in a writing action (will be described later) is performed by the display control circuit 11, and each voltage application is performed by the display control circuit 11, the counter electrode drive circuit 12, the source driver 13, and the gate driver 14.

<First Type>

A pixel circuit, belonging to the first type, in which the second switch circuit 23 is configured by a series circuit of only the transistor T1 and the diode D1 will be described below.

Figure 26:
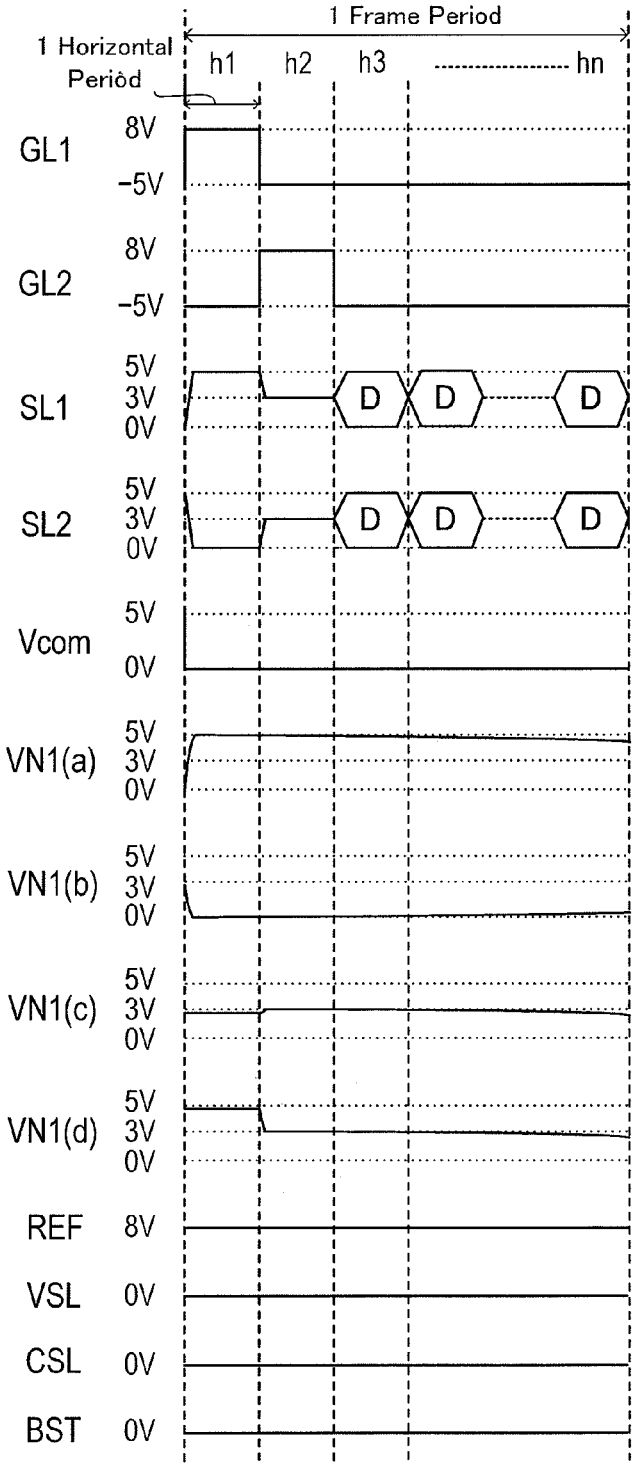
FIG. 26 is a timing chart of a writing action in an always-on display mode performed by the pixel circuit of the first type.

FIG. 26 is a timing chart of a writing action using the pixel circuit 2A (FIG. 7) of the first type. FIG. 26 shows voltage waveforms of two gate lines GL1 and GL2, two source lines SL1 and SL2, the reference line REF, the auxiliary capacitive line CSL, the voltage supply line VSL, and the boost line BST in a 1-frame period and a voltage waveform of the counter voltage Vcom.

Furthermore, in FIG. 26, voltage waveforms of the potentials VN1 of the internal nodes N1 of the four pixel circuits 2A are additionally shown. The four pixel circuits 2A are a pixel circuit 2A(a) selected by a gate line GL1 and a source line SL1, a pixel circuit 2A(b) selected by the gate line GL1 and a source line SL2, a pixel circuit 2A(c) selected by a gate line GL2 and the source line SL1, and a pixel circuit 2A(d) selected by the gate line GL2 and the source line SL2, respectively. In the drawing, the circuits are discriminated from each other by adding (a) to (d) to the ends of the internal node potentials VN1, respectively.

A 1-frame period is divided into horizontal periods the number of which is the number of gate lines GL, and gate lines GL1 to GLn to be selected are sequentially allocated to the horizontal periods, respectively. FIG. 26 shows changes in voltage of the two gate lines GL1 and GL2 in first two horizontal periods. In the first horizontal period, a selected-row voltage of 8 V is applied to the gate line GL1, and a non-selected row voltage of −5 V is applied to the gate line GL2. In the second horizontal period, the selected-row voltage of 8 V is applied to the gate line GL2, and the non-selected row voltage of −5 V is applied to the gate line GL1. In the subsequent horizontal periods, the non-selected row voltage of −5 V is applied to both the gate lines GL1 and GL2.

A voltage (5 V, 3 V, 0 V) corresponding to pixel data of a display line corresponding to each horizontal period is applied to the source line SL of each column. In FIG. 26, the two source lines SL1 and SL2 are shown as typical source lines SL. In FIG. 26, in order to explain a change of the potential VN1 of the internal node N1, voltages of the two source lines SL1 and SL2 in the first two horizontal periods are shown to be classified in 5 V, 3 V, and 0 V. Thereafter, a ternary voltage corresponding to pixel data is applied. In FIG. 26, in order to show that a voltage value depends on data, "D" is displayed.

In FIG. 26, as an example, in a first horizontal period h1, a high-level voltage and a low-level voltage are written in the pixel circuit 2A(a) and the pixel circuit 2A(b), respectively. Furthermore, in a second horizontal period h2, intermediate-level voltages are written in the pixel circuits 2A(c) and 2A(d), respectively.

In the following description, as an example, as the pixel circuits 2A(a) to 2A(d) at a point of time immediately before a writing action, the pixel circuit 2A(a) in which writing is performed at about 0 V (low-voltage state), the pixel circuits 2A(b) and 2A(c) in each of which writing is performed at about 3 V (intermediate-voltage state), and the pixel circuit 2A(d) in which writing is performed at about 5 V (high-voltage state) are used. The "about" mentioned here is a description given in consideration of a variation in potential with time caused by a leakage current or the like.

More specifically, it is assumed that, by the writing action of the embodiment, writing is performed from 0 V to 5 V in the pixel circuit 2A(a), writing is performed from 3 V to 0 V in the pixel circuit 2A(b), writing is performed at 3 V in the pixel circuit 2A(c), and writing is performed from 5 V to 3 V in the pixel circuit 2A(d).

During a period (during a 1-frame period) of a writing action, a voltage that sets the transistor T2 in an always-on state regardless of the voltage state of the internal node N1 is applied to the reference line REF. The voltage is set to 8 V. The voltage may be a value larger than a value obtained by adding a threshold voltage (2 V) of the transistor T2 to the potential VN1 (5 V) of the internal node N1 written in a high-voltage state. In this manner, the output node N2 and the internal node N1 are electrically connected, and auxiliary capacitor element Cs connected to the internal node N1 can be used to stabilize the internal node potential VN1.

During the writing action period, since a boost rising action is not performed, a low-level voltage (0 V is set here) is applied to the boost line BST. Furthermore, the auxiliary capacitive line CSL is fixed to a predetermined fixed voltage (for example, 0 V). Although the counter voltage Vcom is subjected to the counter AC driving as described above, the counter voltage Vcom is fixed to any one of a high-level voltage (5 V) and the low-level voltage (0 V) in a1-frame period. In FIG. 26, the counter voltage Vcom is fixed to 0 V.

During the writing action period, 0 V is applied to the voltage supply line VSL. This has a purpose for which, regardless of the voltage state of the internal node N1, a voltage potential equal to or larger than the turn-on voltage Vdn is prevented from being generated in a direction from voltage supply line VSL to the internal node N1 between both the ends of the diode D1 to reliably turn off the second switch circuit 23. Naturally, a negative voltage may be applied to the voltage supply line VSL.

In the first horizontal period h1, a selected-row voltage is applied to the gate line GL1, and a voltage depending on pixel data is applied to each of the source lines SL. In the pixel circuits having the control terminals of the transistors T3 connected to the gate line GL1, 5 V is written in the pixel circuit 2A(a), and 0 V is written in the pixel circuit 2A(b). For this reason, 5 V is applied to the source line SL1, and 0 V is applied to the source line SL2. Voltages depending on pixel data are also applied to the other source lines.

In the first horizontal period h1, in each of the pixel circuits 2A(a) and 2A(b), the transistor T3 is turned on. For this reason, an applied voltage to the source line SL is written in the internal node N1 through the transistor T3.

On the other hand, in the first horizontal period h1, in the pixel circuit having the control terminal of the transistor T3 connected to the gate line GL except for the gate line GL1, since the transistor T3 is in an off state, the applied voltage to the source line SL is not given to the internal node N1 through the first switch circuit 22.

Here, attention is focused on the pixel circuit 2A(c) selected by the gate line GL2 and the source line SL1. Since the pixel circuit 2A(c) has the control terminal of the transistor T3 connected to the gate line GL2, as described above, the transistor T3 is in an off state, and the applied voltage (5 V) to the source line SL1 is not written in the internal node N1 through the first switch circuit 22.

Immediately before the writing action, the potential VN1 (*c*) of the internal node N1 exhibits about 3 V, and 0 V is applied to the voltage supply line VSL. For this reason, the diode D1 is set to a reverse bias state. Thus, since the second switch circuit 23 is turned off, an applied voltage to the voltage supply line VSL is not also written in the internal node N1.

Thus, in the first horizontal period h1, the VN1(*c*) still holds a potential immediately before the writing action.

Next, attention is focused on the pixel circuit 2A(d) selected by the gate line GL2 and the source line SL2. Since the pixel circuit 2A(d) also has the control terminal of the transistor T3 connected to the gate line GL2, as in the pixel circuit 2A(c), the transistor T3 is in an off state. Thus, the applied voltage (0 V) to the source line SL2 is not given to the internal node N1 through the first switch circuit 22.

Immediately before the writing action, the potential VN1 (*d*) of the internal node N1 exhibits about 5 V, and a reverse-bias voltage is applied to the diode D1 as in the pixel circuit 2A(c). Thus, the applied voltage (0 V) to the voltage supply line VSL is not given to the internal node N1 through the second switch circuit 23.

Thus, in the first horizontal period h1, the VN1(*d*) still holds a potential immediately before the writing action.

On the other hand, in the second horizontal period h2, in order to write 3 V in the pixel circuits 2A(c) and 2A(d), a selected-row voltage is applied to the gate line GL2, and a non-selected row voltage is applied to the other gate lines GL each, 3 V is applied to the source lines SL1 and SL2 each, and voltages depending on pixel data of the pixel circuits selected by the gate line GL2 are also applied to the other source lines SL. In each of the pixel circuits 2A(c) and 2A(d), the applied voltage to the source line SL is given to the internal node N1 through the first switch circuit 22.

In the second horizontal period h2, in each of the pixel circuits 2A(a) and 2A(b), the first switch circuit 22 is in an off state. For this reason, an applied voltage to the source line SL is not written in the internal node N1.

In this case, in the pixel circuit 2A(a), since the internal node N1 has 5 V, the diode D1 is set to a reverse bias state, and the second switch circuit 23 is turned off. On the other hand, in the pixel circuit 2A(b), the potential VN1 of the internal node N1 and the applied voltage to the voltage supply line VSL are 0 V each. However, in consideration of the turn-on voltage Vdn of the diode D1, the diode D1 is not turned on from the voltage supply line VSL to the internal node N1. Furthermore, since the transistor T1 is turned off, the second switch circuit 23 is still turned off.

Thus, in the second horizontal period h1, the values of the VN1(*a*) and the VN1(*b*) do not vary, and the written voltage level is kept.

With the voltage application, for a selected pixel circuit, a voltage depending on pixel data is given from the source line SL to the internal node N1 through the first switch circuit 22.

The above embodiment is described on the assumption that each of the pixel circuits is the pixel circuit 2A shown in FIG. 7. However, even in the pixel circuits 2A shown in FIG. 8 and FIG. 9, the same writing action can be realized as a matter of course.

<Second Type>

A pixel circuit, belonging to the second type, in which the second switch circuit 23 is configured by the series circuit of the transistor T1, the diode D1, and the transistor T4, and the control terminal of the transistor T4 is connected to the selecting line SEL will be described below.

In the second type, the pixel circuit 2B (FIG. 9 to FIG. 11) in which the first switch circuit 22 configured by only the transistor T3 and the pixel circuit 2C (FIG. 12 to FIG. 15) in which the first switch circuit 22 is configured by a series circuit of the transistors T3 and T4 (or T5) are supposed as described above.

Figure 27:
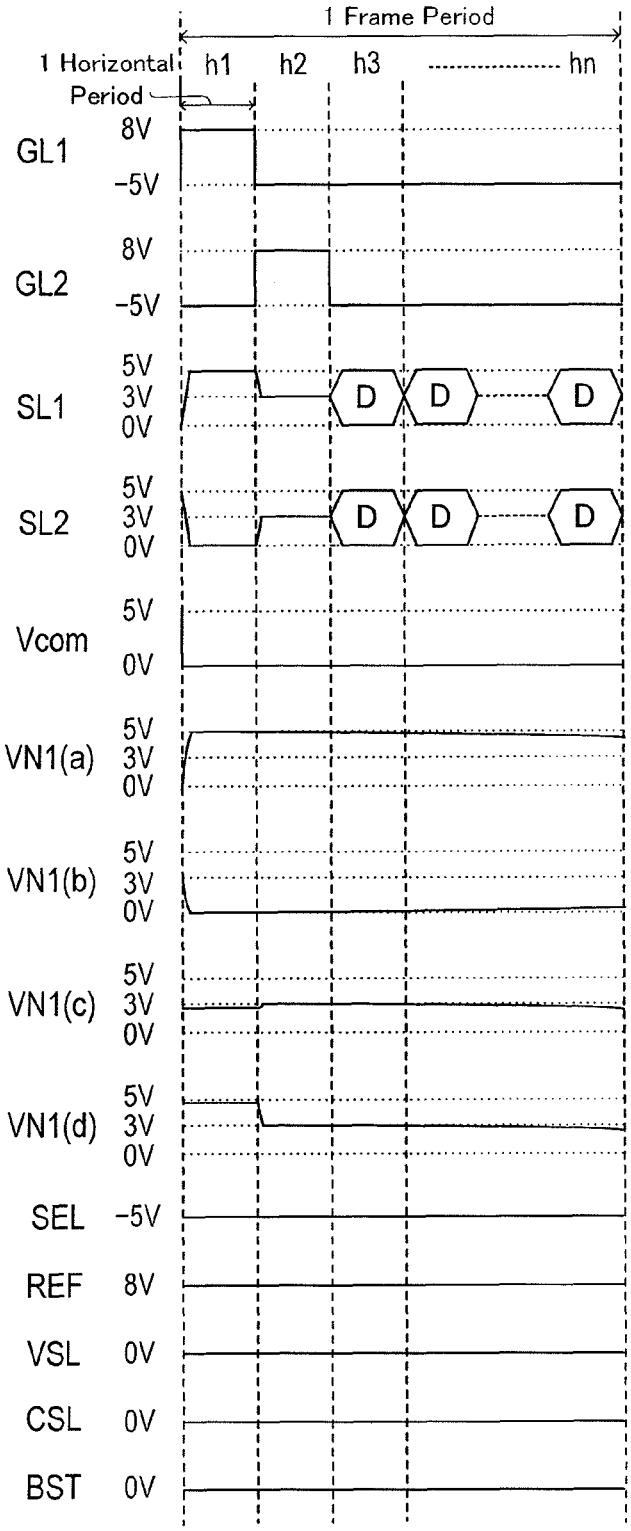
FIG. 27 is a timing chart of a writing action in an always-on display mode performed by the pixel circuit of the second type.

As described above in the first type, in the writing action, the second switch circuit 23 is turned off, and a voltage is applied from the source line SL to the internal node N1 through the first switch circuit 22. In the pixel circuit 2B, the transistor T4 is always set to an off state to make it possible to reliably turn off the second switch circuit 23 in the writing action. With respect to the other points, the writing action can be realized by the same method as described in the first type. FIG. 27 is a timing chart of a writing action using the pixel circuit 2B (FIG. 9) of the second type. In FIG. 27, in order to turn off the transistor T4 during the writing action, −5 V is applied to the selecting line SEL.

On the other hand, as shown in FIG. 12 to FIG. 15, when the first switch circuit 22 is configured by a series circuit of the transistors T3 and T4 (or T5), in the writing action, in order to turn on the first switch circuit 22, not only the transistor T3 but also the transistor T4 (or T5) must be turned on. Although the first switch circuit 22 includes the transistor T5 in the pixel circuit 2C shown in FIG. 15, since the transistor T5 has the control terminal connected to the control terminal of the transistor T4, turn-on/off control of the transistor 4 is performed as in the other pixel circuit 2C to perform turn-on/off control of the first switch circuit 22.

Based on the above circumstances, in the pixel circuit 2C, all the selecting lines SEL are not controlled in a lump unlike in the pixel circuit 2B, and like the gate lines GL, the selecting lines SEL must be independently controlled in units of rows. More specifically, the selecting lines SEL the number of which is the same as the number of gate lines GL1 to GLn are arranged in units of rows one by one, and the selecting lines SEL are sequentially selected like the gate lines GL1 to GLn.

Figure 28:
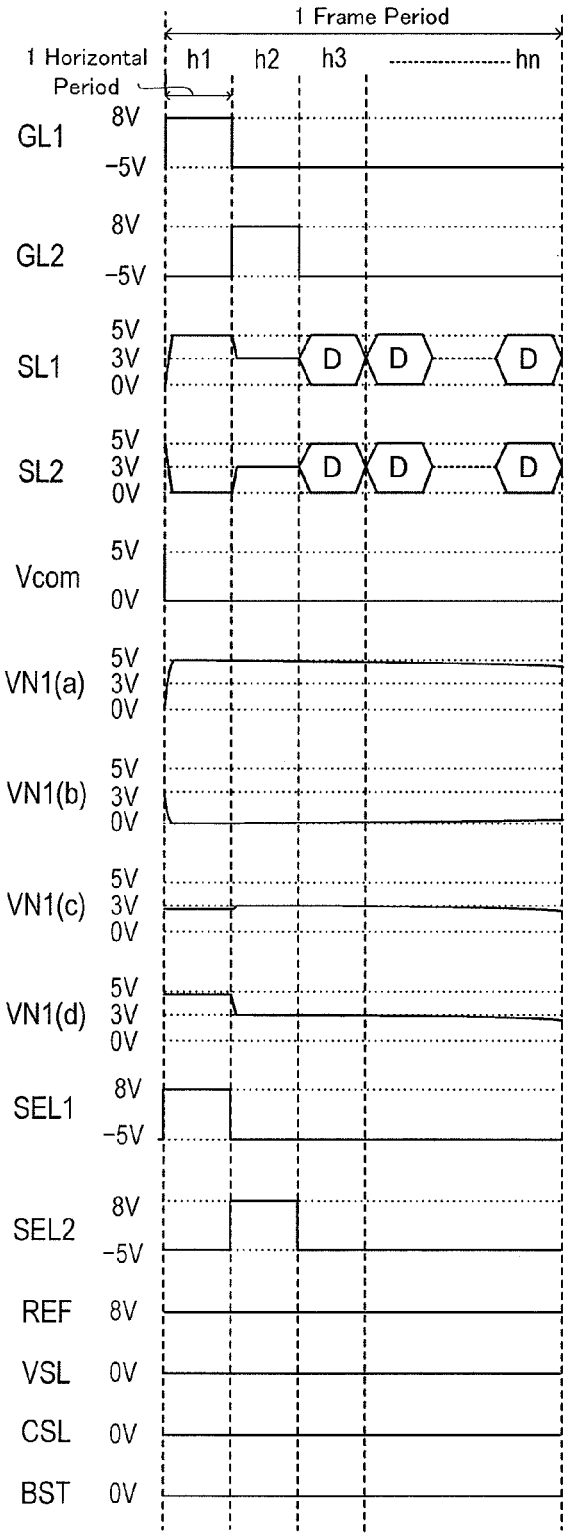
FIG. 28 is a timing chart of a writing action in an always-on display mode performed by the pixel circuit of the second type.

FIG. 28 shows a timing chart of a writing action using the pixel circuit 2C (FIG. 12) of the second type. FIG. 28 shows changes in voltage of the two selecting lines SEL1 and SEL2 in first two horizontal periods. In the first horizontal period, a selecting voltage of 8 V is applied to the selecting line SEL1, and a non-selecting voltage of −5 V is applied to the selecting line SEL2. In the second horizontal period, the selecting voltage of 8 V is applied to the selecting line SEL2, and the non-selecting voltage of −5 V is applied to the selecting line SELL. In the subsequent horizontal periods, the non-selecting voltage of −5 V is applied to both the selecting lines SEL1 and SEL2. The other points are the same as those in the timing chart of the writing action of the pixel circuit 2A of the first type shown in FIG. 26. In this manner, the same voltage state as that of the pixel circuit 2A of the first type shown in FIG. 26 can be realized. A detailed description thereof will be omitted.

<Third Type>

A pixel circuit, belonging to the third type, in which the second switch circuit 23 is configured by a series circuit of the transistor T1, the diode D1, and the transistor T4, and the control terminal of the transistor T4 is connected to the boost line BST will be described below.

Figure 29:
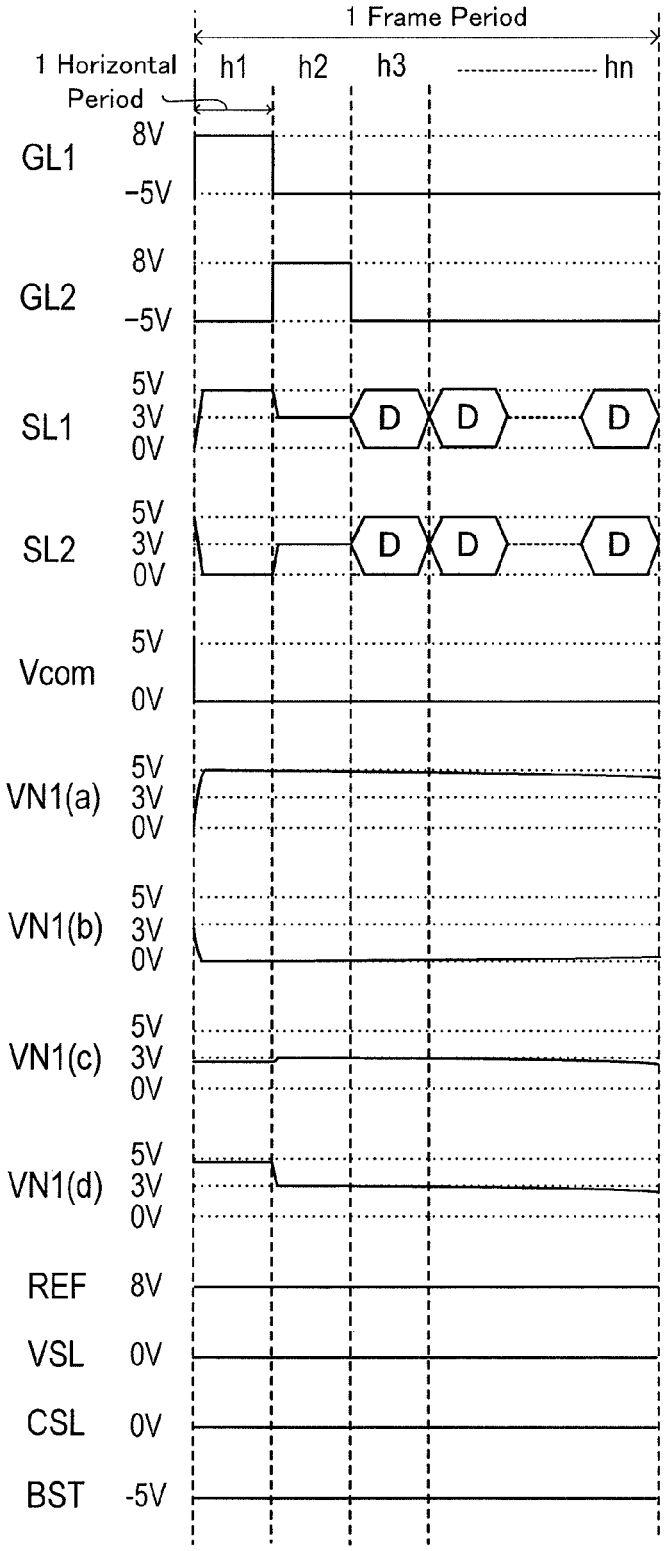
FIG. 29 is a timing chart of a writing action in an always-on display mode performed by the pixel circuit of the third type.

The pixel circuit of the third type is different from the pixel circuit of the second type in only that no selecting line SEL is arranged and the boost line BST is connected to the control terminal of the transistor T4. Thus, a voltage may be applied to the boost line BST by the same method as the method that applies a voltage to the selecting line SEL in the second type. FIG. 29 is a timing chart of a writing action using the pixel circuit 2D (FIG. 16) of the third type.

At this time, 8 V is applied to the reference line REF, and the transistor T2 is always in an on state. For this reason, even though an applied voltage to the boost line BST increases, the potential VN2 of the output node N2 rarely increases, and the transistor T1 is not turned on.

[Fifth Embodiment]

In the fifth embodiment, a relationship between a self-refresh action and a writing action in an always-on display mode will be described.

In the always-on display mode, after a writing action is executed to image data of one frame, display contents obtained by the immediately previous writing action are maintained without performing the writing action in a predetermined period.

By the writing action, a voltage is given to the internal node N1 (pixel electrode 20) in each pixel through the source line SL. Thereafter, the gate line GL is set at a low level, and the transistor T3 is turned off. However, the potential VN1 of the internal node N1 is kept by the presence of charges accumulated in the pixel electrode 20 by the immediately previous writing action. More specifically, a voltage Vlc is maintained between the pixel electrode 20 and the counter electrode 80. In this manner, even after the writing action is completed, a state in which a voltage required to display image data is applied across both the terminals of the liquid crystal capacity Clc continues.

When a potential of the counter electrode 80 is fixed, the liquid crystal voltage Vlc depends on the potential of the pixel electrode 20. The potential varies with time in association with generation of a leakage current of a transistor in the pixel circuit 2. For example, when a potential of the source line SL is lower than a potential of the internal node N1, a leakage current flowing from the internal node N1 to the source line SL is generated, and the potential VN1 of the internal node N1 decreases with time. In contrast to this, when the potential of the source line SL is higher than the potential of the internal node N1 (in particular, writing is performed in a low-voltage state), a leakage current flowing from the source line SL to the internal node N1 is generated, the VN1 increases with time. More specifically, when time has elapsed without performing an external writing action, the liquid crystal voltage Vlc gradually changes. As a result, a displayed image also changes.

In a normal display mode, a writing action is executed to all the pixel circuits 2 in units of frames even in a still image. Therefore, electric charges accumulated in the pixel electrode 20 need only be maintained in a one-frame period. Since a variation in potential of the pixel electrode 20 in a 1-frame period at most is very small, the variation in potential meanwhile does not give an influence that is enough to be visually confirmed to image data to be displayed. For this reason, in the normal display mode, the variation in potential of the pixel electrode 20 does not cause a serious problem.

In contrast to this, in the always-on display mode, a writing action is not configured to be executed for each frame. Therefore, while the potential of the counter electrode 80 is fixed, the potential of the pixel electrode 20 needs to be kept for several frames depending on the circumstances. However, when the pixel circuit is left without performing a writing action for several frame periods, a potential of the pixel electrode 20 intermittently varies due to generation of the leakage current described above. As a result, image data to be displayed may be changed enough to be visually confirmed.

Figure 30:
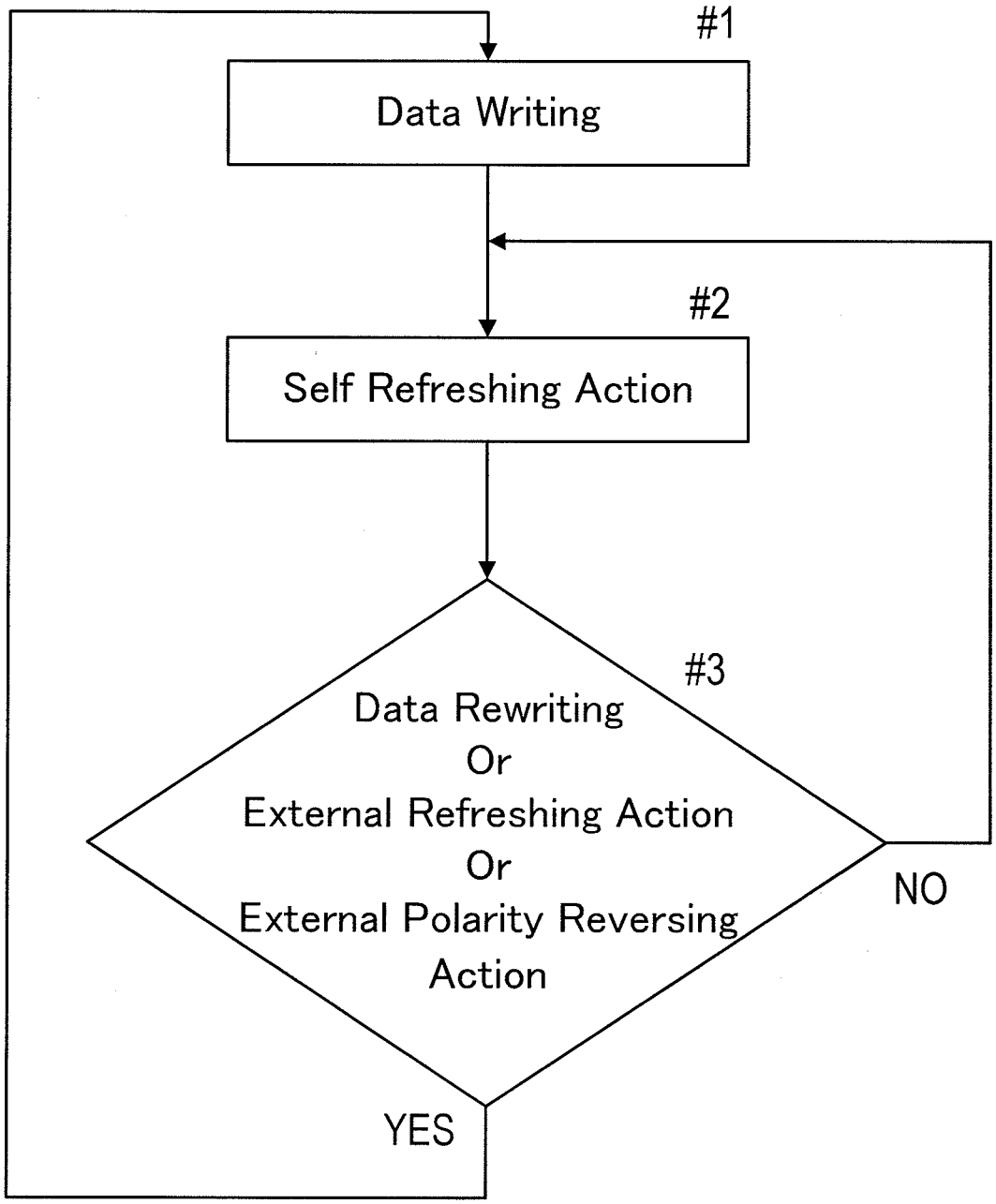
FIG. 30 is a flow chart showing procedures of the writing action and a self-refresh action in the always-on display mode.

In order to avoid the phenomenon, in the always-on display mode, by the manner shown in the flow chart in FIG. 30, the self-polarity-inverting action and the writing action are executed in combination with each other to considerably reduce a power consumption while suppressing a variation in potential of the pixel electrode.

A writing action of pixel data of one frame in the always-on display mode is executed by the manner described in the above fourth embodiment (step #1).

After the writing action in step #1, a self-refresh action is executed by the manner described in the above second embodiment (step #2). As described above, the self-refresh action includes the refresh step S1 and the standby step S2.

In this case, in a period of the standby step S2, when a request for a writing action (data writing) of new pixel data, an external refresh action, or an external polarity inverting action is received (YES in step #3), the control flow returns to step #1 to execute the writing action of the new pixel data or the previous pixel data. In the period of the standby step S2, when the request is not received (NO in step #3), the control flow returns to step #2 to execute the self-refresh action again. In this manner, a change of a display image by an influence of a leakage current can be suppressed.

When a refresh action is to be performed by a writing action without performing a self-refresh action, a power consumption expressed by the relational expression shown in numerical expression 1 described above is obtained. On the other hand, when the self-refresh action is repeated at the same refresh rate, if each pixel circuit holds ternary pixel data, the number of times of voltage application to all the voltage supply line VSL is two as described above in the fourth embodiment. The voltage supply line VSL in the fourth embodiment corresponds to the source line SL in a writing state in the sense that a-voltage is supplied to the internal node N1. More specifically, when a variable n in numerical expression 1 becomes 2 and a display solution (the number of pixels) of VGA is supposed, m=1920 and n=480. For this reason, a power consumption is expected to be reduced to about 1/240 of it.

In the embodiment, the self-refresh action and the external refresh action or the external polarity inverting action are used in combination to cope with the following case. That is, even in the pixel circuit 2 that normally operates at first, the second switch circuit 23 or the control circuit 24 is defected by aging, although a writing action can be performed without a trouble, a self-refresh action cannot be normally executed in some pixel circuits 2. More specifically, when only the self-refresh action is performed, displays of the some pixel circuits 2 are deteriorated and the deterioration is fixed. However, by using the external polarity inverting action in combination with it, the display defect can be prevented from being fixed.

[Sixth Embodiment]

In the sixth embodiment, a writing action in a normal display mode will be described for each type with reference to the accompanying drawings.

In the writing action in the normal display mode, pixel data of one frame is divided in units of display lines in a horizontal direction (row direction), and a multi-tone analog voltage corresponding to each pixel data of one display line is applied to the source lines SL of each column for each horizontal period, and a selected-row voltage of 8 V is applied to the gate line GL of a selected display line (selected row) to turn on the first switch circuits 22 of all the pixel circuits 2 of the selected row, and a voltage of the source line SL of each column is transferred to the internal node N1 of each of the pixel circuits 2 of the selected row. A non-selected row voltage of −5 V is applied to the gate lines GL of display lines (non-selected rows) except for the selected display line to turn off the first switch circuits 22 of all the pixel circuits 2 of the selected row.

Unlike in the always-on display mode, in the writing action in the normal display mode, since the counter voltage Vcom varies (counter AC drive) every horizontal period, the auxiliary capacitive line CSL is driven to have the same voltage as the counter voltage Vcom. The pixel electrode 20 is capacitively coupled to the counter electrode 80 through a liquid crystal layer, and is also capacitively coupled to the auxiliary capacitive line CSL through the auxiliary capacitor element Cs. For this reason, if the voltage of the auxiliary capacitor element Cs is fixed, only the voltage Vcom varies in numerical expression 2, thereby inducing variations of the liquid crystal voltages Vlc of the pixel circuits 2 of a non-selected row. For this reason, all the auxiliary capacitive lines CSL are driven at the same voltage as that of the counter voltage Vcom to change the voltages of the counter electrode 80 and the pixel electrode 20 in the same voltage direction, thereby canceling the influence of the counter AC drive.

Figure 31:
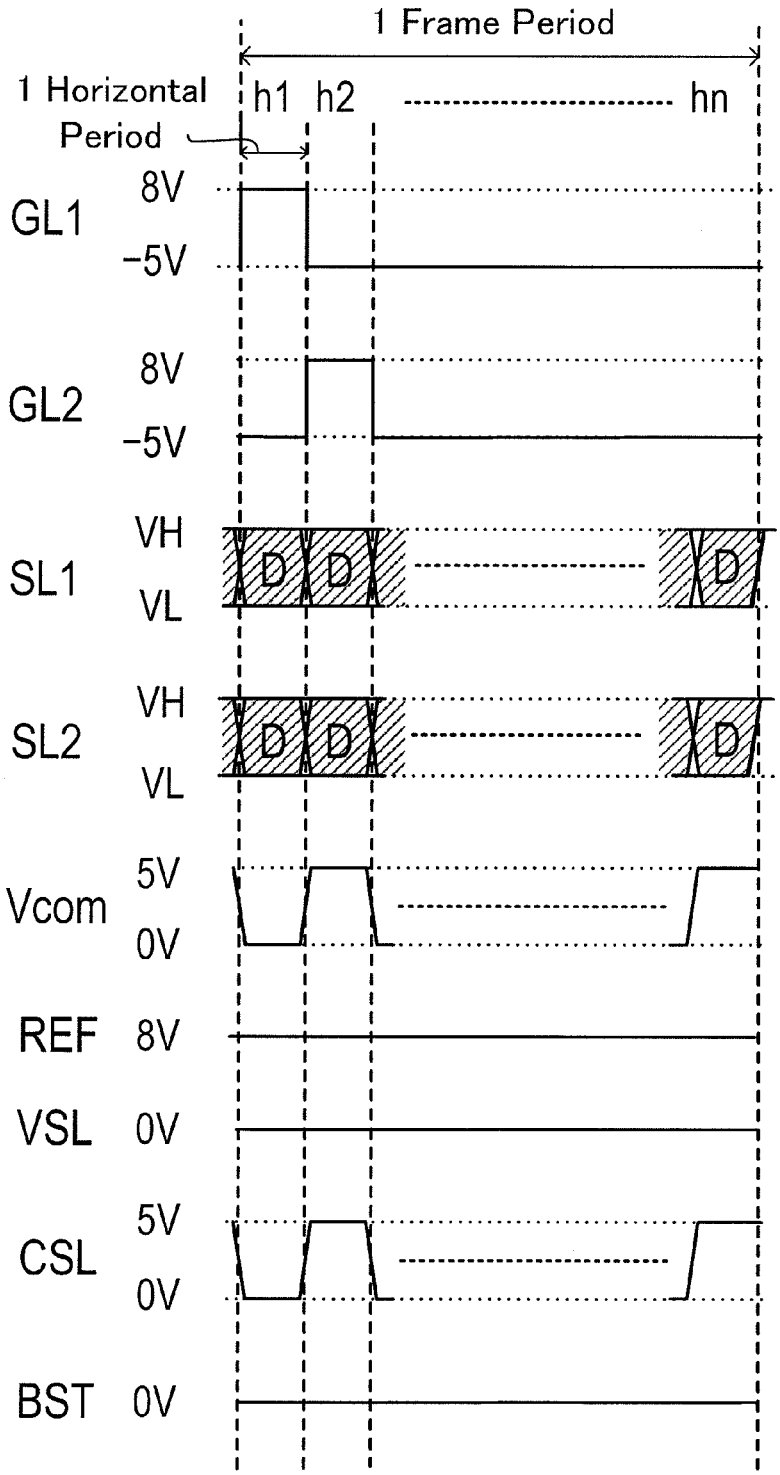
FIG. 31 is a timing chart of a writing action in a normal display mode performed by the pixel circuit of the first type.

Since the normal display mode performs an operation that is theoretically the same as that of the writing action in the always-on display mode except that counter AC drive is performed and an analog voltage the number of gradation levels of which is larger than the number of gradation levels in the always-on display mode is applied from the source line SL, a detailed description thereof will be omitted. FIG. 31 is a timing chart of a writing action in an always-on display mode performed to the pixel circuit 2A (FIG. 7) of the first type. In FIG. 31, since a multi-tone analog voltage corresponding to pixel data of an analog display line is applied to the source line SL, an applied voltage is not uniquely specified in the range from a minimum value VL to a maximum value VH. For this reason, this range is expressed by shaded portion in FIG. 31.

Figure 32:
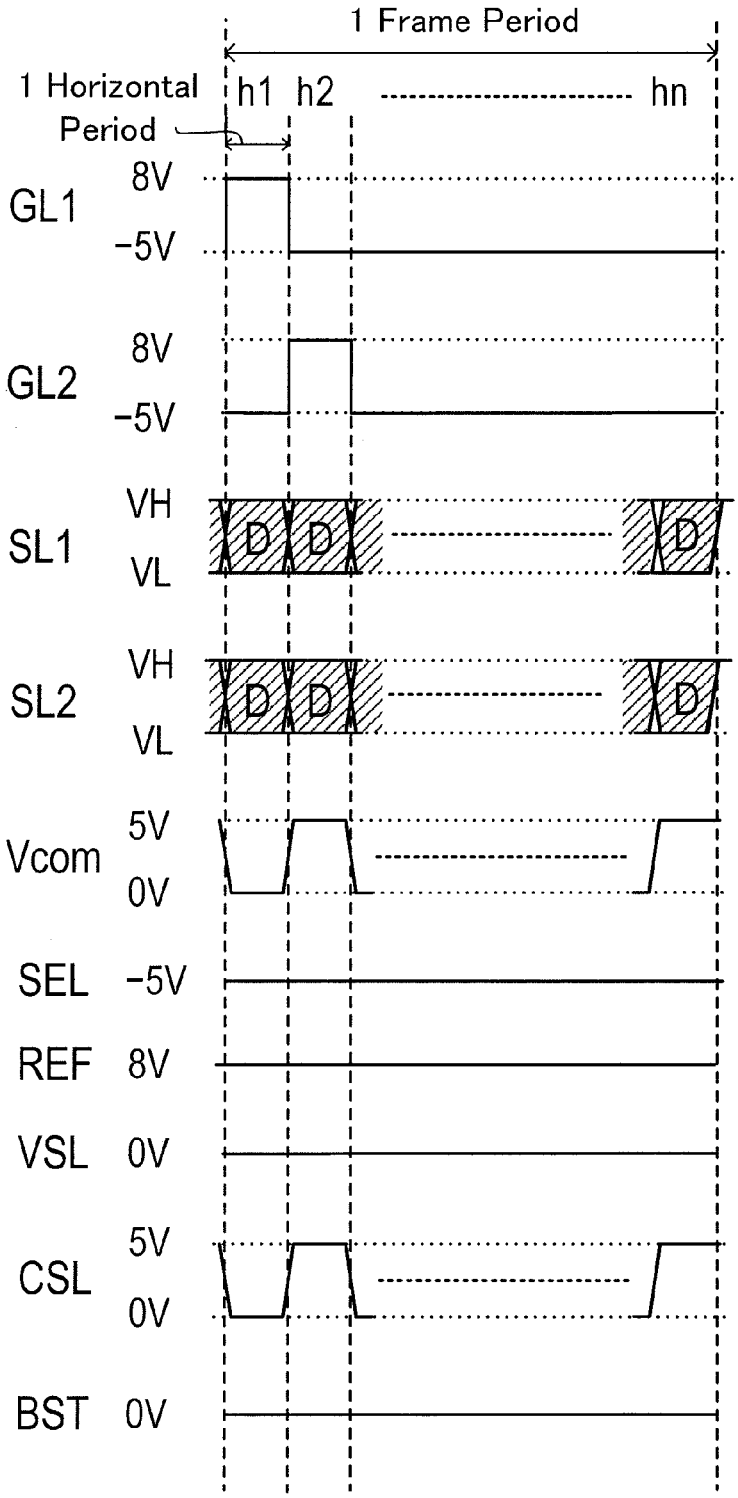
FIG. 32 is a timing chart of a writing action in a normal display mode performed by the pixel circuit of the second type.

Similarly, FIG. 32 shows a timing chart of a writing action using the pixel circuit 2C (FIG. 12) of the second type.

In the embodiment, in the writing action in the normal display mode, a method of inverting the polarity of each display line every horizontal period is employed. This method is employed to cancel a disadvantage (will be described later) occurring when polarity inversion is performed in units of frames. As the method of canceling the disadvantage, there are a method of performing polarity inversion drive for each column and a method of simultaneously performing polarity inversion drive in units of pixels in row and column directions.

It is assumed that the positive liquid crystal voltage Vlc is applied in all pixels in a certain frame F1 and the negative liquid crystal voltage Vlc is applied in all the pixels in the next frame F2. Even though the voltage having the same absolute value is applied to the liquid crystal layer 75, light transmittances may be slightly different from each other depending on the positive polarity or the negative polarity. When a high-quality still image is displayed, the presence of the slight difference may possibly cause small changes in display manners in the frame F1 and the frame F2. Even in a moving image display state, in a display area in which the same display contents should be displayed in the frames, the display manners may be possibly slightly changed. In display of a high-quality still image or moving image, it can be assumed that even the slight change can be visually recognized.

Since the normal display mode is a mode of displaying a high-quality still image or moving image, the above slight change may be possibly visually recognized. In order to avoid the phenomenon, in the embodiment, the polarity is inverted for each display line in the same frame. In this manner, since the liquid crystal voltages Vlc having polarities different between display lines in the same frame are applied, an influence on display image data based on the polarity of the liquid crystal voltage Vlc can be suppressed.

[Another Embodiment]

Another embodiment will be described below.

<1> In the embodiment described above, the always-on display mode targeted by a self-refresh action is explained as a mode having the number of display colors smaller than that of the normal display mode. However, when the number of gradation levels is increased to increase the number of display colors to a predetermined level, so that liquid crystal display may be realized by only the always-on display mode. In this case, although full-color display such as the normal display mode cannot be realized, display processing can be performed in only the always-on display mode of the present invention for a screen in which the required number of displayable colors is not very large.

When the number of gradation levels increases, the number of times of a pulse applied in a self-refresh action, i.e., the number of phases in the refresh step S1 also increases. The second embodiment can be realized by the 2 phases, i.e., the phases P1 and P2 in ternary pixel data. However, when the number of gradation levels increases to four, 3 phases are required, and, when the number of gradation levels increases to 5, 4 phases are required.

In the embodiment, as values of pixel data in the always-on display mode, 5 V, 3 V, and 0 V are employed. However, the values are not limited to the voltage values described above as a matter of course.

<2> With respect to the pixel circuit 2B (FIG. 9 to FIG. 11) of the second type, in writing actions in the normal display mode and the always-on display mode, a low-level voltage may be given to the reference line REF to set the transistor T2 in an off state. In this manner, when the internal node N1 and the output node N2 are electrically separated from each other, the potential of the pixel electrode 20 is not influenced by the voltage of the output node N2 obtained before the writing action. In this manner, the voltage of the pixel electrode 20 correctly reflects an application voltage to the source line SL, and the image data can be displayed without an error.

<3> The fourth embodiment is explained on the assumption that 0 V or a negative voltage is applied to the voltage supply line VSL in a writing action period. However, even though a positive voltage is applied, a writing action can be correctly executed.

For example, in the timing chart in FIG. 26, it is assumed that 5 V is applied to the voltage supply line VSL. At this time, in the one-horizontal period h1, writing is performed at 0 V in the pixel circuit 2A(b). For this reason, a potential VN2 of the node N2 becomes 0 V. Thus, the transistor T1 is turned off, and the second switch circuit 23 is not turned on. In the second horizontal period h2, also when 3 V is written in the pixel circuits 2A(c) and 2A(d), the second switch circuit 23 is not turned on for the same reason.

On the other hand, in the one-horizontal period h1, writing is performed at 5 V in the pixel circuit 2A(a). For this reason, a potential VN2 of the node N2 becomes 5 V. In consideration of a turn-on voltage of the diode D1, as in the pixel circuits 2A(b) to 2A(d), the transistor T1 is in an off state.

More specifically, in the writing action, even though any voltage is applied to the voltage supply line VSL, the second switch circuit 23 is not turned on. For this reason, the applied voltage does not influence the written data. The same as described above is applied to the writing action of the sixth embodiment.

<4> In the embodiment, the second switch circuits 23 and the control circuits 24 are arranged in each of all the pixel circuits 2 arranged on the active matrix substrate 10. In contrast to this, on the active matrix substrate 10, when pixel units of two types, i.e., a transmissive pixel unit that performs a transmissive liquid crystal display and a reflective pixel unit that performs a reflective liquid crystal display are provided, only pixel circuits of the reflective pixel unit may include the second switch circuits 23 and the control circuits 24, and pixel circuits of the transmissive display unit may not include the second switch circuits 23 and the control circuits 24.

In this case, an image display is performed by the transmissive pixel unit in the normal display mode, and an image display is performed by the reflective pixel unit in the always-on display mode. With the above configuration, the number of elements formed on the entire area of the active matrix substrate 10 can be reduced.

<5> In the embodiment, each of the pixel circuits 2 includes the auxiliary capacitor element Cs. However, the pixel circuit 2 need not include the auxiliary capacitor element Cs. However, in order to more stabilize the potential of the internal node N1 to reliably stabilize a display image, the auxiliary capacitor element Cs is preferably included.

Figure 33:
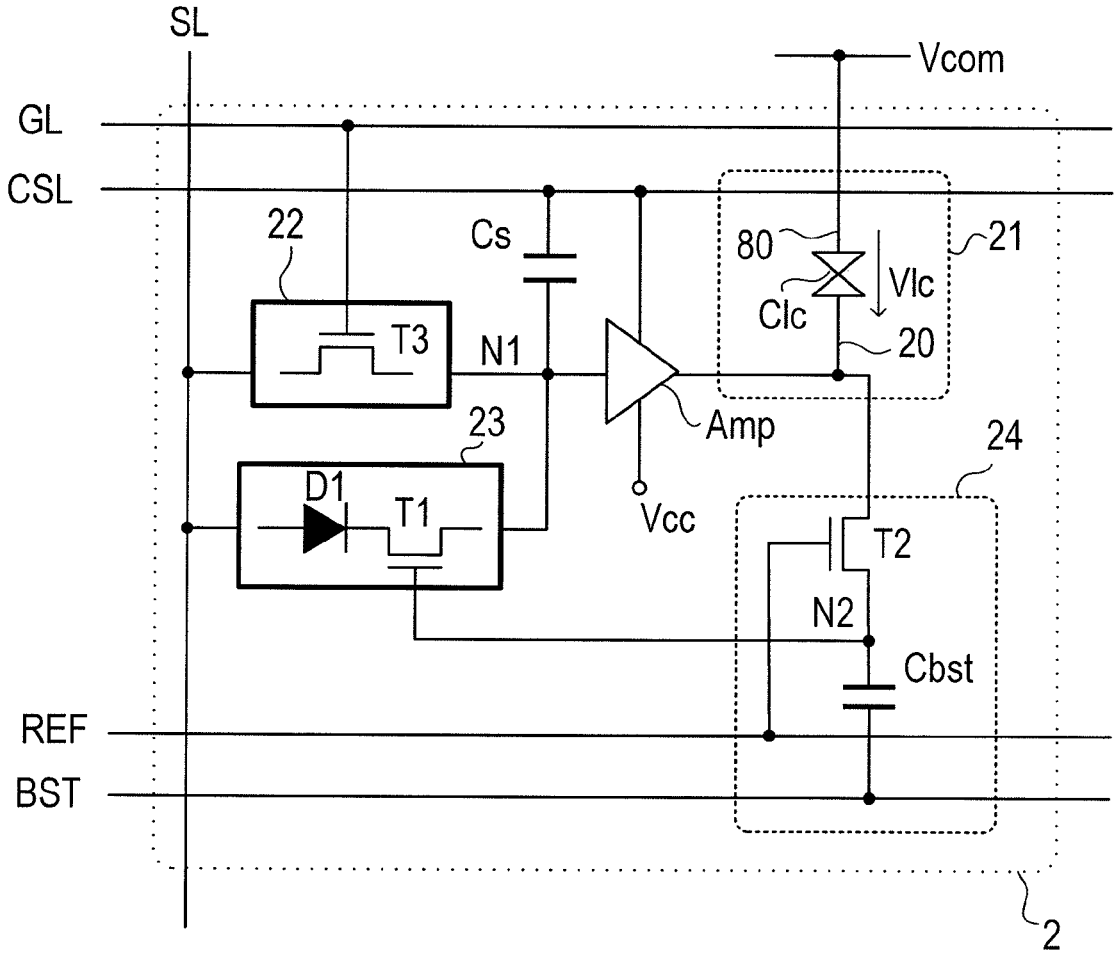
FIG. 33 is a circuit diagram showing still another basic circuit configuration of the pixel circuit of the present invention.

<6> In the embodiment, it is assumed that the display element unit 21 of each of the pixel circuits 2 is configured by only the unit liquid crystal display element Clc. However, as shown in FIG. 33, an analog amplifier Amp (voltage amplifier) may be arranged between the internal node N1 and the pixel electrode 20. In FIG. 33, as an example, as a power supply line for the analog amplifier Amp, the auxiliary capacitive line CSL and a power supply line Vcc are input.

In this case, a voltage given to the internal node N1 is amplified by a gain η set by the analog amplifier Amp, and the amplified voltage is supplied to the pixel electrode 20. Thus, in the configuration, a small voltage change at the internal node N1 can be reflected on a display image.

In the configuration, in the self-polarity-inverting action in the always-on display mode, the voltage of the internal node N1 is amplified by the gain η and supplied to the pixel electrode 20. For this reason, a voltage difference between the first and second voltage states applied to the source line SL is adjusted to make it possible to make the voltages in the first and second voltage states supplied to the pixel electrode 20 equal to the high-level and low-level voltages of the counter voltage Vcom.

<7> In the embodiment, the transistors T1 to T4 in the pixel circuit 2 are supposed to be n-channel polycrystalline silicon TFTs. However, a configuration using p-channel TFTs or a configuration using amorphous silicon TFTs can also be used. In this case, the pixel circuit 2 can be operated by the same manner as that in each of the embodiments by inverting the magnitude relations of the voltages, a rectifying direction of the diode D1, or the like, and the same effect as described above can be obtained.

<8> In the embodiments, the liquid crystal display device is exemplified. However, the present invention is not limited to the embodiments. The present invention can be applied to any display device that has a capacity corresponding to the pixel capacity Cp to hold pixel data and displays an image based on a voltage held in the capacity.

Figure 34:
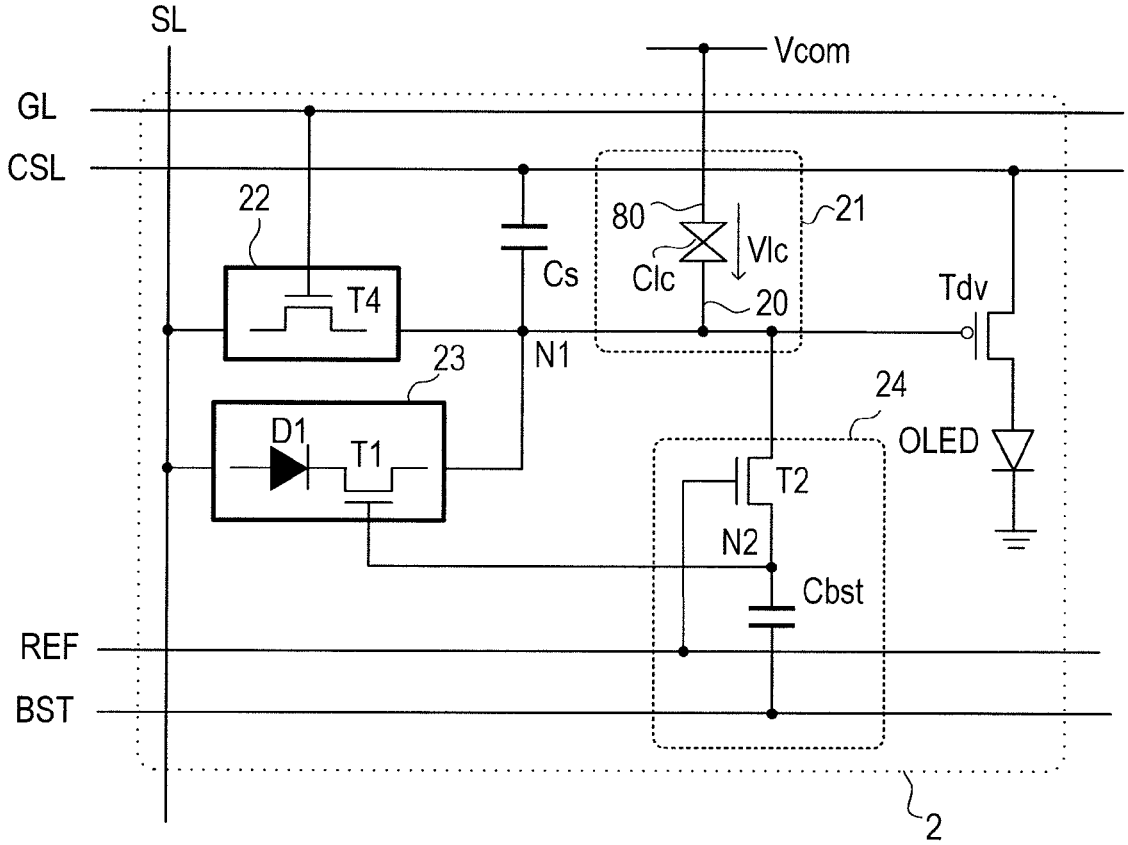
FIG. 34 is a circuit diagram showing still another basic circuit configuration of the pixel circuit of the present invention.

For example, in an organic EL (Electroluminescence) display device in which a voltage corresponding to pixel data is held in a capacity corresponding to a pixel capacity to display an image, the present invention can be especially applied to a self-refresh action. FIG. 34 is a circuit diagram showing an example of a pixel circuit of the organic EL display device. In the pixel circuit, a voltage held in the auxiliary capacity Cs as pixel data is given to a gate terminal of a drive transistor Tdv configured by a TFT, and a current corresponding to the voltage flows in a light-emitting element OLED through the drive transistor Tdv. Thus, the auxiliary capacity Cs corresponds to the pixel capacity Cp in each of the embodiments.

In the pixel circuit shown in FIG. 34, unlike in a liquid crystal display device in which a voltage is applied across electrodes to control a light transmittance to display an image, an element itself emits light by a current flowing in the element to display an image. For this reason, because of the rectification of the light-emitting element, the polarity of a voltage applied across both the terminals of the element cannot be inverted, and need not be inverted.

<8> In the second embodiment, a self-refresh action of the pixel circuit of the second type will be described with reference to the timing charts in FIG. 21 and FIG. 22. The pixel circuits 2B and 2C (FIG. 9 to FIG. 15) of the second type include the transistor T4, and include the selecting line SEL connected to the gate of the transistor T4 independently of the boost line BST. Thus, in the pixel circuits of the type, a voltage application timing to the boost line BST and a turn-on timing of the transistor T4 can be purposely differentiated.

When, by using this, a self-refresh action is performed for the pixel circuits 2B and 2C of the second type, the voltage application timing to the selecting line SEL may be slightly delayed from application timings of voltages applied to the reference line REF and the boost line BST.

As described above, to the reference line REF, a voltage falling in the range in which the transistor T2 is turned on is applied in a pixel having a gradation level lower than a gradation level to be refreshed. Thus, even though a voltage is applied to the boost line BST in this state, a potential is not raised at the node N2 in the pixel. As a result, the transistor T1 is not turned on.

However, it is assumed that, depending on the influences of the capabilities of the transistors, the parasitic capacities of the nodes, or other factors, even though the transistor T2 is turned on, when a voltage is applied to the boost line BST, the potential of the node N2 is temporarily raised. In this case, the transistor T1 is turned on at this point of time. As a result, the pixel may be disadvantageously written by a voltage having a different gradation.

In contrast to this, when the turn-on timing of the transistor T4 is slightly delayed from a voltage application timing to the boost line BST, if the potential of the node N2 temporarily increases to turn on the transistor T1 meanwhile, the transistor T4 is turned off. For this reason, conduction between the voltage supply line VSL and the node N1 can be cut off. Even though the potential of the node N2 temporarily increases, thereafter, the potential of the node N2 decreases because electric charges are absorbed in the parasitic capacity of the node N1. At this time, since the transistor T1 is turned off, even though the transistor T4 is turned on, the node N1 of a pixel circuit having a gradation level lower than a gradation level to be refreshed is not written by an applied voltage to the source line SL.

As described above, in particular, in a pixel circuit of the second type, since a voltage application timing to the selecting line SEL can be controlled independently of a voltage application timing to the boost line BST, the voltage application timing to the selecting line SEL is slightly delayed from the application timing to the boost line BST to make it reliably prevent an erroneous operation in which writing is performed at an erroneous gradation level.

This method can also be applied to the timing chart shown in FIG. 25 in the third embodiment. More specifically, in FIG. 25, the voltage application timing to the selecting line SEL may be slightly delayed from t3.

In the first type or the third type, a refresh action cannot be performed by the above method. However, since the probability of causing the above erroneous writing is originally low, a pixel circuit can be correctly refreshed to an original gradation level by a refresh action performed by the method described in the second embodiment.

EXPLANATION OF REFERENCES

1: Liquid crystal display device
2: Pixel circuit
2A, 2B, 2C, 2D, 2E: Pixel circuit
10: Active matrix substrate
11: Display control circuit
12: Counter electrode drive circuit
13: Source driver
14: Gate driver
20: Pixel electrode
21: Display element unit
22: First switch circuit
23: Second switch circuit
24: Control circuit
74: Seal member
75: Liquid crystal layer
80: Counter electrode
81: Counter substrate
Amp: Analog amplifier
BST: Boost line
Cbst: Boost capacitor element
Clc: Liquid crystal display element
CML: Counter electrode wire
CSL: Auxiliary capacitive line
Cs: Auxiliary capacitor element
Ct: Timing signal
D1: Diode
DA: Digital image signal
Dv: Data signal
GL (GL1, GL2, GLn): Gate line
Gtc: Scanning-side timing control signal
N1: Internal node
N2: Output node
OLED: Light emitting element
P1, P2: Phase
REF: Reference line
S1, S2: Step
Sc1, Sc2, Scm: Source signal
SEL: Selecting line
SL (SL1, SL2, SLm): Source line
Stc: Data-side timing control signal
T1, T2, T3, T4, T5: Transistor
Tdv: Drive transistor
Vcom: Counter voltage
Vlc: Liquid crystal voltage
VN1: Internal node potential, Pixel electrode potential
VN2: Output node potential

The invention claimed is:

1. A pixel circuit comprising:

a display element unit including a unit display element;

an internal node that is a part of the display element unit and holds a voltage of pixel data applied to the display element unit;

a first switch circuit that transfers the voltage of the pixel data supplied from a data signal line to the internal node through at least a predetermined switch element;

a second switch circuit that transfers a voltage supplied from a voltage supply line different from the data signal line to the internal node without passing through the predetermined switch element; and a control circuit that holds a predetermined voltage depending on the voltage of the pixel data held by the internal node at one end of a first capacitor element and controls on/off of the second switch circuit, wherein the second switch circuit is configured by a series circuit including a first transistor element having a first terminal, a second terminal, and a control terminal that controls conduction between the first and second terminals, and a diode element, the control circuit is configured by a series circuit including a second transistor element having a first terminal, a second terminal, and a control terminal that controls conduction between the first and second terminals, and the first capacitor element, one end of the first switch circuit is connected to the data signal line, one end of the second switch circuit is connected to the voltage supply line, the other ends of the first and second switch circuits and the first terminal of the second transistor element are connected to the internal node, the diode element has a rectifying function in a direction from the voltage supply line to the internal node, the control terminal of the first transistor element, the second terminal of the second transistor element, and the one end of the first capacitor element are connected to each other to form an output node of the control circuit, the control terminal of the second transistor element is connected to a first control line, and the other end of the first capacitor element is connected to a second control line.

2. The pixel circuit according to claim 1, wherein the predetermined switch element is configured by a third transistor element having a first terminal, a second terminal, and a control terminal that controls conduction between the first and second terminals, and the control terminal of the third transistor element is connected to a scanning signal line.

3. The pixel circuit according to claim 1, wherein the second switch circuit is configured by a series circuit including the first transistor element, the diode element, and a fourth transistor element having a first terminal, a second terminal, and a control terminal that controls conduction between the first and second terminals, and the control terminal of the fourth transistor element is connected to the second control line or the third control line.

4. The pixel circuit according to claim 3, wherein the first switch circuit is configured by a series circuit of the fourth transistor element in the second switch circuit and the predetermined switch element or a series circuit of a fifth transistor element having a control terminal connected to the control terminal of the fourth transistor element in the second switch circuit and the predetermined switch element.

5. The pixel circuit according to claim 1, further comprising a second capacitor element having one end connected to the internal node and having the other end connected to a fourth control line or a predetermined fixed voltage line.

6. A display device comprising a pixel circuit array provided by arranging a plurality of pixel circuits each according to claim 1 in a row direction and a column direction, wherein the data signal line is arranged for each of the columns, one ends of the first switch circuits in the pixel circuits arranged along the same column are connected to a common data signal line, control terminals of the second transistor elements in the pixel circuits arranged along the same row or the same column are connected to a common first control line, the other ends of the first capacitor elements in the pixel circuits arranged along the same row or the same column are connected to a common second control line, one ends of the second switch circuits in the pixel circuits arranged along the same row or the same column are connected to a common voltage supply line, and a data signal line drive circuits that drives the data signal lines independently, and a control line drive circuit that drives the first control line, the second control line, and the voltage supply line independently are provided.

7. The display device according to claim 6, wherein the predetermined switch element is a third transistor element having a first terminal, a second terminal, and a control terminal that controls conduction between the first and second terminals, and the control terminal is connected to a scanning signal line, the scanning signal line is arranged for each of the rows, and the pixel circuits arranged along the same row are connected to a common scanning signal line, and a scanning signal line drive circuit that drives the scanning signal lines independently is provided.

8. The display device according to claim 7, wherein the second switch circuit is configured by a series circuit including the first transistor element, the diode element, and a fourth transistor element having a first terminal, a second terminal, and a control terminal that controls conduction between the first and second terminals, and the control terminals of the fourth transistor elements in the pixel circuits arranged along the same row or the same column are connected to the common second control line.

9. The display device according to claim 7, wherein the second switch circuit is configured by a series circuit including the first transistor element, the diode element, and a fourth transistor element having a first terminal, a second terminal, and a control terminal that controls conduction between the first and second terminals, the control terminals of the fourth transistor elements in the pixel circuits arranged along the same row or the same column are connected to a common third control line, and the control line drive circuit drives the first to third control lines independently.

10. The display device according to claim 8, wherein the first switch circuit is configured by a series circuit including the fourth transistor element in the second switch circuit and the third transistor element or a series circuit including a fifth transistor element having a control terminal connected to the control terminal of the fourth transistor element in the second switch circuit and the third transistor element.

11. The display device according to claim 9, wherein the first switch circuit is configured by a series circuit including the fourth transistor element in the second switch circuit and the third transistor element or a series circuit including a fifth transistor element having a control terminal connected to the control terminal of the fourth transistor element in the second switch circuit and the third transistor element.

12. The display device according to claim 7, wherein, in a writing action for writing the pixel data in the pixel circuits arranged along one selected row independently, the scanning signal line drive circuit applies a predetermined selected row voltage to the scanning signal line of the selected row to turn on the third transistor elements arranged along the selected row and applies a predetermined non-selected row voltage to the scanning signal line of a non-selected row to turn off the third transistor elements arranged along the non-selected row, and the data signal line drive circuit applies data voltages corresponding to pixel data to be written in the pixel circuits of the columns of the selected row to the data signal lines, independently.

13. The display device according to claim 12, wherein, in the writing action, the control line drive circuit applies a predetermined voltage to the first control line to turn on the second transistor element.

14. The display device according to claim 10, wherein, in a writing action for writing the pixel data in the pixel circuits arranged along one selected row independently, the scanning signal line drive circuit applies a predetermined selected row voltage to the scanning signal line of the selected row to turn on the third transistor elements arranged along the selected row, and applies a predetermined non-selected row voltage to the scanning signal line of a non-selected row to turn off the third transistor elements arranged along the non-selected row, the control line drive circuit applies a predetermined selecting voltage to the second control line of the selected row to turn on the fourth transistor elements, and applies a predetermined non-selecting voltage to the second control line of the non-selected row to turn off the fourth transistor elements, and the data signal line drive circuit applies data voltages corresponding to the pixel data to be written in the pixel circuits of the columns of the selected row to the data signal lines, independently.

15. The display device according to claim 11, wherein, in a writing action for writing the pixel data in the pixel circuits arranged along one selected row, the scanning signal line drive circuit applies a predetermined selected row voltage to the scanning signal line of the selected row to turn on the third transistor elements arranged along the selected row, and applies a predetermined non-selected row voltage to the scanning signal line of a non-selected row to turn off the third transistor elements arranged along the non-selected row, the control line drive circuit applies a predetermined selecting voltage to the third control line of the selected row to turn on the fourth transistor elements, and applies a predetermined non-selecting voltage to the third control line of the non-selected row to turn off the fourth transistor elements, and the data signal line drive circuit applies data voltages corresponding to the pixel data to be written in the pixel circuits of the columns of the selected row to the data signal lines, independently.

16. The display device according to claim 7, wherein the internal nodes of the pixel circuits in the pixel circuit array can hold one voltage state among a plurality of discrete voltage states, in which a multi-tone mode is realized by different voltage states, and in a self-refresh action for compensating for voltage variations of the internal nodes at the same time by operating the second switch circuit and the control circuit in the plurality of pixel circuits, the scanning signal line drive circuit applies a predetermined voltage to the scanning signal lines connected to all the pixel circuits in the pixel circuit array to turn off the third transistor elements, and in a state in which the control line drive circuit applies to the voltage supply line a refresh input voltage obtained by adding a predetermined first adjusting voltage corresponding to a voltage drop in the second switch circuit to a refresh target voltage corresponding to a voltage state of a target gradation level in which a refresh action is to be executed, and applies to the first control line a refresh reference voltage obtained by adding a predetermined second adjusting voltage corresponding to voltage drops in the first control line and the internal node to a refresh isolation voltage defined by an intermediate voltage between a voltage state of a gradation level one step lower than the target gradation level and a voltage state of the target gradation level, the control line drive circuit applies a boost voltage having a predetermined amplitude to the second control line to give a voltage change by a capacitive coupling through the first capacitor element to the output node, when a voltage state of the internal node is higher than the refresh target voltage, the diode element is reversely biased from the voltage supply line to the internal node not to electrically connect the voltage supply line to the internal node, when the voltage state of the internal node is lower than the refresh isolation voltage, a potential variation of the output node due to application of the boost voltage is suppressed to turn off the first transistor element not to electrically connect the voltage supply line to the internal node, and when the voltage state of the internal node is the refresh isolation voltage or more and the refresh target voltage or less, the diode element is forwardly biased from the voltage supply line to the internal node, the first transistor element is turned on without suppressing a potential variation of the output node to give the refresh target voltage to the internal node, so that the refresh action to the pixel circuit having the internal node that exhibits the voltage state of the target gradation level is executed.

17. The display device according to claim 9, wherein the internal nodes of the pixel circuits in the pixel circuit array can hold one voltage state among a plurality of discrete voltage states, in which a multi-tone mode is realized by different voltage states, and in a self-refresh action for compensating for voltage variations of the internal nodes at the same time by operating the second switch circuit and the control circuit in the plurality of pixel circuits, the scanning signal line drive circuit applies a predetermined voltage to the scanning signal lines connected to all the pixel circuits in the pixel circuit array to turn off the third transistor elements, and in a state in which the control line drive circuit applies to the voltage supply line a refresh input voltage obtained by adding a predetermined first adjusting voltage corresponding to a voltage drop in the second switch circuit to a refresh target voltage corresponding to a voltage state of a target gradation level in which a refresh action is to be executed, applies to the first control line a refresh reference voltage obtained by adding a predetermined second adjusting voltage corresponding to voltage drops in the first control line and the internal node to a refresh isolation voltage defined by an intermediate voltage between a voltage state of a gradation level one step lower than the target gradation level and a voltage state of the target gradation level, and applies a predetermined voltage to turn on the fourth transistor element to the third control line, the control line drive circuit applies a boost voltage having a predetermined amplitude to the second control line to give a voltage change by a capacitive coupling through the first capacitor element to the output node, when a voltage state of the internal node is higher than the refresh target voltage, the diode element is reversely biased from the voltage supply line to the internal node not to electrically connect the voltage supply line to the internal node, when the voltage state of the internal node is lower than the refresh isolation voltage, a potential variation of the output node due to application of the boost voltage is suppressed to turn off the first transistor element not to electrically connect the voltage supply line to the internal node, and when the voltage state of the internal node is the refresh isolation voltage or more and the refresh target voltage or less, the diode element is forwardly biased from the voltage supply line to the internal node, the first transistor element is turned on without suppressing a potential variation of the output node to give the refresh target voltage to the internal node, so that the refresh action to the pixel circuit having the internal node that exhibits the voltage state of the target gradation level is executed.

18. The display device according to claim 16, wherein, in a state in which the third transistor element is turned off, the refresh input voltage is applied to the voltage supply line, and the refresh reference voltage is applied to the first control line, an action of applying the boost voltage to the second control line is executed more than once while changing the values of the refresh input voltage and the refresh isolation voltage, so that the refresh action is sequentially executed to the pixel circuits having the internal nodes that exhibit voltage states of different gradation levels.

19. The display device according to claim 18, wherein, while the values of the refresh input voltage and the refresh isolation voltage are changed the number of times that is equal to a number obtained by subtracting 1 from the number of gradation levels that is the number of voltage states that can be held by the internal nodes of the pixel circuits in the pixel circuit array, the boost voltage is applied.

20. The display device according to claim 18, wherein, after a refresh step in which, in a state in which the third transistor element is turned off, the refresh input voltage is applied to the voltage supply line, and the refresh reference voltage is applied to the first control line, an action of applying the boost voltage to the second control line is executed more than once while changing the values of the refresh input voltage and the refresh isolation voltage, a standby step is performed in which the data signal line drive circuit applies a voltage corresponding to a minimum value of a voltage state that can be held by the internal node to the data signal line, and the control line drive circuit applies a voltage corresponding to a minimum value in the voltage state that can be held by the internal node to the voltage supply line without applying the boost voltage to the second control line, and applies a voltage to turn on the second transistor element regardless of the voltage state of the internal node to the first control line for at least a predetermined period of time.

21. The display device according to claim 20, wherein after the standby step is executed for a period of time that is ten or more times as long as that of the refresh step, the refresh step is executed again.

22. The display device according to claim 16, wherein the first adjusting voltage is a turn-on voltage of the diode element.

23. The display device according to claim 16, wherein the second adjusting voltage is a threshold voltage of the second transistor element.

24. The display device according to claim 9, wherein the internal nodes of the pixel circuits in the pixel circuit array can hold one voltage state among a plurality of discrete voltage states, in which a multi-tone mode is realized by different voltage states, and in a self-refresh action for compensating for voltage variations of the internal nodes at the same time by operating the second switch circuit and the control circuit in the plurality of pixel circuits, the scanning signal line drive circuit applies a predetermined voltage to the scanning signal lines connected to all the pixel circuits in the pixel circuit array to turn off the third transistor elements, and in a state in which the control line drive circuit applies to the voltage supply line a refresh input voltage obtained by adding a predetermined first adjusting voltage corresponding to a voltage drop in the second switch circuit to a refresh target voltage corresponding to a voltage state of a target gradation level in which a refresh action is to be executed, and applies to the first control line a refresh reference voltage obtained by adding a predetermined second adjusting voltage corresponding to voltage drops in the first control line and the internal node to a refresh isolation voltage defined by an intermediate voltage between a voltage state of a gradation level one step lower than the target gradation level and a voltage state of the target gradation level, the control line drive circuit applies a boost voltage having a predetermined amplitude to the second control line to give a voltage change by a capacitive coupling through the first capacitor element to the output node, and thereafter applies a predetermined voltage to turn on the fourth transistor element to the third control line, when a voltage state of the internal node is higher than the refresh target voltage, the diode element is reversely biased from the voltage supply line to the internal node not to electrically connect the voltage supply line to the internal node, when the voltage state of the internal node is lower than the refresh isolation voltage, a potential variation of the output node due to application of the boost voltage is suppressed to turn off the first transistor element not to electrically connect the voltage supply line to the internal node, and when the voltage state of the internal node is the refresh isolation voltage or more and the refresh target voltage or less, the diode element is forwardly biased from the voltage supply line to the internal node, the first transistor element is turned on without suppressing a potential variation of the output node to give the refresh target voltage to the internal node, so that the refresh action to the pixel circuit having the internal node that exhibits the voltage state of the target gradation level is executed.

25. The display device according to claim 9, wherein, in the self-refresh action, a first gradation level is set as the target gradation level, and in a state in which the refresh input voltage is applied to the voltage supply line and the refresh reference voltage is applied to the first control line, the boost voltage is applied to the second control line, and then while the boost voltage is continuously applied, a second gradation level one step higher than the first gradation level is set as the target gradation level, the refresh reference voltage applied to the first control line is changed, and thereafter the refresh input voltage applied to the voltage supply line is changed, so that the refresh action is sequentially executed to the pixel circuit having the internal node that exhibits voltage states having different gradation levels.

26. The display device according to claim 25, wherein when a gradation level higher than the second gradation level is present, after the refresh action to the second gradation level is completed, while the boost voltage is still continuously applied, an action in which a one step higher gradation level is set as the target gradation level, the refresh reference voltage applied to the first control line is changed, and thereafter the refresh input voltage applied to the voltage supply line is changed is repeatedly executed.

27. The display device according to claim 17, wherein in the self-refresh action, a first gradation level is set as the target gradation level, and in a state in which the refresh input voltage is applied to the voltage supply line and the refresh reference voltage is applied to the first control line, the boost voltage is applied to the second control line and a predetermined voltage that turns on the fourth transistor element is applied to the third control line, and then while the boost voltage and the predetermined voltage that turns on the fourth transistor element are continuously applied, a second gradation level one step higher than the first gradation level is set as the target gradation level, the refresh reference voltage applied to the first control line is changed, and thereafter the refresh input voltage applied to the voltage supply line is changed, so that the refresh action is sequentially executed to the pixel circuit having the internal node that exhibits voltage states having different gradation levels.

28. The display device according to claim 27, wherein when a gradation level higher than the second gradation level is present, after the refresh action to the second gradation level is completed, while the boost voltage and the predetermined voltage that turns on the fourth transistor element are still continuously applied, an action in which a one step higher gradation level is set as the target gradation level, the refresh reference voltage applied to the first control line is changed, and thereafter the refresh input voltage applied to the voltage supply line is changed is repeatedly executed.

* * * * *